US008342910B2

(12) United States Patent
Dinh-Ngoc et al.

(10) Patent No.: US 8,342,910 B2
(45) **Date of Patent: *Jan. 1, 2013**

(54) ABRASIVE TOOL FOR USE AS A CHEMICAL MECHANICAL PLANARIZATION PAD CONDITIONER

(75) Inventors: Charles Dinh-Ngoc, Holliston, MA (US); Srinivasan Ramanath, Holden, MA (US); Eric M. Schulz, Worcester, MA (US); Jianhui Wu, Westborough, MA (US); Thomas Puthanangady, Shrewsbury, MA (US); Ramanujam Vedantham, Worcester, MA (US); Taewook Hwang, Acton, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 129 days.

This patent is subject to a terminal disclaimer.

(21) Appl. No.: 12/651,326

(22) Filed: Dec. 31, 2009

(65) Prior Publication Data

US 2010/0248595 A1 Sep. 30, 2010

Related U.S. Application Data

(60) Provisional application No. 61/162,893, filed on Mar. 24, 2009, provisional application No. 61/235,980, filed on Aug. 21, 2009.

(51) Int. Cl.
*B24B 1/00* (2006.01)

(52) U.S. Cl. ..... 451/56; 451/443

(58) Field of Classification Search ..... 451/41, 451/56, 443
See application file for complete search history.

(56) References Cited

U.S. PATENT DOCUMENTS

| | | | | |
|---|---|---|---|---|
| 2,175,073 | A | 10/1939 | Amstuz | |
| 3,341,984 | A * | 9/1967 | Sickle et al. | 451/490 |
| RE26,879 | E | 5/1970 | Kelso | |
| 3,990,124 | A | 11/1976 | MacKay, Jr. et al. | |
| 4,222,204 | A | 9/1980 | Benner | |
| 4,818,515 | A | 4/1989 | Ceresa et al. | |
| 4,925,457 | A * | 5/1990 | deKok et al. | 51/293 |

(Continued)

FOREIGN PATENT DOCUMENTS

CN 1482959 3/2004

(Continued)

OTHER PUBLICATIONS

De Pellegrin, D. V., et al., "The Measurement and Description of Diamond Shape in Abrasion," Department of Mechanical and Manufacturing Engineering, University of Dublin, Ireland, 16 pgs.

(Continued)

*Primary Examiner* — Maurina Rachuba
(74) *Attorney, Agent, or Firm* — Abel Law Group, LLP; Joseph P. Sullivan

(57) ABSTRACT

An abrasive tool including a CMP pad conditioner having a substrate including a first major surface, a second major surface opposite the first major surface, and a side surface extending between the first major surface and the second major, wherein a first layer of abrasive grains is attached to the first major surface and a second layer of abrasive grains is attached to the second major surface. The conditioner further includes a first sealing member extending in a peripheral direction along a portion of the side surface of the substrate.

15 Claims, 22 Drawing Sheets

U.S. PATENT DOCUMENTS

| | | | | |
|---|---|---|---|---|
| 4,951,423 | A | 8/1990 | Johnson | |
| 4,968,326 | A | 11/1990 | Wiand | |
| 5,014,468 | A | 5/1991 | Ravipati et al. | |
| 5,049,165 | A | 9/1991 | Tselesin | |
| 5,152,917 | A | 10/1992 | Pieper et al. | |
| 5,219,462 | A | 6/1993 | Bruxvoort et al. | |
| 5,304,223 | A | 4/1994 | Pieper et al. | |
| 5,352,493 | A | 10/1994 | Dorfman et al. | |
| 5,382,189 | A | 1/1995 | Arendall | |
| 5,466,431 | A | 11/1995 | Dorfman et al. | |
| 5,492,771 | A | 2/1996 | Lowder et al. | |
| 5,511,718 | A | 4/1996 | Lowder et al. | |
| 5,645,474 | A | 7/1997 | Kubo et al. | |
| 5,669,943 | A | 9/1997 | Horton et al. | |
| 5,683,289 | A | 11/1997 | Hempel, Jr. | |
| 5,791,975 | A | 8/1998 | Cesna et al. | |
| 5,795,648 | A | 8/1998 | Goel et al. | |
| 5,833,724 | A | 11/1998 | Wei et al. | |
| 5,842,912 | A | 12/1998 | Holzapfel et al. | |
| 5,851,138 | A | 12/1998 | Hempel, Jr. | |
| 5,863,306 | A | 1/1999 | Wei et al. | |
| 5,919,084 | A | 7/1999 | Powell et al. | |
| 5,921,856 | A | 7/1999 | Zimmer | |
| 5,980,678 | A | 11/1999 | Tselesin | |
| 6,022,266 | A | 2/2000 | Bullard et al. | |
| 6,039,641 | A | 3/2000 | Sung | |
| 6,096,107 | A | 8/2000 | Caracostas et al. | |
| 6,099,603 | A * | 8/2000 | Johnson | 51/297 |
| 6,123,612 | A | 9/2000 | Goers | |
| 6,136,043 | A | 10/2000 | Robinson et al. | |
| 6,136,143 | A | 10/2000 | Winter et al. | |
| 6,159,087 | A | 12/2000 | Birang et al. | |
| 6,200,675 | B1 | 3/2001 | Neerinck et al. | |
| 6,234,883 | B1 | 5/2001 | Berman et al. | |
| 6,263,605 | B1 * | 7/2001 | Vanell | 451/443 |
| 6,286,498 | B1 * | 9/2001 | Sung | 125/12 |
| 6,288,648 | B1 * | 9/2001 | Easter et al. | 340/635 |
| 6,293,980 | B2 | 9/2001 | Wei et al. | |
| 6,309,433 | B1 | 10/2001 | Kinoshita | |
| 6,347,982 | B1 | 2/2002 | Holzapfel | |
| 6,358,133 | B1 | 3/2002 | Cesna et al. | |
| 6,368,198 | B1 | 4/2002 | Sung et al. | |
| 6,390,909 | B2 * | 5/2002 | Foster et al. | 451/444 |
| 6,402,603 | B1 | 6/2002 | Watson et al. | |
| 6,416,878 | B2 | 7/2002 | An | |
| 6,468,642 | B1 | 10/2002 | Bray et al. | |
| 6,508,697 | B1 * | 1/2003 | Benner et al. | 451/443 |
| 6,511,713 | B2 | 1/2003 | Mathisen et al. | |
| 6,537,140 | B1 | 3/2003 | Miller et al. | |
| 6,572,446 | B1 | 6/2003 | Osterheld et al. | |
| 6,575,353 | B2 | 6/2003 | Palmgren | |
| 6,626,747 | B1 | 9/2003 | Sidebottom | |
| 6,679,243 | B2 * | 1/2004 | Sung | 125/12 |
| 6,769,975 | B2 | 8/2004 | Sagawa | |
| 6,818,029 | B2 | 11/2004 | Myoung et al. | |
| 6,887,138 | B2 | 5/2005 | Bottema et al. | |
| 6,945,857 | B1 * | 9/2005 | Doan et al. | 451/56 |
| 7,124,753 | B2 | 10/2006 | Sung | |
| 7,217,172 | B2 | 5/2007 | Benner | |
| 7,258,708 | B2 | 8/2007 | Sung | |
| 7,467,989 | B2 | 12/2008 | Lin et al. | |
| 7,507,267 | B2 * | 3/2009 | Hall et al. | 51/293 |
| 7,575,503 | B2 | 8/2009 | Benner | |
| 7,641,538 | B2 | 1/2010 | Goers | |
| 6,261,167 | B1 | 7/2010 | Watson et al. | |
| 2002/0068518 | A1 | 6/2002 | Cesena et al. | |
| 2002/0072302 | A1 | 6/2002 | Robinson et al. | |
| 2002/0173234 | A1 | 11/2002 | Sung et al. | |
| 2002/0197947 | A1 | 12/2002 | Sagawa | |
| 2003/0036341 | A1 | 2/2003 | Myoung et al. | |
| 2004/0037948 | A1 | 2/2004 | Tank et al. | |
| 2004/0180617 | A1 * | 9/2004 | Goers | 451/443 |
| 2004/0198206 | A1 | 10/2004 | Toge et al. | |
| 2005/0025973 | A1 | 2/2005 | Slutz et al. | |
| 2005/0118820 | A1 | 6/2005 | Akahori et al. | |
| 2005/0153634 | A1 | 7/2005 | Prasad et al. | |
| 2005/0214201 | A1 | 9/2005 | Maruno et al. | |
| 2005/0215188 | A1 | 9/2005 | Toge et al. | |
| 2005/0260922 | A1 | 11/2005 | Gan et al. | |
| 2005/0276979 | A1 | 12/2005 | Slutz et al. | |
| 2006/0010780 | A1 | 1/2006 | Hall et al. | |
| 2006/0073774 | A1 | 4/2006 | Sung | |
| 2006/0079162 | A1 | 4/2006 | Yamashita et al. | |
| 2006/0213128 | A1 | 9/2006 | Sung | |
| 2006/0254154 | A1 | 11/2006 | Huang et al. | |
| 2007/0049185 | A1 | 3/2007 | Lin et al. | |
| 2007/0060026 | A1 | 3/2007 | Sung et al. | |
| 2007/0066194 | A1 | 3/2007 | Wielonski et al. | |
| 2007/0235801 | A1 | 10/2007 | Cheng et al. | |
| 2007/0259609 | A1 | 11/2007 | Liyoshi et al. | |
| 2008/0004743 | A1 | 1/2008 | Goers et al. | |
| 2008/0132153 | A1 | 6/2008 | Rikita et al. | |
| 2008/0153398 | A1 | 6/2008 | Sung | |
| 2008/0193649 | A1 | 8/2008 | Jacquet et al. | |
| 2008/0248734 | A1 | 10/2008 | Bajaj | |
| 2008/0271384 | A1 * | 11/2008 | Puthanangady et al. | 51/309 |
| 2009/0053980 | A1 | 2/2009 | Hwang et al. | |
| 2009/0206304 | A1 | 8/2009 | Dziomkina | |
| 2010/0022174 | A1 | 1/2010 | Chou et al. | |
| 2010/0248595 | A1 | 9/2010 | Dinh-Ngoc et al. | |
| 2010/0330886 | A1 * | 12/2010 | Wu et al. | 451/56 |
| 2011/0097977 | A1 * | 4/2011 | Bubnick et al. | 451/56 |

FOREIGN PATENT DOCUMENTS

| | | | |
|---|---|---|---|
| DE | 69210221 | T2 | 1/1997 |
| DE | 10109892 | A1 | 9/2002 |
| DE | 10296547 | T5 | 5/2006 |
| EP | 1020303 | A1 | 7/2000 |
| EP | 1208945 | A1 | 5/2002 |
| EP | 1297928 | A1 | 4/2003 |
| EP | 1346797 | A | 9/2003 |
| JP | 04-250978 | A | 9/1992 |
| JP | 2000-052254 | A | 2/2000 |
| JP | 2002-178264 | | 6/2002 |
| JP | 2003-53665 | | 2/2003 |
| JP | 2003048163 | A | 2/2003 |
| JP | 2003094332 | A | 4/2003 |
| JP | 2003117822 | A | 4/2003 |
| JP | 2004025377 | A | 1/2004 |
| JP | 2004066409 | A | 3/2004 |
| JP | 2004202639 | A | 7/2004 |
| JP | 2007109767 | A | 4/2007 |
| JP | 04-084944 | B2 | 4/2008 |
| JP | 2008114334 | A | 5/2008 |
| JP | 20088186998 | A | 8/2008 |
| JP | 2008229775 | A | 10/2008 |
| WO | 2005039828 | A1 | 5/2005 |
| WO | 2008/002735 | A2 | 1/2008 |
| WO | 2008036892 | A1 | 3/2008 |

OTHER PUBLICATIONS

Hwang, Taewook et al., "Optimized and Customized CMP Conditioner Design for Next Generation Oxide/Metal CMP," Saint-Gobain High Performance Materials, 6 pgs.

Hwang, Taewook et al., "Advanced Pad Conditioner Design for Oxide/Metal CMP," Saint-Gobain High Performance Materials, Transactions on Electrical and Electronic Materials, vol. 7, No. 2, Apr. 2006, pp. 62-66.

Popp U, et al., "Properties of nanocrysatlline ceramic powder preparation by laser evaporation and recondensation," Nanocrystal, Jan. 1, 1998, vol. 18, No. 9.

English abstract of Japanese Patenet Publication No. JP3895840B2, published on Mar. 22, 2007. Application Asahi Diamnd Kogyo KK.

International Search Report and Written Opinion of the International Searching Authority mailed Mar. 14, 2011, from counterpart International application No. PCT/US2010/036895, filed on Jun. 1, 2010.

International Search Report from International Application No. PCT/US2009/069961 (1 pg.) dated Aug. 13, 2010.

Elmufdi, Carolina, L., et al., "The Impact of Pad Microtexture and Material Properties on Surface Contact and Defectivity in CMP," Pad Engineering Research Group, 11th International CMP Symposium, Lake Placid, NY, Aug. 15, 2006, 18 pgs.

Hwang, Taewook et al., "Advanced Pad Conditioner Design for Oxide/Metal CMP, " Saint-Gobain High Performance Materials, Transactions on Electrical and Electronic Materials, vol. 7, No. 2, Apr. 2006, pp. 62-66.
Lawing, A. Scott, "Pad Conditioning and Textural Effects in Chemical Mechanical Polishing," Rohm and Haas Electronic Materials CMP Technologies, CMP-MIC Conference, Feb. 23-25, 2005, pp. 33-42.

* cited by examiner

ABRASIVE TOOL FOR USE AS A CHEMICAL MECHANICAL PLANARIZATION PAD CONDITIONER

CROSS-REFERENCE TO RELATED APPLICATION(S)

The present application claims priority from (i) U.S. Provisional Patent Application No. 61/162,893, filed Mar. 24, 2009, entitled "Abrasive Tool For Use As A Chemical Mechanical Planarization Pad Conditioner," naming inventors Charles Dinh-Ngoc, Srinivasan Ramanath, Eric M. Schulz, Jianhui Wu, Thomas Puthanangady, Ramanujam Vedantham, and Taewook Hwang, and (ii) U.S. Provisional Patent Application No. 61/235,980, filed Aug. 21, 2009, entitled "Abrasive Tool For Use As A Chemical Mechanical Planarization Pad Conditioner," naming inventors Charles Dinh-Ngoc, Srinivasan Ramanath, Eric M. Schulz, Jianhui Wu, Thomas Puthanangady, Ramanujam Vedantham, and Taewook Hwang, which applications are both incorporated by reference herein in their entirety

BACKGROUND

1. Field of the Disclosure

The following application is directed to an abrasive tool, and more particularly to an abrasive tool for use as a chemical mechanical planarization pad conditioner.

2. Description of the Related Art

In the fabrication of electronic devices, multiple layers of various types of material are deposited including for example conducting, semiconducting, and dielectric materials. Successive deposition or growth and removal of various layers results in a non-planar upper surface. A wafer surface that is not sufficiently planar will result in structures that are poorly defined, with the circuits being nonfunctional or exhibiting less than optimum performance. Chemical mechanical planarization (CMP) is a common technique used to planarize or polish workpieces such as semiconductor wafers.

During a typical CMP process, a workpiece is placed in contact with a polishing pad and a polishing slurry is provided on the pad to aid in the planarization process. The polishing slurry can include abrasive particles which may interact with the workpiece in an abrasive manner to remove materials, and may also act in a chemical manner to improve the removal of certain portions of the workpiece. The polishing pad is typically much larger than the workpiece, and is generally a polymer material that can include certain features, such as micro-texture suitable for holding the slurry on the surface of the pad.

During such polishing operations, a pad conditioner is typically employed to move over the surface of the polishing pad to clean the polishing pad and properly condition the surface to hold slurry. Polishing pad conditioning is important to maintaining a desirable polishing surface for consistent polishing performance, since the surface of the polishing pad wears down over time and resulting in smoothing of micro-texture of the pad. Still, the conditioning operation faces certain obstacles, including the presence of polishing debris which can clog the components, chemical corrosion, conditioner geometry irregularity, conditioner over-use, and grain pull-out, which can interfere with conditioning operations and damage the sensitive electronic components being polished.

Accordingly, the industry continues to demand improved CMP pad conditioners and methods of forming thereof.

SUMMARY

According to a first aspect an abrasive tool includes a CMP pad conditioner having a substrate including a first major surface and a second major surface opposite the first major surface, a first layer of abrasive grains attached to the first major surface, and a second layer of abrasive grains attached to the second major surface. The abrasive tool can further include a first indicia on the substrate corresponding to the first major surface and identifying a wear status of the first layer of abrasive grains.

In another aspect, an abrasive tool includes a CMP pad conditioner having a substrate including a first major surface, a second major surface opposite the first major surface, and a side surface extending between the first major surface and the second major. The CMP pad conditioner further includes a first layer of abrasive grains attached to the first major surface, a second layer of abrasive grains attached to the second major surface, and a first sealing member extending in a peripheral direction along a portion of the side surface of the substrate.

In still other aspects, an abrasive tool for use as a CMP pad conditioner is disclosed that includes a plate, and an abrasive article that includes a substrate having a first major surface and a second major surface opposite the first major surface. The CMP pad conditioner also includes a first layer of abrasive grains attached to the first major surface, a second layer of abrasive grains attached to the second major surface, and an engagement structure configured to engage a portion of the plate and removably couple the abrasive article and the plate.

Other aspects are directed to an abrasive tool for use as a CMP pad conditioner including a plate and an abrasive article having a substrate including a first major surface and a second major surface opposite the first major surface, a first layer of abrasive grains attached to the first major surface, and a second layer of abrasive grains attached to the second major surface. The abrasive tool is formed such that the plate and abrasive article are removably coupled via a coupling mechanism.

In accordance with another aspect, an abrasive tool for use as a CMP pad conditioner includes an abrasive article made of a substrate having a first major surface and a second major surface opposite the first major surface, a first layer of abrasive grains attached to the first major surface, and a second layer of abrasive grains attached to the second major surface. In particular, the plate includes a magnet for removably coupling the plate and abrasive article.

According to still another aspect, an abrasive tool for use as a CMP pad conditioner is disclosed that includes a plate comprising a recess, and an abrasive article removably coupled within the recess. The abrasive article includes a substrate having a first major surface and a first layer of abrasive grains attached to the first major surface, and wherein the first layer of abrasive grains have a flatness of not greater than about 0.02 cm as measured by optical auto-focusing technology.

Other aspects of the present disclosure are directed to a method of forming an abrasive article that includes the steps of placing a first bonding layer material on a first major surface of a substrate, wherein the substrate comprises an engagement structure configured to removably couple the substrate to a plate, and placing a first layer of abrasive grains within the first bonding layer material. The method further includes placing a second bonding layer material on a second major surface of the substrate, wherein the second major surface is opposite the first major surface, placing a second layer of abrasive grains within the second bonding layer material, and forming a CMP pad conditioner comprising a first abrasive surface defined by the first layer of abrasive grains on the first major surface and a second abrasive surface defined by the second layer of abrasive grains on the second major surface.

In another aspect an abrasive tool includes a CMP pad conditioner made of a substrate having a first major surface and a second major surface opposite the first major surface, wherein the first major surface includes an abrasive texture including a first upper surface defined by upper portions of a first set of protrusions extending from a lower surface defined by a first set of grooves separating the first set of protrusions. The second major surface includes an abrasive texture including a second upper surface defined by upper portions of a second set of protrusions extending from a lower surface defined by a second set of grooves separating the second set of protrusions.

According to still another aspect, a method of dressing a CMP pad is disclosed that includes the steps of coupling an abrasive article to a dressing machine, the abrasive article includes a substrate having a first major surface and a second major surface opposite the first major surface, wherein the abrasive article includes a first abrasive surface at the first major surface of the substrate, and a second abrasive surface at the second major surface of the substrate, and wherein the abrasive article is mounted on the dressing machine to expose the first abrasive surface. The method further includes contacting the first abrasive surface to a surface of a first CMP pad and moving the first CMP pad relative to the first abrasive surface to condition the first CMP pad, inverting the abrasive article to expose the second abrasive surface, and contacting the second abrasive surface to a surface of a second CMP pad and moving the second CMP pad relative to the second abrasive surface to condition the second CMP pad.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

The following is directed to an abrasive tool for use as a chemical mechanical planarization (CMP) pad conditioner, also referred to as a dresser. The abrasive tool includes a plurality of features including an abrasive article having two (first and second) abrading surfaces and coupling mechanisms for removably coupling the abrasive article with a fixture or plate. The abrasive tool can include different types of engagement structures facilitating removal and reversing of the abrasive tool such that both first and second abrading surfaces are useable.

Figure 1:
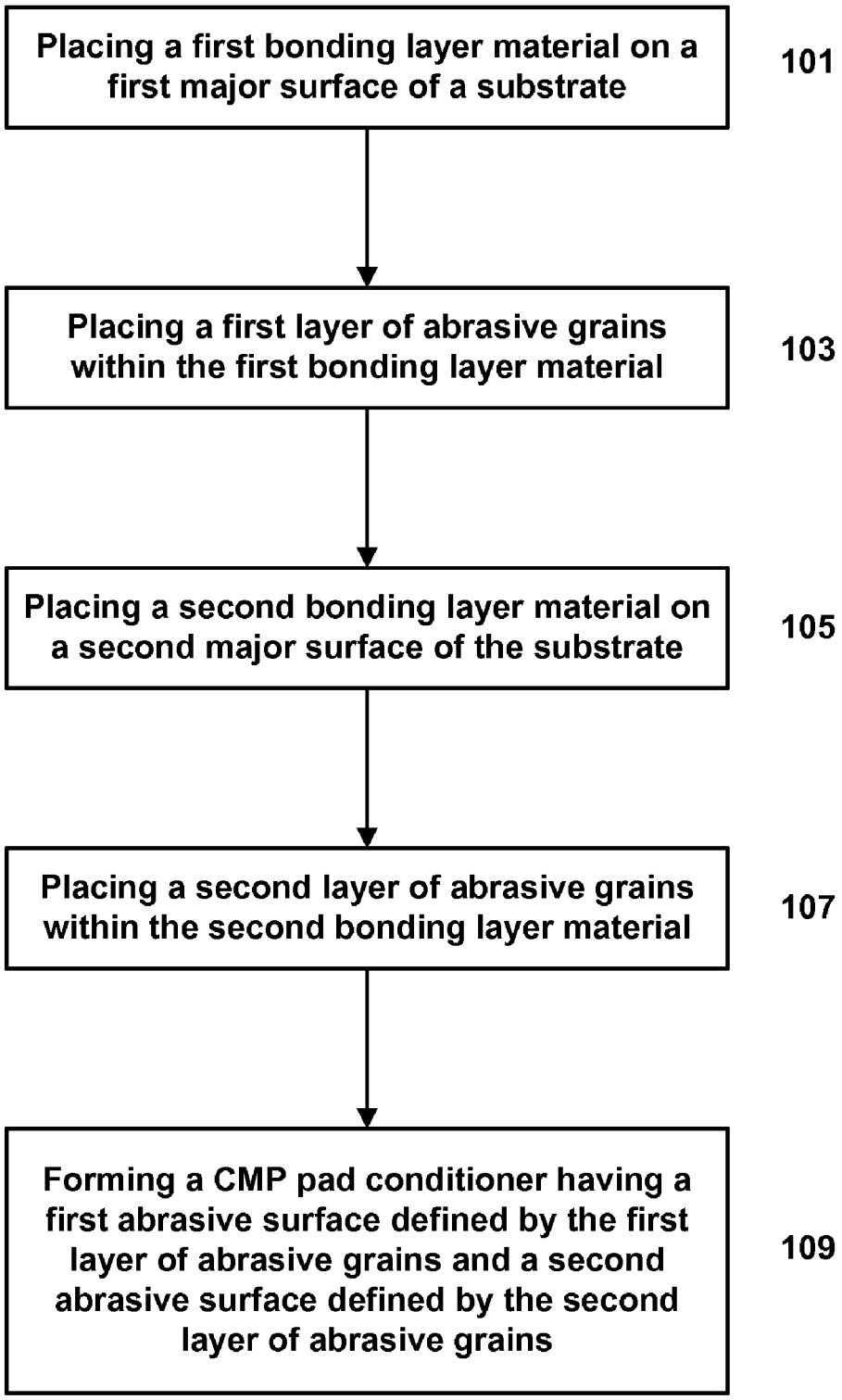
FIG. 1 includes a flowchart for forming an abrasive article in accordance with an embodiment.

FIG. 1 includes a flowchart demonstrating a method of forming an abrasive tool in accordance with an embodiment. As illustrated, the process can be initiated at step 101 by placing a first bonding layer material on a first major surface of a substrate.

Generally, the substrate is made of a material suitable for withstanding the rigors of abrasive processing. For example, the substrate can be a material having an elastic modulus of at least 2E3 MPa. In other embodiments, the substrate may be made of a material having a greater elastic modulus, such as on the order of at least about 5E3 MPa, such as at least about 1E4 MPa, or even at least about 1E5 MPa. In particular instances, the substrate material has an elastic modulus within a range between about 2E3 MPa and about 4E5.

For example, the substrate can include materials such as metals, metal alloys, ceramics, polymers, or a combination thereof. In accordance with one particular embodiment, the substrate is made of a metal alloy, such as steel. For some embodiments, as will be appreciated herein, the substrate can include a material that is magnetized or capable of being magnetized.

The substrate can have a certain shape, including for example, a generally disk-like shape having a first major surface and a second major surface that are opposite each other and substantially parallel with each other. The first major surface and second major surface can be connected by a side surface that defines the height of the substrate. While the substrate can have a disk-like shape with a circular contour, such that the shape of the substrate is cylindrical, other shapes are contemplated. For example, the substrate can have a rectangular or polygonal shape, such that the substrate has substantially planar sides that may be parallel to each other. Notably, the substrate can include other features (e.g., engagement structures) that will be described in more detail herein.

Placement of a first bonding layer material on the first major surface of the substrate can include the application of a layer of material, which may be applied to the substrate surface in the form of a film, foil, tape, or the like. Typically, the application of the bonding layer material is in a manner such that the bonding layer has a sufficient thickness to contain abrasive grains therein and form a homogeneous bonding layer material during processing. For example, in one embodiment, the bonding layer material can include a metal or metal alloy. Particularly useful metals can include transition metals. For example, the bonding layer material can be a braze material that includes transition metals such as nickel, chromium, titanium, tin, gold, palladium, silver, and a combination thereof.

In still other embodiments, the first bonding layer material can be a polymer material. Particularly suitable polymer bonding layer materials can include thermoplastics and thermosets, polyamides, polyimides, polyesters, polyethers, fluoropolymers, and a combination thereof. For example, particularly suitable polymer materials for use in the first bonding layer can include epoxies, acrylics, and a combination thereof. Certain bonding layer materials can also incorporate phenol formaldehyde.

The first bonding layer material can include fillers, which may improve the mechanical characteristics of the bond material making the bond material more durable. Additionally, filler particles can be used to match the coefficient of thermal expansion of braze-filler combination to that of braze-abrasive combination to inhibit out-of-flatness. Likewise, such inert fillers can be used to prevent sticking of braze to the plate or refractory on which the unfinished tool rests during thermal processing, so as to inhibit out-of-flatness. In addition, such inert fillers may improve wear resistance and can operate as an abrasive, if so desired.

After placing a first bonding layer material on a first major surface at step 101, the process continues at step 103 by placing a first layer of abrasive grains within the first bonding layer material. Various methods may be used for placement of the abrasive grains within the bonding layer material. For example, the abrasive grains may be placed within the bonding layer in a random arrangement having no short range or long range order. Alternatively, the placement of the abrasive grains may be completed in a manner such that the grains have a pattern, and even arranged in a pattern having long range order, such as an array (e.g., face centered cubic pattern, cubic pattern, hexagonal pattern, rhombic pattern, spiral pattern, random pattern, and combinations of such patterns). In particular instances, the abrasive grains may be placed at particular locations within the bonding layer such that they are arranged in a self-avoiding random distribution (i.e., a SARD™ pattern), which is particularly suitable for conditioning CMP pads.

The abrasive grains may be particularly hard materials, such that the abrasive grains can have a Vickers hardness of at least about 1500 kg/mm$^2$. In particular instances, the abrasive grains can include materials such as oxides, borides, nitrides, carbides, carbon-based structures (including man-made carbon-based materials such as fullerenes), and a combination thereof. In some instances, superabrasive materials such as cubic boron nitride or diamond can be used as the abrasive grains.

The abrasive grains can have an average grit size suitable for conditioning pads in CMP processing. For such applications, the average grit size can be less than about 250 microns. However, in other instances, smaller abrasive grains may be used such that the average grit size is not greater than about 200 microns, not greater than about 100 microns, or even not greater than about 50 microns. In particular instances, the abrasive grains have an average grit size within a range between about 1 micron and about 250 microns, such as within a range between about 1 micron and about 100 microns.

After placing the first layer of abrasive grains within the first bonding layer material at step 103, the process can continue at step 105 by placing a second bonding layer material on a second major surface of the substrate. As described above, the substrates can have a disk like or cylindrical shape such that the first major surface and second major surface are opposite to and substantially parallel with each other. The first and second major surfaces can be spaced apart from each other and connected to each other by the side surface. Placement of the second bonding layer material can include processes that are similar to, or the same as, the placement of the first bonding layer material on the first major surface. In particular processes, the placement of the second bonding layer may include suspension of the substrate such that the completed first bonding layer material and the first layer of abrasive grains are not in contact with any surfaces. Suspension of the substrate while forming the second bonding layer avoids a change in the placement or orientation of the first layer of abrasive grains, or even dulling of the first layer of abrasive grains. The substrate may be suspended using mechanical means, pressurized means, or the like.

In accordance with one embodiment, the second bonding layer material can be the same bonding layer material as the first bonding layer material. Still, in alternative designs, it may be suitable that the second bonding layer material be a different material than the first bonding layer material. Such designs may be suitable for varying the capabilities of the abrasive article such that the first bonding layer material is suitable for a first type of dressing operation and the second major surface of the substrate is suitable for a different dressing operation.

After placing the second bonding layer material on the second major surface at step 105, the process can continue at step 107 by placing a second layer of abrasive grains within the second bonding layer material. Like step 102 described above, the placement of the second layer of abrasive grains can be completed in a random arrangement, a patterned arrangement, or even a self-avoiding random distribution (SARD™). Moreover, the second layer of abrasive grains can have the same arrangement as the first layer of abrasive grains.

Additionally, the abrasive grains used in the second layer can be the same as the abrasive grains of the first layer, including the same type of material and the same average grit size. However, in particular embodiments, the abrasive grains of the second layer can be different from the abrasive grains used in the first layer of abrasive grains. Use of different abrasive grains between the first major surface and second major surface may facilitate formation of an abrasive article capable of conducting different dressing operations. For example, the abrasive grains of the second layer may contain a different type of material than the abrasive grains of the first layer. In some designs, the abrasive grains of the second layer can have a different average grit size for completing a different dressing operation either on the same CMP pad or a different type of CMP pad.

After placing the second layer of abrasive grains within the second bonding layer material at step 107, the process continues at step 109 by heating the substrate to form a CMP pad conditioner. Heating can be completed in a manner suitable for forming a braze layer from the first and second bonding layer material to secure the abrasive grains to the substrate.

In particular embodiments, the process of heating includes suspending the substrate material, such the abrasive grains of the first layer and the second layer are spaced apart from any contact surfaces. Such an arrangement avoids reorienting, rotating, and/or dulling of the abrasive grains during processing. In certain processes, during heating the substrate can be suspended in a vertical position above the furnace floor, such that the substrate is oriented at a perpendicular angle to the furnace floor. In other embodiments, the substrate can be suspended in a horizontal position above the furnace floor, such that the first major surface and second major surface are substantially parallel to the furnace floor. And still, in other embodiments, the substrate may be angled relative to the furnace floor, such that the first major surface and second major surface of the substrate are neither parallel nor perpendicular to the furnace floor.

According to one process, the substrate may change position during the heating process relative to a starting position and a stopping position. Changing the position of the substrate during heating can facilitate the formation of an abrasive article having a particular uniform bonding layer while also facilitating maintaining the original position of the abrasive grains. For example, changing the position of the substrate can include rotating, tilting, or inverting the substrate during heating. Such a process is particularly suitable for an abrasive article having bonding layer material and abrasive grains on first and second major surfaces.

The forming process described herein facilitates the formation of a reversible abrasive article having first and second major surfaces, each of which are suitable for abrasive processes. Moreover, the process described herein facilitates the formation of an abrasive article having superior flatness with regard to the first layer of abrasive grains and second layer of abrasive grains. The superior flatness facilitates improved processing and dressing of CMP pads.

Figure 2A:
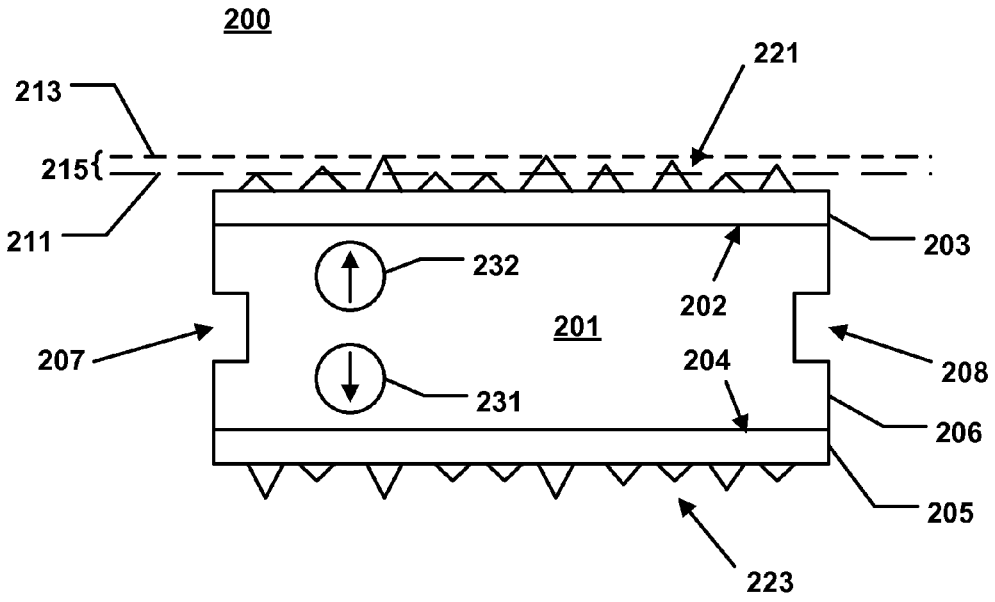
FIGS. 2A-2E include cross-sectional illustrations of an abrasive article in accordance with an embodiment.

Referring to FIG. 2A a cross-sectional illustration of an abrasive article in accordance with an embodiment is provided. In particular, the abrasive article 200 includes a substrate 201 having a first major surface 202 and a second surface 204 opposite the first major surface 202, wherein the first and second major surfaces 202 and 204 are joined by a side surface 206. A first bonding layer 203 overlies and abuts the first major surface 202, and a first layer of abrasive grains 221 is contained within the bonding layer 203, such that the abrasive grains are secured to the substrate 201. As illustrated, the first layer of abrasive grains 221 can have superior flatness as measured using a non-contact optical measuring method using various wavelengths of light to calculate distances along the surface and generate a map of the flatness of the sample. For example, the first layer of abrasive grains can have a flatness of not greater than about 0.02 cm, such as not greater than about 0.01 cm, or even not greater than about 0.005 cm. Such flatness measurements are gathered using optical auto-focusing technology to measure distance between points. An example of such technology is the Benchmark 450™ commonly available from VIEW Engineering, Inc.

The flatness of the first layer of abrasive grains 221 is relative to the flatness of the first bonding layer, and the orientation and size of the abrasive grains. As illustrated, the abrasive article 200 defines a lower working surface 211 generally defined by a plane extending through the upper most surfaces of the abrasive grains set at the lowest height above the surface of the bonding layer 203. The abrasive article 200 further illustrates an upper working surface 213 defined by a plane extending through the upper most surfaces of the abrasive grains set at the greatest height above the surface of the bonding layer 203. The difference between the lower working surface 211 and upper working surface 213 is the working surface distortion height 215 ($\Delta h$), which can be affected by a non-planar surface of the bonding layer 203 and further amplified by differences in grain sizes within the first layer of abrasive grains 221. Notably, the forming process described herein facilitates the formation of abrasive articles having a reduced working surface distortion height 215 and superior flatness. In particular, the abrasive article 200 has a symmetry about the center of the substrate such that the first and second major surfaces 202 and 204 are formed to have similar structures including bonding layers 203 and 205 and layers of abrasive grains 221 and 223. Such symmetry facilitates the formation of an abrasive article 200 having superior flatness and working surface distortion height with respect to the layers of abrasive grains 221 and 223 which is particularly suitable for conditioning of CMP pads.

As illustrated, the abrasive article 200 includes a bonding layer 205 attached to and abutting the second major surface 204 of the substrate 201. A layer of abrasive grains 223 are contained and secured within the bonding layer 205. Notably, the layer of abrasive grains 223 can have the same degree of flatness and working surface distortion height as the layer of abrasive grains 221 described herein.

Moreover, the abrasive article 200 can have a side surface 206 having particular contours facilitating the formation of the abrasive article 200. For example, the substrate 201 can include engagement structures along the side surfaces for improving the forming process and also providing coupling structures for removably coupling the substrate 201 to a plate during conditioning operations. According to the illustrated embodiment, the engagement structures can include recesses 207 and 208 within the side surface 206 that extend laterally into the interior of the substrate 201. The recesses 207 and 208 can be used to hold the substrate 201 (e.g., suspend the substrate 201) during processing for suitable formation of the bonding layers 203 and 205 and layers of abrasive grains 221 and 223. Additionally, the recesses 207 and 208 can provide formations for securing the abrasive article 200 within a plate as will be described in further embodiments. Other engagement structures are contemplated and will be described in more detail herein.

The abrasive article 200 further includes indicia 231 and 232 disposed on the side surface 206 of the substrate 201. The indicia 232 corresponds to the first major surface 202 of the substrate 201 and the layer of abrasive grains 221 for identifying a wear status of the layer of abrasive grains 221. Likewise, the indicia 231 corresponds to the second major surface 204 and is used to identify a wear status of the layer of abrasive grains 223. During use, the indicia 231 and 232 can indicate the wear status by identifying the number of times the layer of abrasive grains have been used in a conditioning operation. The indicia aid a user in identifying the side that is used versus a side that is unused, and further aids identification of the remaining useable life of a corresponding layer of abrasive grains.

The indicia 231 and 232 of FIG. 2A are illustrated as markings incorporating arrows corresponding to the layers of abrasive grains 223 and 221 respectively. It will be appreciated that upon completed use of either of the layer of abrasive grains 223 and 221, a user may mark or score the indicia 231 or 232 indicating the corresponding layer of abrasive grains 223 or 221 have been used. In different embodiments, the indicia can include other means of identifying the wear status of the layers of abrasive grains 223 and 221. For example, the indicia may include physical markings or printed markings, such as roman numerals, indicating the number of times the respective layer of abrasive grains 221 and 223 have been used.

In accordance with another embodiment, certain indicia can include color indicators, wherein the indicia have different color states identifying the wear status of the respective layer of abrasive grains 223 or 221. In particular, the color indicators can have various color states wherein the color of the indicia changes with repetitive exposure to certain chemicals used in the CMP process. In accordance with other embodiments, other physical markings may be used as the indicia 231 and 232. Alternatively, the indicia may be a user implemented material, such as a piece of adhesive or tape or other identifying structure indicating the number of times a layer of abrasive grains has been used and ultimately the wear status of the layer of abrasive grains.

Figure 2B:
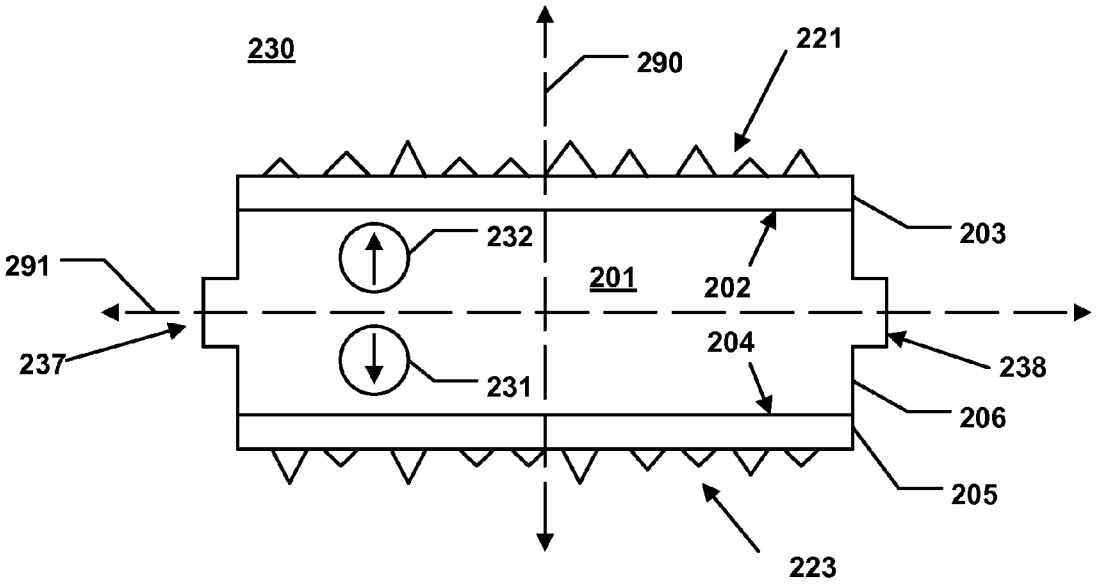

FIG. 2B includes a cross-sectional view of an abrasive article in accordance with an embodiment. The abrasive article 240 has the same features as the abrasive article 200 of FIG. 2A including a substrate 201 having a first major surface 202, a second surface 204 opposite the first major surface 202, and a side surface 206. The abrasive article further includes a first bonding layer 203 overlying and abutting the first major surface 202, and a first layer of abrasive grains 221 contained within the bonding layer 203, such that the abrasive grains are secured to the substrate 201. A second bonding layer 205 overlies and abuts the second major surface 204, and a second layer of abrasive grains 223 are contained within the bonding layer 205 such that the abrasive grains are secured to the substrate 201. Notably, the abrasive article 230 includes different engagement structures 237 and 238 than the abrasive article 200. As illustrated, the engagement structures 237 and 238 are protrusions that extend from the side surface 206 of the substrate 201 in a radial direction parallel that to the axis 291.

FIG. 2B further includes axes 290 and 291, which are perpendicular to each other and define directions to aid the description of embodiments. The axis 290 extends through the abrasive article and defines a longitudinal or axial direction, which generally extends through a thickness of the abrasive article 230. The axis 291 extends through the abrasive article and defines a lateral or radial direction, thereby defining a width or circumference of the abrasive article 230. As used in the embodiments herein, reference to such directions will be understood to reference the general directions illustrated by the axes 290 and 291.

Figure 2C:
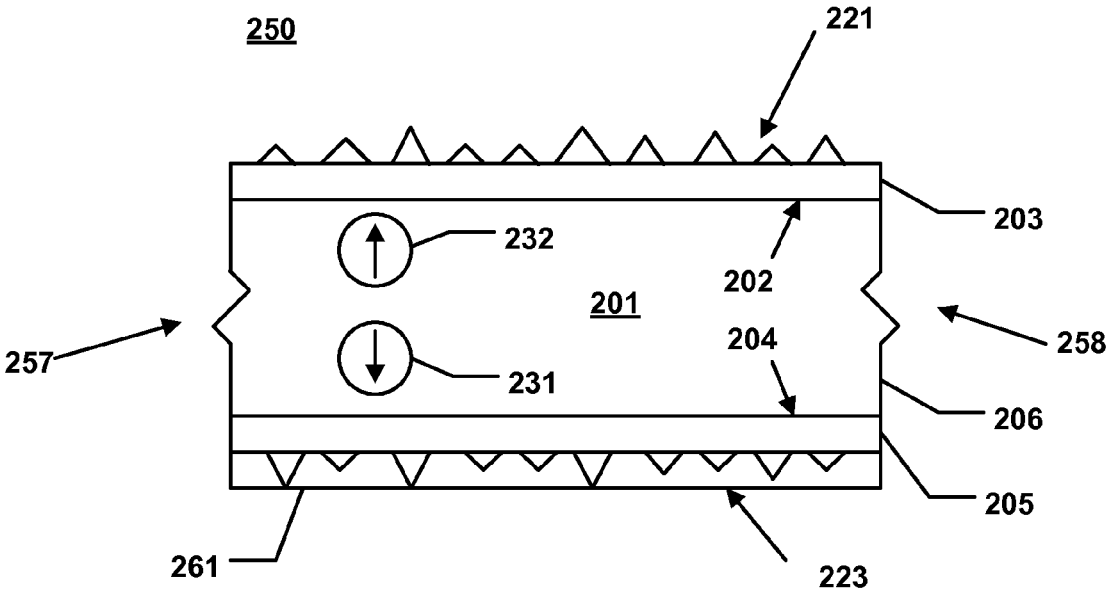

FIG. 2C includes a cross-sectional view of an abrasive article in accordance with an embodiment. The abrasive article 250 has the same features as the abrasive article 200 of FIG. 2A including a substrate 201 having a first major surface 202 and a second surface 204 opposite the first major surface 202 that is joined by a side surface 206. The abrasive article 250 further includes a first bonding layer 203 overlying and abutting the first major surface 202, and a first layer of abrasive grains 221 contained within the bonding layer 203, such that the abrasive grains are secured to the substrate 201. Also illustrated is a second bonding layer 205 overlying and abutting the second major surface 204, and a second layer of abrasive grains 223 contained within the bonding layer 205, such that the abrasive grains are secured to the substrate 201. Notably, the abrasive article 250 includes different engagement structures 257 and 258 than the abrasive article 200. As illustrated, the engagement structures 257 and 258 include a combination of grooves and protrusions on the side surface 206 of the substrate 201. In particular embodiments, the combination of grooves and protrusions can include a helical pattern, extending around the periphery of the side surface and forming a threaded engagement structure, such that the abrasive article can be screwed on a complementary structure, such as a plate including complementary threads.

The abrasive article 250 further includes a protective layer 261 overlying the layer of abrasive grains 223. The protective layer 261 provides a layer of material overlying the abrasive grains to safeguard the grains from damage during shipping and further during use of the opposite side of the abrasive article 250. According to one embodiment, the protective layer 261 can include a material that is removable when the user is ready to use the layer of abrasive grains 223. The material may be removable using physical or mechanical force (i.e., peeling), heat, chemicals, radiation, or the like. As will be appreciated, the protective layer 261 can be provided on both sides of the abrasive article 250 such that before use, a protective layer 261 covers both layers of abrasive grains 221 and 223.

For example, the protective layer 261 can include a polymer material, such as a thermoset, thermoplastic, resin, elastomer, and a combination thereof. Particularly suitable polymer materials can include acetates (e.g., polyvinyl acetate), polyamides, polyimides, polyurethanes, polyesters, fluoropolymers, gels, silicone, polyxylylenes (e.g., poly-para-xylylene or Parylene™) and a combination thereof. In certain designs, the protective layer 261 can include a porous material, such as a foam material providing additional protection to mechanical shocks and/or vibrations.

Certain protective layers 261 can include materials suitable for absorbing shock and protecting the covered portions of the abrasive article 250 covered. For example, the protective layer 261 can have a Shore A hardness of not greater than about 90 A based on the ASTM D2240 type A scale. In other embodiments, the protective layer 261 can have a Shore A hardness of not greater than about 80 A, such as not greater than about 70 A, not greater than about 60 A, or even not greater than about 50 A. Particular protective layers 261 have a Shore A hardness within a range between about 10 A and about 90 A, for example between about 20 A and about 70 A, and more particularly within a range between about 30 A and about 60 A.

Figure 2D:
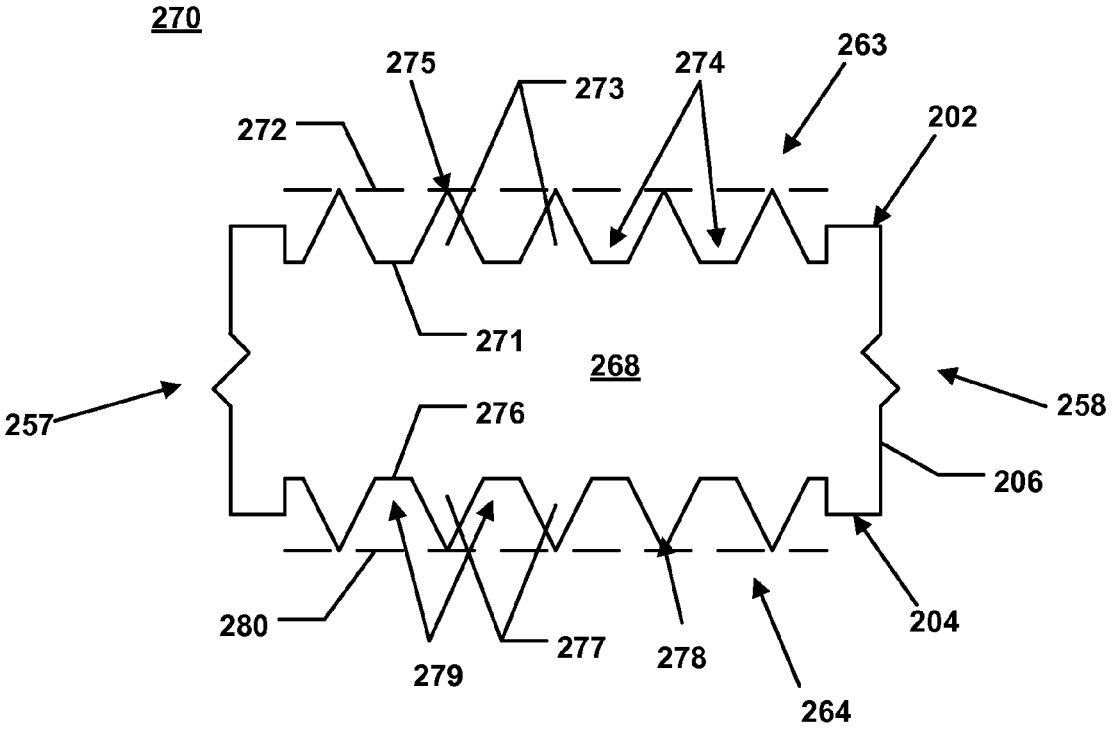

FIG. 2D includes a cross-sectional illustration of an abrasive tool in accordance with an embodiment. The abrasive article 270 can include a substrate 268 having a first major surface 202 and a second major surface 204. Unlike previously described embodiments, the abrasive article 270 can be a monolithic article including the substrate 268 that has abrasive texture 263 and 264 integrally formed in the first and second major surfaces 202 and 204 of the substrate body. That is, the abrasive tool 270 may not necessarily include a bonding layer or abrasive grains contained in the major surfaces of the substrate 268.

According to one embodiment, the abrasive article 270 includes a first set of protrusions 273 formed in the first major surface 202 of the substrate 268. The first set of protrusions 273 extend in an axial direction from a lower surface 271 of the substrate 268. The first set of protrusions 273 also define a first set of grooves 274 extending between each of the protrusions of the first set of protrusions 273. Additionally, the abrasive article 270 includes a first upper surface 272 defined by the upper portions 275 of the first set of protrusions 273 that is axially displaced at a distance from the first major surface 202 and also axially displaced at a distance from the lower surface 271. This design ensures that the protrusions can suitably engage and condition a CMP pad and reduce the likelihood of contact by other surfaces (e.g., 202 and 271) with the pad. Moreover, such a design facilitates proper abrasion of a CMP pad and swarf removal.

The first set of protrusions 273 can be formed in a random manner on the first major surface 202. However, in particular instances, the first set of protrusions 273 can be arranged in a pattern, such as any of those discussed with regard to the abrasive articles herein, for example, in the form of a self-avoiding random distribution (SARD™) pattern.

The substrate 268 can be formed of those materials previously described herein. For example, a material having an elastic modulus within a range between about 2E3 MPa and about 4E5. Certain substrate 268 materials can include metals, metal alloys, ceramics, polymers, and a combination thereof. Some embodiments may utilize a metal or metal alloy material that is magnetized or capable of being magnetized to facilitate removable coupling of the abrasive article 270 with a plate. More details of the removable coupling features incorporating magnets if provided herein.

Certain designs utilize a substrate 268 that includes an abrasive material, such that the sets of protrusions 273 and 277 integrally formed with the substrate 268 are made of an abrasive material. Suitable abrasive materials can include oxides, carbides, borides, nitrides, and a combination thereof. One particular embodiment utilizes a substrate 268 and sets of protrusions 273 and 277 comprising alumina.

Each of the protrusions of the first set of protrusions 273 can have a height (h) and a width (w) that defines a two-dimensional lateral contour. The two-dimensional lateral contour of the protrusions illustrated in FIG. 2D is a generally triangular shape. However, the protrusions can have other polygonal shapes, including for example, rectangular, trapezoidal, and the like. Moreover, each of the protrusions within the first set of protrusions 273 may not necessarily each have the same shape. For example, within each set of protrusions, a combination of different polygonal two-dimensional lateral contours may be utilized.

As illustrated, the abrasive article 270 is formed such that it is a reversible CMP pad conditioning tool, having first abrasive texture 263 on the first major surface 202 and second abrasive texture 264 on the second major surface 204. This design facilitates a process wherein a user can use the first abrasive texture 263 to condition a CMP pad or a series of CMP pads, and upon complete use of the first abrasive texture 263, invert the abrasive article 270 and use the second abrasive texture 263 on the opposite surface to carry out conditioning processes on a CMP pad or a series of CMP pads.

The second abrasive texture 264 can include features similar to the first abrasive texture 263. Notably, the second abrasive texture 264 is integrally formed within the body of the substrate 268 and includes a second set of protrusions 277 extending axially from a lower surface 276 defined by a second set of grooves 279 extending between each of the protrusions of the second set of protrusions 277. The second set of protrusions 277 include upper portions 278 that define a second upper surface 280 axially displaced from the second major surface 204 and lower surface to facilitate suitable engagement of the second set of protrusions 277 with a CMP pad during a conditioning operation.

The second set of protrusions 277 can be oriented in the same manner at the second major surface 204 as the first set of protrusions 273. That is, they may be formed in a same random arrangement, or alternatively, formed in a same patterned arrangement. Moreover, each of the protrusions within the second set of protrusions 277 can have the same two-dimensional lateral contour as each of the protrusions of the first set of protrusions 273. Still, in particular embodiments, the arrangement or lateral contour of the protrusions of the second set of protrusions 277 can be different from the arrangement or lateral contour of the protrusions within the first set of protrusions 273.

As further illustrated in FIG. 2D, the abrasive article 270 can have engagement structures 257 and 258 for removably coupling the substrate 268 with a plate for reversible operation of the abrasive article 270. It will be appreciated that while particular engagement structures are illustrated, the abrasive article 270 can incorporate any of the engagement structures described herein for removable coupling with a plate.

Given the distinct features noted above with regard to the abrasive article 270, the method of forming the such an abrasive article may be different than the method described in accordance with FIG. 1. Notably, the method may not include the placement of layers of abrasive grains within a bonding layer on opposite major surfaces of a substrate. Rather, in certain forming processes, the substrate 268 is obtained as a blank piece of material, having limited or no texture or other contours. The substrate 268 can be machined to have the proper contours including the abrasive texture on the first and second major surfaces. Additionally, the engagement structures can be formed within the substrate during the same machining process. The machining operations can be automated, and can include the use of computer guided lathes, other cutting instruments, and the like.

According to another method of forming the abrasive article 270, the substrate 268 can be a molded article or cast article. In particular instances, the abrasive texture 263 and 264 can be formed simultaneously with the forming of the substrate 268. The molding or casting process can start with various raw materials, such as powder raw materials to be molded or a slurry of material to be cast. The molding or casting process can be conducted to obtain a near final shape piece, including the substrate body having the first and second set of protrusions. After molding or casting, the piece can be dried, heat treated (e.g., sintered) and machined.

Figure 2E:
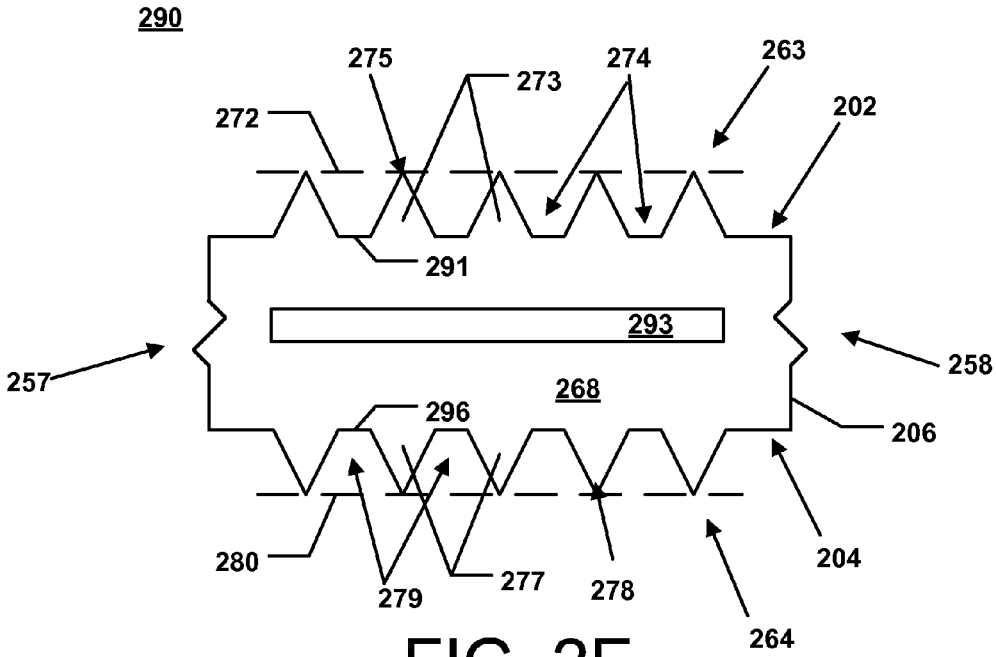

FIG. 2E includes a cross-sectional illustration of an abrasive tool in accordance with an embodiment. Like the abrasive article 270 of FIG. 2D, the abrasive article 290 includes a substrate 268 having a first major surface 202 and a second major surface 204. In particular, the abrasive article 290 is a monolithic article including a substrate 268 having abrasive texture 263 and 264 integrally formed in the first and second major surfaces 202 and 204 of the substrate body. That is, the abrasive tool 290 may not necessarily include a bonding layer or abrasive grains contained in the major surfaces of the substrate 268.

As provided in the illustrated embodiment, the abrasive article has a different shape, wherein the lower surface 291 and the first major surface 202 are within the same plane. Likewise, the lower surface 296 and the second major surface 204 are within the same plane. This design removes the distinction between these planes and may aid swarf removal and conditioning.

Moreover, the abrasive article 290 includes a magnet 293 within the substrate 268 that can facilitate removable coupling between the abrasive article 290 and a plate. The magnet 293 can be embedded within the body of the substrate 268 such that it is surrounded on all sides by the material of the substrate 268. In other embodiments, the abrasive article 290 can incorporate more than one magnet, such as a series of magnets embedded within the body of the substrate 268. The embodiments incorporating a series of magnets within the body of the substrate 268 may do so in a manner such that the magnets are aligned with each other along the radial axis. It will be appreciated throughout the disclosure that any of the abrasive articles illustrated in FIGS. 2A-2E may can be combined with any of the abrasive tools of the embodiments herein.

Figure 3:
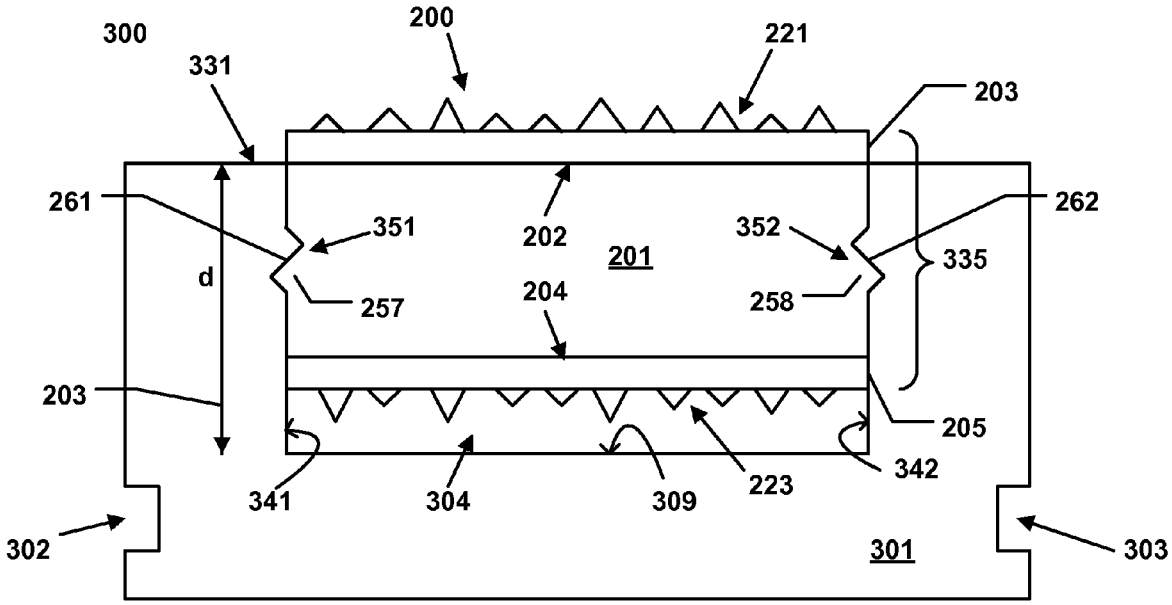
FIG. 3 includes a cross-sectional illustration of a portion of an abrasive tool in accordance with an embodiment.

FIG. 3 includes a cross-sectional illustration of an abrasive tool in accordance with an embodiment. In particular, the abrasive tool 300 includes an abrasive article 250 that is removably coupled to a plate 301. In particular, the plate 301 includes a recess 304 extending into the interior of the plate 301 and configured to provide a space for removably coupling the abrasive article 201. Moreover, the plate 301 and abrasive article 300 are removably coupled to each other via coupling mechanisms 351 and 352 that include the engagement structures 257 and 258 of the abrasive article 250 engaged with complementary coupling surfaces 261 and 262 of the plate 301. That is, the plate 301 has particular shapes and coupling surfaces 261 and 262 particularly designed to be removably coupled to the abrasive article 250 having first and second working surfaces incorporating abrasive grains.

As illustrated, the abrasive tool 300 includes a plate 301 having a recess 304 such that the abrasive article 250 can be removably coupled to the plate 301 within the recess 304. In accordance with a particular embodiment, the recess 304 has a depth 305 as measured between the upper surface 331 of the plate 301 and the bottom surface 309 of the recess 304. Notably, the depth 305 of the recess 304 can be significantly greater than the height 335 of the abrasive article 200, such that the layer of abrasive grains 223 contained within the recess 304 are spaced apart from the bottom surface 309. Such an arrangement facilitates sufficient spacing between the bottom surface 309 and first layer of abrasive grains 223 to avoid destruction, dulling, or altering of the characteristics and orientation of the abrasive grains 223.

As further illustrated, the abrasive tool 300 is designed such that the abrasive article 250 is particularly situated within the recess 304 of the plate 301. That is, the upper major surface 202 of the substrate 201 can be flush with the upper surface 331 of the plate 301 such that only the bonding layer 203 and layer of abrasive grains 221 extend above the upper surface 331 of the plate 301. Such a configuration facilitates the engagement of the layer of abrasive grains 221 during a conditioning process and apt spacing between the upper surface 331 of the plate 301 and the pad during a dressing operation. The orientation between the abrasive article 250 and plate 301 in such a manner can be facilitated by the coupling mechanisms 351 and 352 which facilitate fixing the orientation between the abrasive article 250 and the plate 301. As will be appreciated and described in more detail herein, the coupling mechanisms 351 and 352 can include alternative features and engagement structures using a variety of connections, such as an interference fit connection, latches, fasteners, levers, clamps, chucks, or a combination thereof. Certain coupling mechanisms described herein may further include magnetic coupling devices and/or electrode coupling devices (e.g., anodic bonding) between the abrasive article 250 and the plate 301.

The plate can include a material that is suitable for use in CMP processing. For example, the plate 301 can include a same material as used in the substrate 201 of the abrasive article 200. Moreover, the plate 301 is generally formed of a material having suitable mechanical characteristics, such as an elastic modulus of at least 2E3 MPa. For example, in particular embodiments, the plate 301 is made of a material having an elastic modulus with in a range between about 2E3 MPa and about 4E5 MPa.

Some suitable materials for use as the plate 301 can include metals, metal alloys, polymers, and a combination thereof. For instance, in certain embodiments, the plate 301 is made of a metal material, such as a metal alloy, and particularly including transition metal elements. Alternatively, the plate 301 can include a polymer material, such that the plate is made of a durable polymer such as a thermoplastic, thermoset, or resin material. Notably, the plate 301 is designed to withstand repetitive CMP processing and dressing procedures. That is, the plate 301 is intended to be a reusable member, such that it may undergo many uses before being replaced. In short, the plate 301 is designed such that it is reusable member having a lifetime extending beyond that of the abrasive article 250.

The plate 301 can include recesses 302 and 303 configured for engagement with a fixture typically designed to hold the dresser, such that the plate 301 and abrasive article 250 can be rotated in accordance with a dressing operation. It will be appreciated that while the plate 301 is illustrated as having recesses 302 and 303 for engagement with a fixture, other engagement structures may be used such as an arbor hole through the center of the plate 301 or other structures suitably designed such that the plate 301 can be rotated with the abrasive article 200 for conditioning and dressing of a CMP pad.

Figure 4:
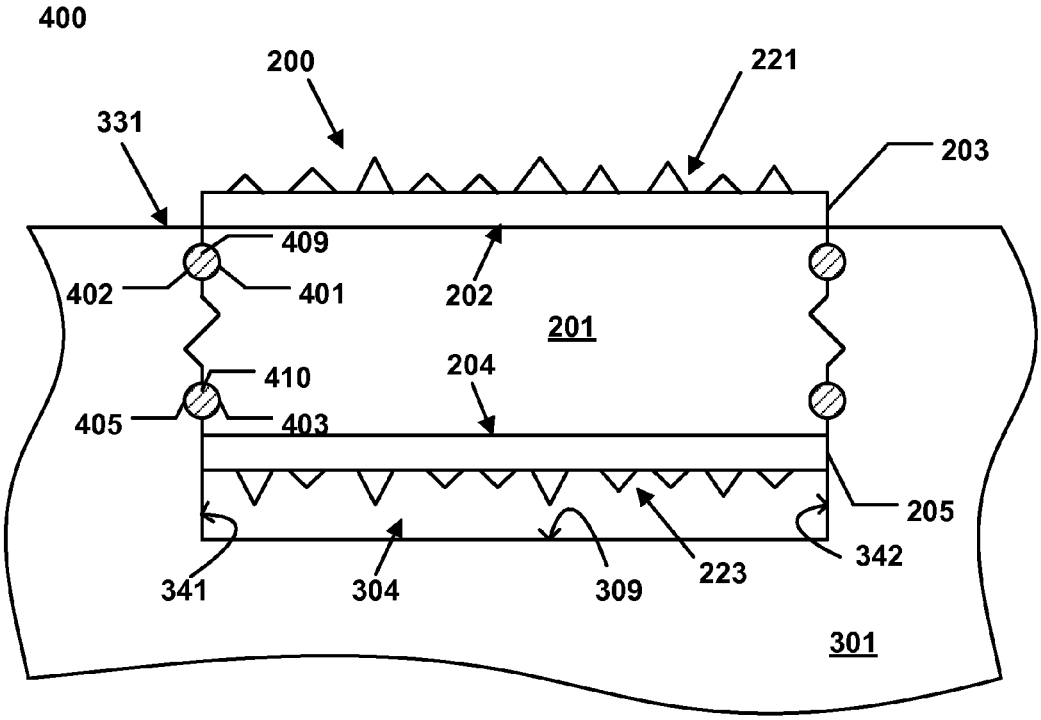
FIG. 4 includes a cross-sectional illustration of a portion of an abrasive tool in accordance with an embodiment.

FIG. 4 includes a cross-sectional illustration of an abrasive tool in accordance with an embodiment. As illustrated, the abrasive tool includes a plate 301 having a recess 304 for removably coupling an abrasive article 200 therein. Notably, sealing members 409 and 410 can be disposed between the side surface 206 of the substrate 201 and side surfaces 341 and 342 of the plate 301 that define the recess 304. The sealing members 409 and 410 are intended to avoid penetration of CMP fluids and debris from penetrating the connection between the abrasive article 250 and the plate 301. Otherwise, such materials may contaminate other pads in subsequent dressing operations.

In accordance with an embodiment, the sealing members 409 and 410 can be attached to the substrate 201. For example, the sealing members 409 and 410 can extend in a peripheral direction (i.e., around the periphery) on the side surface 206 of the substrate 201. In other embodiments, the sealing members 409 and 410 can be attached to the plate 301. Still, certain designs may incorporate one sealing member 409 that is fixedly attached to the substrate 201 and the second sealing member 410 can be fixedly attached to the plate 301. The sealing member 409 may extend in a direction along the periphery of the side surface 206 of the substrate 201. That is, the sealing member 409 can extend circumferentially (in the case of a circular substrate) around the entire periphery of the side surface 206 of the substrate 201. Likewise, the sealing member 410 can be engaged with the recess 403 and extend along the periphery, and particularly the entire periphery, of the side surface 206 of the substrate 201. In accordance with one embodiment, the sealing member 409 is disposed within a recess 401 along the side surface 206 of the substrate 201.

Additionally, the plate 301, and the side surface 341 of the plate 301 can be formed to include a complementary recess 407 for receiving the sealing member 409. Likewise, the sealing member 410 can be arranged in a similar configuration such that the substrate 201 has a receiving surface 403 for engagement with the sealing member 410 along the side surface 206. Moreover, the side surface 341 of the plate 301 can have a complementary receiving surface configured to accept and engage the sealing member 410 therein.

According to one particular design, the sealing member 409 and sealing member 410 can be spaced apart from each other. Certain designs incorporate the sealing member 409 disposed along the side surface 206 in a position that is closer to the first major surface 202 of the substrate 201, while the sealing member 410 is disposed in a position along the side surface 206 closer to the second major surface 204 of the substrate 201. Notably, each of the sealing members 409 and 410 are spaced apart from the engagement structure 307. Such a design facilitates the sealing members properly engaging the recesses 407 and 405 along the side surface 341 of the recess 304 independent of the orientation between the first layer of abrasive grains 221 or second layer of abrasive grains 223. That is, whether the abrasive article 250 is oriented as illustrated in FIG. 4, or inverted such that the layer of abrasive grains 223 are extending from the recess 304, the sealing members 409 and 410 are properly engaged within the recesses 405 and 407 of the plate 301.

The sealing members 409 and 410 can be a deformable or pliable member. For example, the sealing members 409 and 410 can include a polymer material. Some suitable polymer materials include elastomers. In accordance with one particular embodiment, the sealing members 409 and 410 can be o-rings. It will be appreciated that while the sealing members 409 and 410 are illustrated as having particular contours and placement. Other sealing members and configurations are contemplated. For example, the sealing member may be a single film or layer of material disposed between the substrate 201 and the plate 301.

Figure 5:
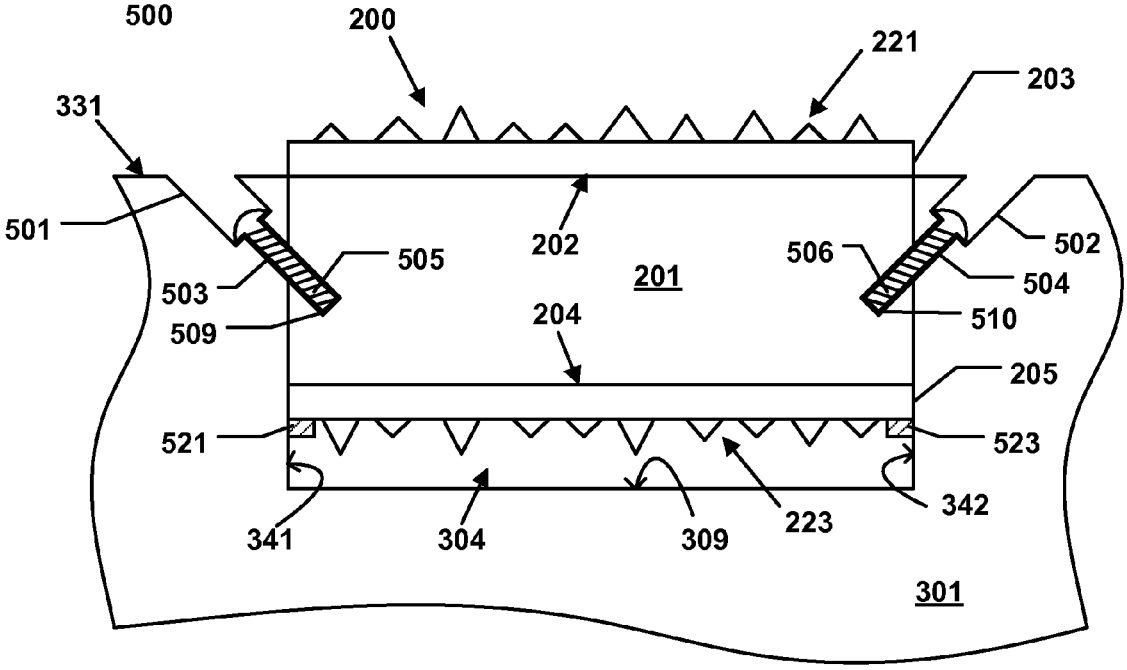
FIG. 5 includes a cross-sectional illustration of a portion of an abrasive tool in accordance with an embodiment.

FIG. 5 includes a cross-sectional illustration of an abrasive tool in accordance with an embodiment. The abrasive tool 500 includes an abrasive article 200 removably coupled to a plate 301 and contained within a recess 304 of the plate 301. A coupling mechanism that includes fasteners 505 and 506 facilitates removable coupling between the abrasive article 200 and the plate 301. According to the illustrated embodiment, the plate 301 can include openings 501 and 502 for engagement of fasteners therein. As illustrated, the fasteners may be angled relative to the upper surface 331 of the plate 301 and relative the axial and radial directions, such that a user can access the fasteners 501 and 506. The openings 501 and 502 allow the fasteners 505 and 506 to be disposed within the plate 301 below the upper surface 331 to avoid engagement between the fasteners 505 and 506 and a CMP pad during a dressing operation.

Each of the openings 501 and 502 can include a channel portion 503 and 504 extending from the openings 501 and 502 through an interior portion of the plate 301. The channel portions 503 and 504 can have a diameter that is smaller than the openings 501 and 502 for engagement of the threaded portion of the fasteners 505 and 506 therein. The abrasive tool 500 can further include channels portions 509 and 510 that extend into the interior of the substrate 201. Notably, the channels portions 509 and 510 are aligned with the channels portions 503 and 504 along their longitudinal axes, such that the channel portions 503 and 509 are coaxial with each other and channel portions 504 and 510 are coaxial with each other. The alignment between the channel portions 503 and 504 of the plate 301 with the channel portions 509 and 510 of the substrate 201 facilitates engagement of the fasteners 505 and 506 therein and coupling between the plate 301 and substrate 201.

Proper alignment of the channel portions 503 and 504 of the plate 301 and the channel portions 509 and 510 of the substrate 201 can be facilitated by use of ridges 521 and 523 extending from the surfaces 341 and 342 of the plate 301 within the recess 304. The abrasive article 200 can be placed within the recess 304 until a portion of the abrasive article 200 engages the ridges 521 and 523, which ensures proper orientation between the channel portions 503, 504, 509 and 510.

During operation, the abrasive article 200 can be removably coupled with the plate by placing the abrasive article 200 within the recess 304 of a plate 301 and securing the abrasive article in place using fasteners 505 and 506. After sufficient use of the first side of abrasive grains 221, the user may unscrew the fasteners 505 and 506, inverting the abrasive article 200 exposing the second layer of abrasive grains 223, and using the fasteners to secure the position of the abrasive article 200 within the recess 304 of the plate 301.

Figure 6:
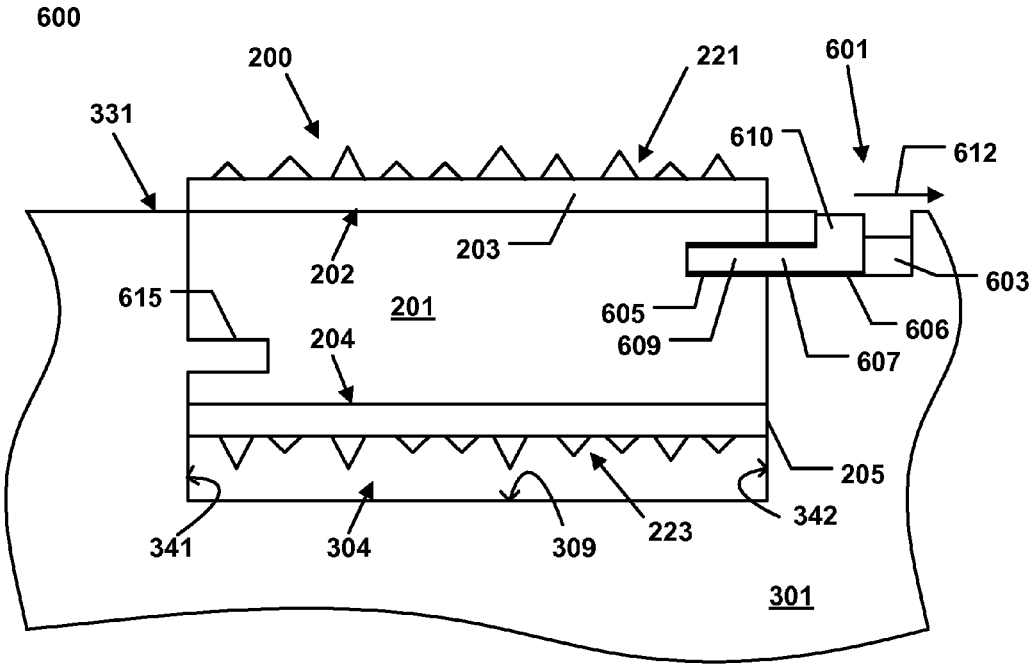
FIG. 6 includes a cross-sectional illustration of a portion of an abrasive tool in accordance with an embodiment.

FIG. 6 includes a cross-sectional illustration of an abrasive tool in accordance with an embodiment. As illustrated, the abrasive tool 600 includes an abrasive article 200 removably coupled within a recess 304 of a plate 301. The abrasive tool 200 and plate 301 are removably coupled via a coupling mechanism that includes a latching mechanism 601. As illustrated, the latching mechanism 301 includes a latch 607 having an elongated member 609 attached to a head member 610 that can be moved within a channel 606 within the plate 301 and a complementary channel 605 that extends into the interior of the substrate 201.

The latching structure 601 further includes a biasing member 603 disposed between a surface of the plate 301 and the head member 610. The biasing member 603 can resiliently bias the latching member 607 in the position as illustrated, such that the elongated member 609 extends into the channel 606, and more particularly, extends into the complementary channel 605 to couple the plate 301 and abrasive article 200 to each other. Upon releasing the abrasive article 200 from within the recess 304, the user can manipulate the head member 610 in a direction 612 as illustrated to remove the elongated member 609 from the channel 605 of the substrate 201 thereby facilitating removal of the abrasive article from within the recess 304. Upon removal, the user can reverse the abrasive article 200 for use of the opposite layer of abrasive grains 223. Accordingly, the substrate 201 can further include a second complementary channel 615 disposed opposite of the channel 605 configured to engage the elongated member 609 of the latching member 607. As will be appreciated, ridges or other placement members as illustrated in FIG. 5 may be used to properly orient the abrasive article 200 and the plate 301 to facilitate engagement of the latching structure 601.

Figure 7:
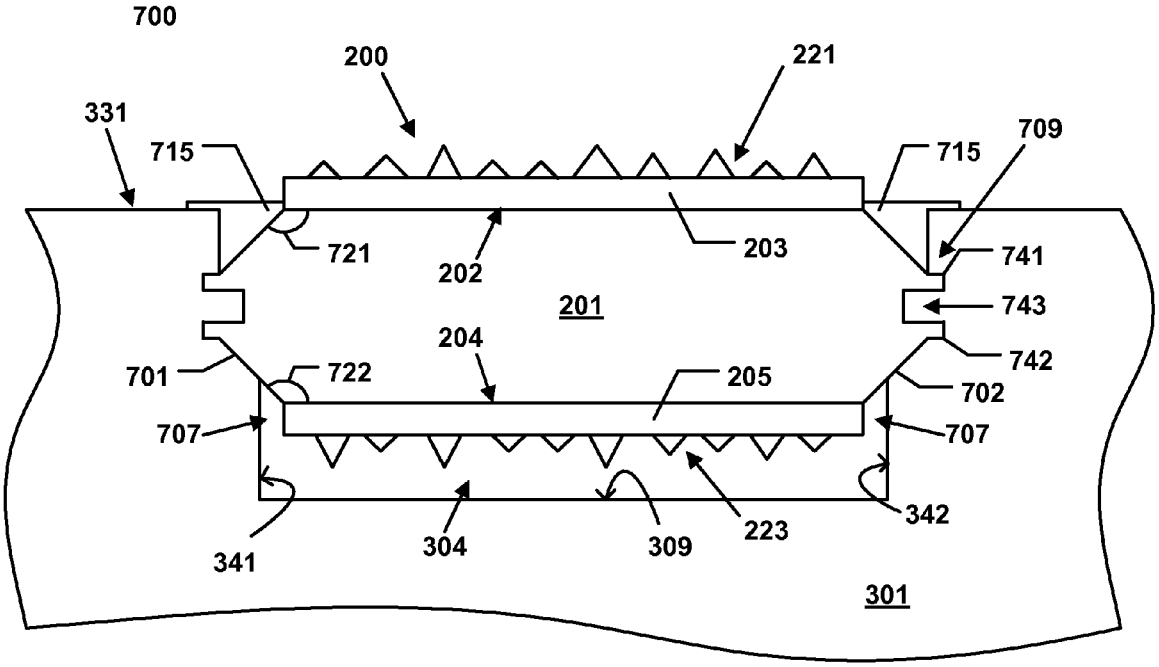
FIG. 7 includes a cross-sectional illustration of a portion of an abrasive tool in accordance with an embodiment.

FIG. 7 includes a cross-sectional illustration of an abrasive tool in accordance with an embodiment. As illustrated, the abrasive tool 700 includes an abrasive article 200 configured to be removably coupled within a recess 304 of the plate 301. Unlike previous embodiments, the substrate 201 of the abrasive article 200 has a unique shape configured to be coupled within the recess 304 of the plate 301. In particular, the substrate 201 includes angled surfaces 703 and 701 which are configured to engage the angled surface 702 of the recess 301. The surfaces 703 and 701 are angled with respect to the upper major surface 202 and lower major surface 204 of the substrate 201 such that angles 721 and 722 are formed between the two surfaces. In particular, the angles 721 and 722 can be obtuse angles (>90°) that facilitate centering of the abrasive article 200 within the recess 304 and can also allow for a gap 707 between the side surfaces 341 and 342 and the bonding layer 205 and layer of abrasive grains 223. The gap 707 reduces likelihood of damage to the layer of abrasive grains 223 during coupling of the plate 301 and abrasive article 200.

As illustrated, the plate 301 and the abrasive article 200 are removably coupled via a coupling mechanism 709 that includes engagement structures (i.e., protrusions) 741 and 742 extending laterally from the substrate 201 that are configured to engage a complementary coupling surface 743 of the plate 301. In one embodiment, the abrasive article 200 can be removably coupled with the plate 301 by placing the abrasive article 200 within the recess until the surface 701 engages the surface 702. Upon placement of the abrasive article 200 within the recess, the abrasive article can be rotated until the engagement structures engage the complementary coupling surface 743 and the substrate 201 and plate 301 are secured against each other, such as in a rotate-and-lock coupling arrangement.

The abrasive tool 700 can further include a sealing layer 715 disposed between surfaces of the substrate 201 and plate 301. The sealing layer 715 facilitates sealing of the connection between the substrate 201 and plate 301 from penetration by CMP liquids and debris. In one particular embodiment, the sealing layer 715 can include a polymer material that may be easily removed after use of the abrasive article. For example, the sealing layer 715 can be a silicone or low temperature polymer than can be removed or softened via heat treatment to facilitate removal of the abrasive article 200 from the plate 301.

Figure 8:
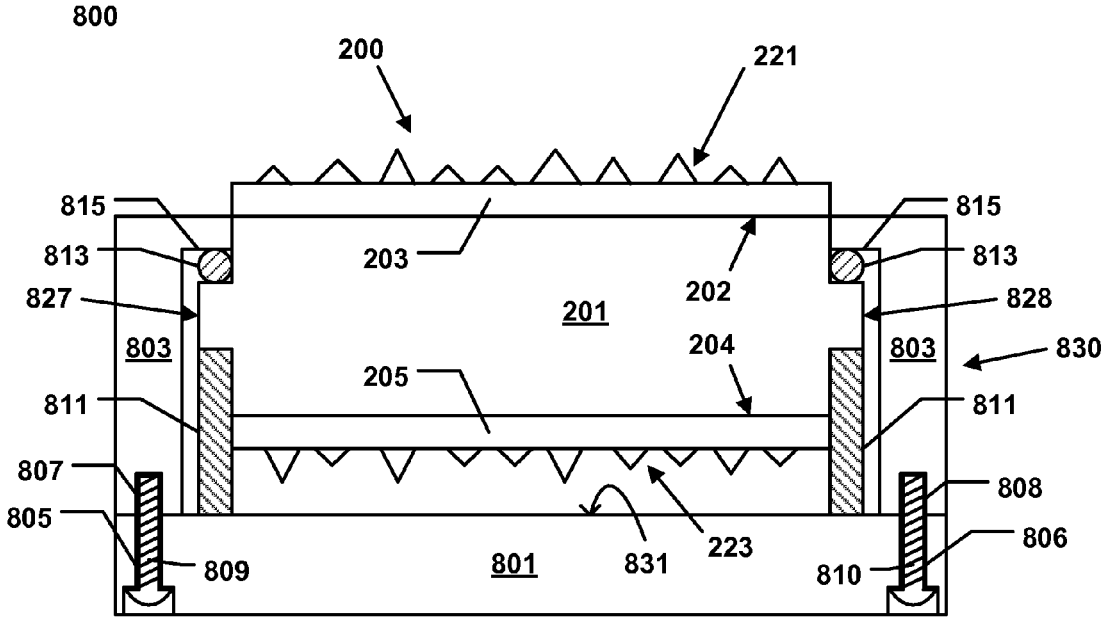
FIG. 8 includes a cross-sectional illustration of a portion of an abrasive tool in accordance with an embodiment.

FIG. 8 includes a cross-sectional view of an abrasive tool in accordance with an embodiment. The abrasive tool 800 includes an abrasive article 200 removably coupled with a plate 830, wherein the plate 830 comprises a first fixture 801 and a second fixture 803 and the abrasive tool 800 is coupled to the plate 830 within the recess 834. Generally herein, the plate can include separate members that can be removably coupled to each other via coupling mechanisms such as, magnetic means, pressurized means, electronic coupling means, mechanical means, and a combination thereof. Certain mechanical means can include fasteners, latches, clamps, locks, biasing members, the like, and a combination thereof.

According to the abrasive tool 800 of FIG. 8, the first fixture 801 can be a generally planar member. The first fixture 801 can be made of the same materials as the plate 301 described in other embodiments. For certain designs, openings 805 and 806 can be present within the body of the first fixture 801, which can extend axially through a portion of the body. In particular, the openings 805 and 806 can extend through the entire thickness of the first fixture 801 for engagement of fasteners 809 and 810 therein.

According to one embodiment, the first fixture 801 can include a biasing member 811 attached to the upper surface 831 of the first fixture 801. The biasing member 811 can extend from the upper surface 831 and is configured to engage portions of the substrate 201, such as the engagement members 827 and 828 to resiliently bias the position of the abrasive article 200 within the recess 834. Additionally, the biasing member 811 can be coupled to the engagement members 827 and 828 upon assembly of the abrasive tool 800 such that the abrasive article 200 can be clamped between portion of the biasing member 811 and a portion of the second fixture 803. Such a design can reduce the likelihood of damage to the abrasive article 200 and improve conditioning performance. According to one particular embodiment, the biasing member 811 can have an annular shape.

Suitable materials for use in the biasing member 811 can include metals, ceramics, polymers, or a combination thereof. In certain embodiments, the biasing member 811 can include a metal spring or the like. According to other embodiments, the biasing member 811 can include a polymer material, and the like. Additionally, the biasing member 811 can be a solid material that is a monolithic piece, such as a foam material or elastomer material. It will be appreciated that the engagement structures 827 and 828 are different structures, however in other designs, the substrate may include a single engagement structure extending around the entire periphery of the side surface of the substrate 201.

The first fixture 801 and the second fixture 803 can be coupled by fasteners 809 and 810. Accordingly, the second fixture 801 can include openings 807 and 808 configured to align with the openings 805 and 806 within the first fixture 801 to accept and engage the threaded portions of the fasteners 809 and 810.

As further illustrated, the body of the second fixture 803 can include a ridge 850 extending in a direction perpendicular to the body of the second fixture 803 and configured to engage the side surface of the substrate 201. The ridge 850 can extend circumferentially around the inner surface of the second fixture 803 to facilitate clamping the second fixture 803 and the first fixture 801 against the engagement members 827 and 828 of the substrate to secure the abrasive article 200 in the recess 834.

The second fixture 803 can further include a sealing member 813 disposed on an interior surface 815 of the ridge 850. The sealing member can be disposed in this position to inhibit debris and conditioning fluids from entering the recess 834 and interfering with the operation of the abrasive tool 800. In one particular embodiment, the sealing member 815 is fixedly attached to the interior surface 815 such that it is properly placed during assembly of the abrasive tool 800. The sealing member 815 can include those features of the sealing members described in accordance with other embodiments herein.

During assembly of the abrasive tool 800, the abrasive article 200 can be placed over the first fixture 801 such that the engagement structures 827 and 828 engage the biasing member 811. The second fixture 803 can then be placed such that the ridge 850 is overlying the engagement structures 827 and 828 and the sealing member 813 is engaged with the top surface of the engagement structures 827 and 828, such that the abrasive article 200 is clamped between the sealing member 813 and the biasing member 811. The openings 807 and 808 of the second fixture 803 can be aligned with the openings 805 and 806 of the first fixture 801 and the fasteners can be engaged within the openings thus securing the first and second fixtures 801 and 803 together and clamping the abrasive article 200 within the recess 834.

Figure 9:
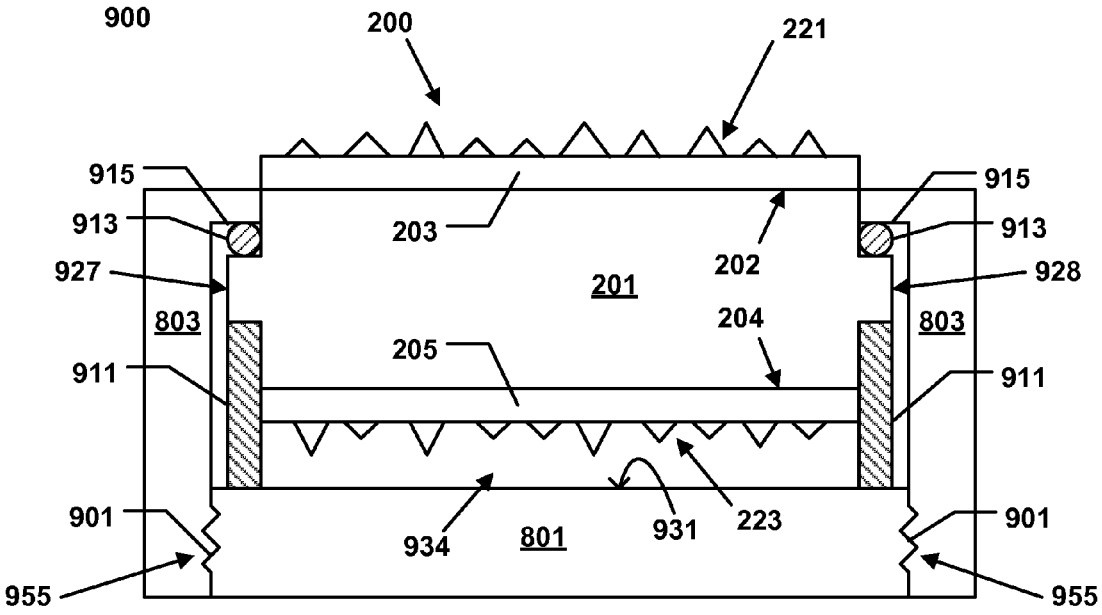
FIG. 9 includes a cross-sectional illustration of a portion of an abrasive tool in accordance with an embodiment.

FIG. 9 includes a cross-sectional illustration of an abrasive tool in accordance with an embodiment. The abrasive tool 900 includes an abrasive article 200 removably coupled to a plate 930, wherein the plate comprises a first fixture 801, a second fixture 803, and a recess 934 formed between the first fixture and second fixture 803. As illustrated, the abrasive tool 900 can have a similar construction as the abrasive tool 800 of FIG. 8, however, the abrasive tool 900 includes a different coupling mechanism between the first fixture 801 and second fixture 803. In particular, the first fixture 801 and second fixture 803 are coupled together via a coupling structure 955, wherein the first fixture 801 and second fixture 803 can be threaded or screwed together directly. The direct threaded connection is facilitated by complementary threaded surfaces 901 on each of the first fixture 801 and second fixture 803. Notably, while the means of engagement between the first fixture 801 and second fixture 803 differ in the abrasive tool 900 from the abrasive tool 800, the manner of assembling the abrasive tool 900 can be substantially the same as described in accordance with the embodiment of FIG. 8.

Figure 10:
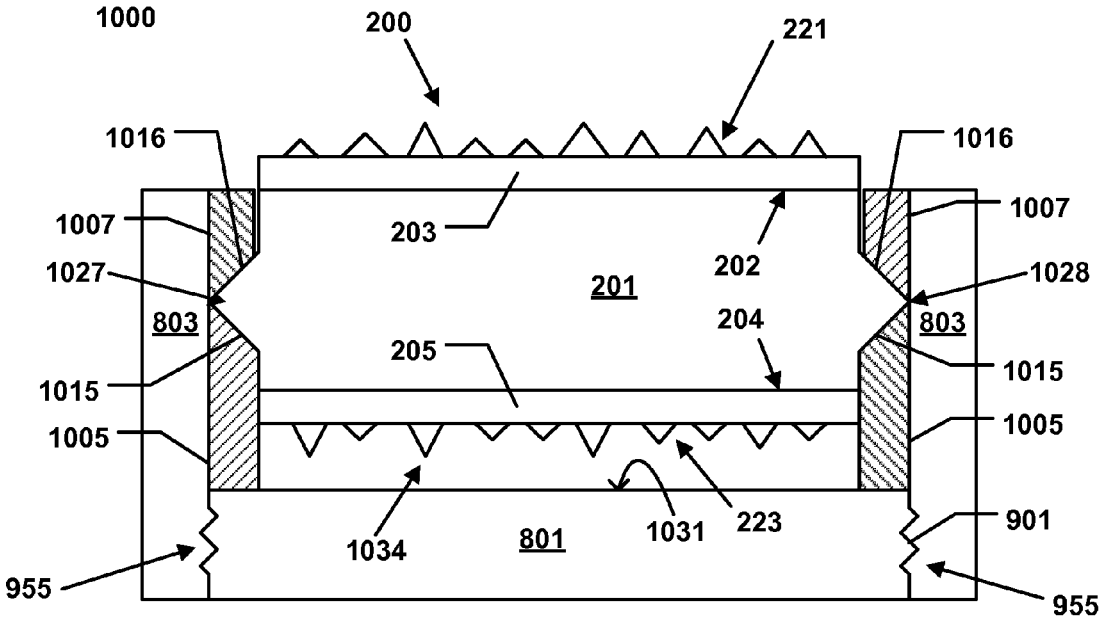
FIG. 10 includes a cross-sectional illustration of a portion of an abrasive tool in accordance with an embodiment.

FIG. 10 included a cross-sectional illustration of an abrasive tool in accordance with an embodiment. Notably, the abrasive tool 1000 includes an abrasive article 200 that is removably coupled to a plate that includes a first fixture 801, second fixture 803, and a recess 1034 formed between the first fixture 801 and second fixture 803. As illustrated, the abrasive tool 1000 has the same design as the abrasive tool 900 described herein, including a first fixture 801 that is coupled to a second fixture 803 via a coupling structure 955.

The abrasive tool 1000 can include a biasing member 1005 extending from the upper surface 931 of the first fixture 801. In particular, the biasing member 1005 can have an annular shape such that it extends circumferentially around the center point of the first fixture 801. Moreover, the biasing member 1005 can have a chamfered surface 1015 for engagement with engagement structures 1027 and 1028 extending from the substrate 201, which according to the illustrated embodiment, include complementary chamfered surfaces. Use of chamfered surfaces on the engagement structures 1027 and 1028 facilitates proper positioning of the abrasive article 200 within the recess 1035. Moreover, the abrasive tool 1000 can include a member 1007 coupled to the second fixture 803 and configured to engage the engagement structures 1027 and 1028 upon assembly of the abrasive tool 900. In particular, the member 1007 can be a pliable member capable of deformation, thus facilitating the proper placement and orientation of the abrasive article 200 within the recess 1034. Likewise, the member 1007 can have a chamfered surface 1016 configured to engage complementary, upper sloped surfaces of the engagement structures 1027 and 1028.

Figure 11:
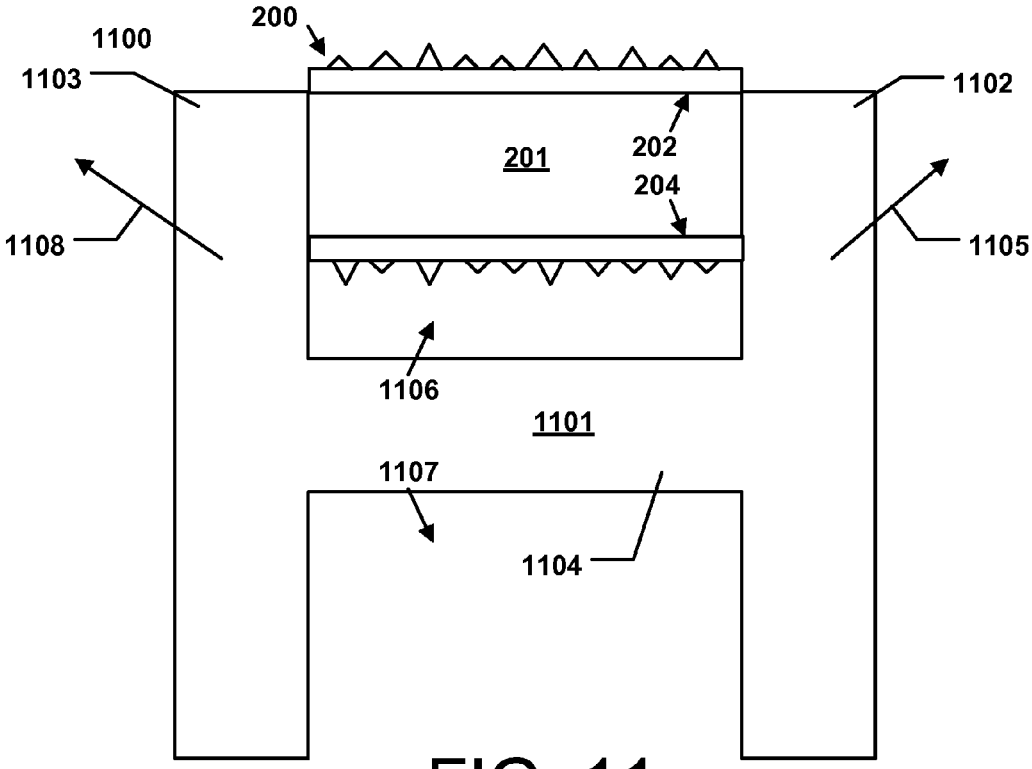
FIG. 11 includes a cross-sectional illustration of a portion of an abrasive tool in accordance with an embodiment.

FIG. 11 includes a cross-sectional illustration of an abrasive tool in accordance with an embodiment. As illustrated, the abrasive tool 1100 includes an abrasive article 200 that is contained within a recess 1106 of a plate 1101. Notably, the plate 1101 is a generally H-shaped member having a first arm 1103 and a second arm 1102 joined by a third arm 1104 forming a first recess 1106 and a second recess 1107 therebetween. During assembly, the abrasive article 200 can be placed within the recess 1106 by first placing sufficient pressure within the first recess 1107 to urge the arms 1103 and 1102 to move away from each other in the directions 1105 and 1108. The application of pressure can be provided by a fluid or gas. After the arms 1102 and 1103 have been sufficiently separated in the directions 1105 and 1108, the abrasive article 200 can be placed within the recess 1106 between the arms 1102 and 1103, and after proper placement of the abrasive article 200, the pressure within the recess 1107 can be changed (i.e., lessened) to urge the arms 1103 and 1102 to return to the starting position. Removal of the pressure from within the recess 1107 allows the arms 1103 and 1102 to return to their original positions, thereby clamping the abrasive article 200 in place between the arms 1103 and 1102 within the recess 1106. To remove the abrasive article 200, pressure can be applied within the recess 1107 to separate the arms 1103 and 1102 in the directions 1108 and 1105.

Figure 12A:
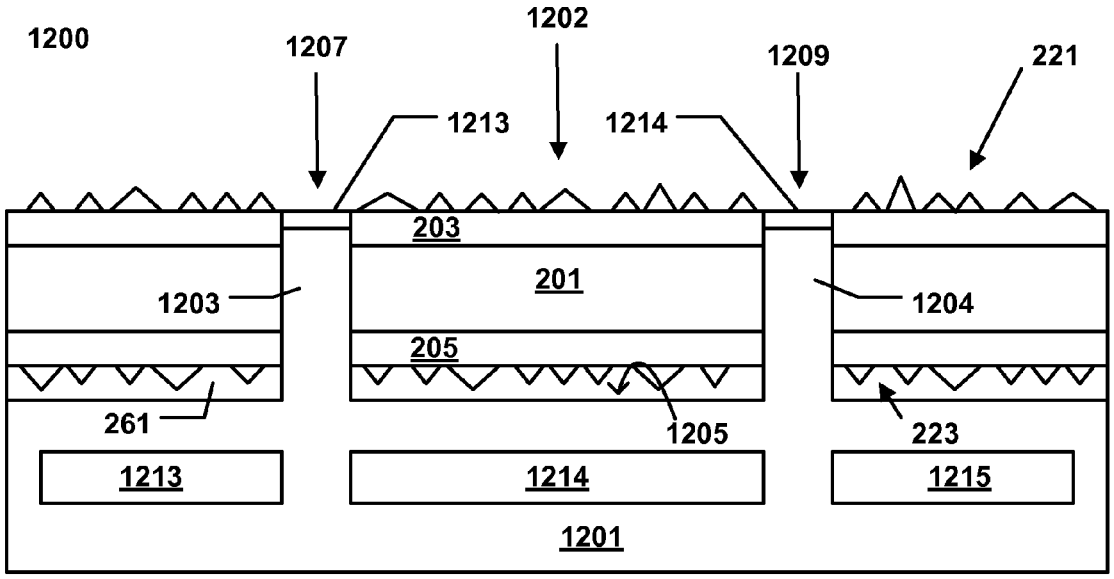
FIG. 12A includes a cross-sectional illustration of a portion of an abrasive tool in accordance with an embodiment.

FIG. 12A includes a cross-sectional illustration of a portion of an abrasive tool in accordance with an embodiment. Notably, the abrasive tool 1200 includes a plate 1201 and an abrasive article 1202 overlying and removably coupled to the plate 1201. In particular, the abrasive article 1202 includes engagement structures in the form of openings 1207 and 1209 that extend axially through the entire thickness of the abrasive article 1202. The openings 1207 and 1209 are configured to be engaged with pins 1203 and 1204 extending from an upper surface 1205 of the plate 1201, such that the abrasive article 1202 is secured in its placement and orientation relative to the plate 1201. The pins 1203 and 1204 can be affixed to the upper surface 1205 of the substrate 1201, or in other designs, the pins 1203 and 1204 and substrate 1201 can be a single monolithic piece.

As further illustrated, the pins 1203 and 1204 can include upper layers 1213 and 1214 that overlie the top surfaces of the pins 1203 and 1204. In particular, the upper layer 1213 and 1214 can be directly attached to the upper surfaces of the pins 1203 and 1204, and more particularly, the upper layers 1213 and 1214 can be configured to be flush with the upper surface of the bonding layer 203 of the abrasive article 1202. The upper layers 1213 and 1214 facilitate sealing the connection between the abrasive article 1202 and the pins 1203 and 1204. Moreover, the upper layers 1213 and 1214 can be made of a soft or pliable material such that they do not interfere with a conditioning process. According to one embodiment, the upper layers 1213 and 1214 can include a polymer material.

The abrasive tool 1200 can further include magnets 1213, 1214, and 1215 disposed within the plate 1201 and configured to magnetically attract and couple the substrate 201 of the abrasive article 1202 to the plate 1201. The magnets 1213-1215 can have a polarity that is suitable for attracting the substrate 1201 or other material within the abrasive article 200 to the upper surface 1205 of the plate 1201. The magnets 1213-1215 can be embedded within the plate 1201 such that they are completely surrounded on all sides by the material of the plate 1201.

It will be appreciated while the abrasive tool 1200 of FIG. 12A is illustrated as including magnets 1213, 1214, and 1215 within the interior of the plate 1201. In accordance with other embodiments, such magnets may be present in the abrasive article 1202. Moreover, both the abrasive article 1202 and the plate 1201 may include magnets such that they are opposite in polarity and attract each other thereby securing the abrasive article 1202 to the plate 1201. Moreover, it will be further appreciated that while the embodiment of FIG. 12A demonstrates magnets, any of the embodiments herein may incorporate magnetic coupling mechanisms to form abrasive tools.

In accordance with an alternative embodiment, the plate 1201 and abrasive article 1202 may be removably coupled via electrode connections, such as anodic bonding, wherein opposite charges are provided at the plate 1201 and substrate 201 to encourage coupling between the two members.

Figure 12B:
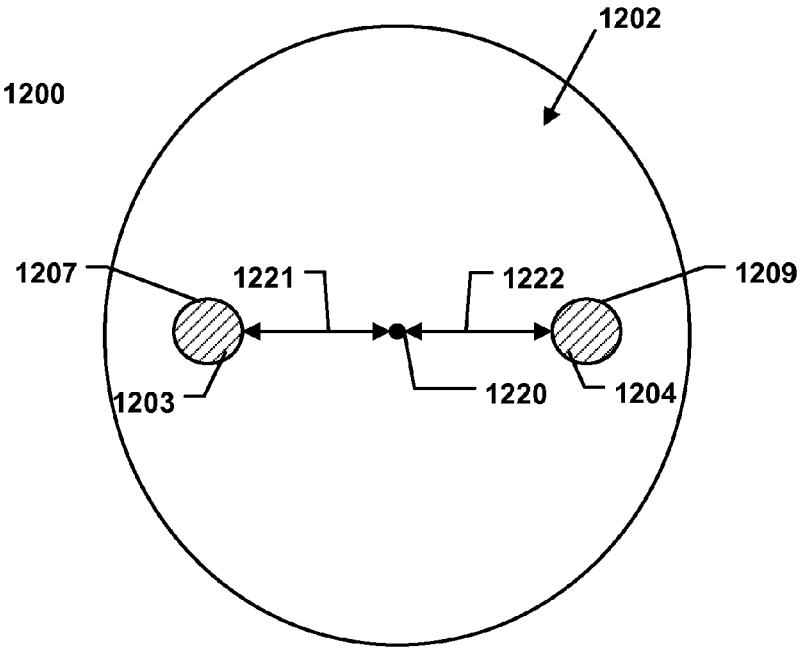
FIGS. 12B-12C include top views of an abrasive tool in accordance with an embodiment.

The abrasive tool 1200 is illustrated in a top view in FIG. 12B, and as described, the abrasive tool 1200 includes an abrasive article 1202 having openings 1207 and 1209 for engagement of pins 1203 and 1204 therein. Notably, the openings 1207 and 1209 within the abrasive article 1202 are spaced apart radially from a center point 1220, and in particular, the opening 1207 within the abrasive article 1202 is spaced apart at a radial distance 1221 from the center point 1220 of the abrasive article 1202, while the opening 1209 is spaced apart from the center point 1220 by a radial distance 1222. Spacing of the openings 1207 and 1209 from the center point 1220 of the abrasive article 1202 facilitates locking the abrasive article 1202 on the place 1201 such that it does not rotate during a conditioning operation.

Figure 12C:
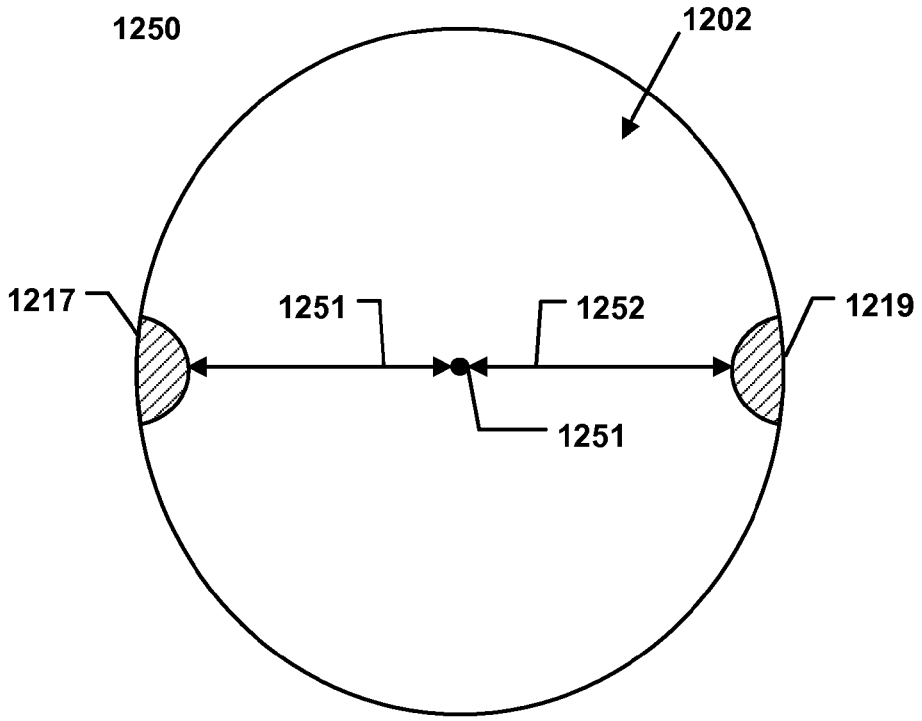

FIG. 12C includes a top view of an abrasive tool in accordance with an embodiment. The abrasive tool 1250 includes an abrasive article 1202 which is overlying an upper surface of a plate (not shown). The abrasive article 1202 includes openings 1217 and 1219 which are spaced apart from the center point 1253 of the abrasive article 1202. In particular, the openings 1217 and 1219 are situated at the periphery of the abrasive article 1202 such that the circumference of the abrasive article 1202 intercepts the openings 1217 and 1219. Additionally, the openings 1217 and 1219 can be spaced at a distance from a center point 1253 and a radial distance of 1251 and 1252 as illustrated to facilitate suitable coupling between the abrasive article 1202 and the plate such that the abrasive article 1202 does not rotate or change position during a dressing operation.

Figure 13:
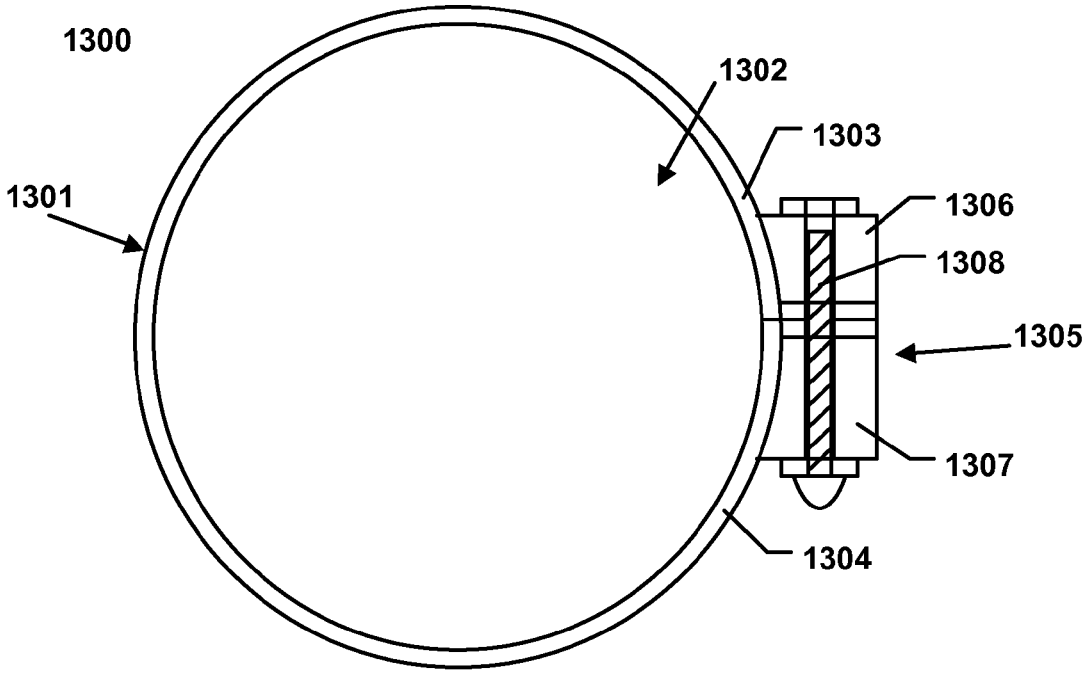
FIG. 13 includes a top view of an abrasive tool in accordance with an embodiment.

FIG. 13 includes a top view illustration of an abrasive tool in accordance with an embodiment. As illustrated, the abrasive tool 1300 can include an abrasive article 1302 which can be removably coupled to a plate (not illustrated), which can be coupled to the bottom of the abrasive article via a clamp ring 1301. The clamp ring 1301 includes a first ring portion 1303 and a second ring portion 1304 that are configured to extend around the periphery of the abrasive article 1302 and secure it to the clamp ring 1301. The first ring portion 1303 and the second ring portion 1303 can be joined by a clamp assembly 1305 which includes a fastener 1308. During operation, the abrasive article 1302 can be placed within the clamp ring 1301 and the first portion 1303 and second portion 1304 can be closed around the abrasive article 1302 via engagement of the fastener 1308 between a first clamp portion 1306 and a second clamp portion 1307. In particular, engagement of the fastener 1308 with the first clamp portion 1306 and second clamp portion 1307 helps reduce space between the first and second clamp portions 1306 and 1307 and secure the abrasive article 1302 between the first ring portion 1303 and second ring portion 1305.

Figure 14:
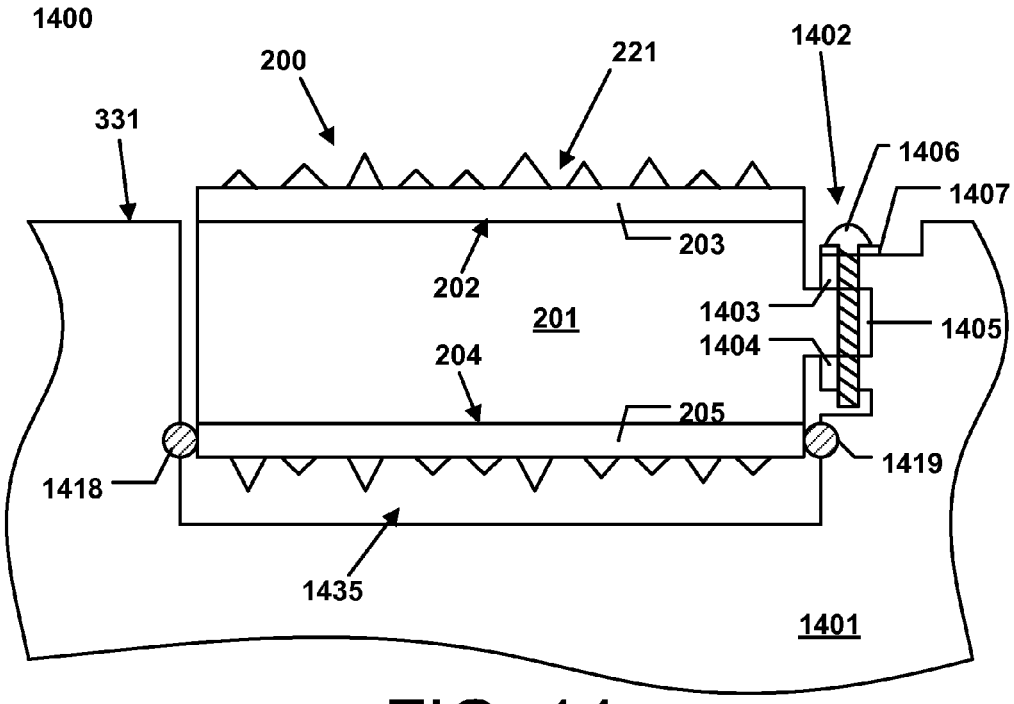
FIG. 14 includes a cross-sectional illustration of a portion of an abrasive tool in accordance with an embodiment.

FIG. 14 includes a cross-sectional illustration of an abrasive tool in accordance with an embodiment. The abrasive tool 1400 includes a coupling mechanism 1402 for removably coupling the abrasive article 200 with the plate 1401. According to the illustrated embodiment, the coupling mechanism 1402 utilizes an engagement structure 1405 extending from the body of the substrate 201 which engages protrusions 1403 and 1404 within the plate 1401. In particular, the engagement structure 1405 is a protrusion that extends laterally from the side of the substrate and configured to be engaged in a recess between the protrusions 1403 and 1404 of the plate. Moreover, the coupling mechanism 1402 further includes a fastener 1406 to facilitate coupling between the engagement structure 1405 of the substrate 201 and protrusions 1403 and 1404 of the plate 1401. As will be appreciated, the engagement structure 1405 and protrusions 1403 and 1404 can have openings extending through them for engagement of the fastener 1406 therein. Additionally, a washer 1407 may be disposed between the fastener 1406 and a surface of the plate 1401.

During operation, the engagement structure 1405 of the substrate 201 can be placed in between the protrusions 1403 and 1404 of the plate 1401 and upon proper alignment between the protrusions 1403, 1404, and 1405, a fastener 1406 may be threaded through each of the protrusions 1403-1405 to removably couple the abrasive article 200 to the plate 1401. It will be appreciated that while the abrasive tool 1400 is illustrated as having a single coupling mechanism 1402 disposed on one side of the abrasive article 200, additional coupling mechanisms can be added to properly secure the abrasive article 200 to the plate 1401.

The abrasive tool 1400 further includes sealing members 1418 and 1419. In particular, the sealing members 1418 and 1419 are disposed at a position below the coupling mechanism 1402 and are attached to the plate 1401. As further illustrated, the sealing members 1418 and 1419 are situated in a manner to engage the side surface of the abrasive article 200, and in some designs, the sealing members 1418 and 1419 may engage the bonding layer 205 to inhibit debris and fluids from entering the recess 1435 and avoid contamination of the unused side of the abrasive article 200 and risk contamination of pads to be dressed in subsequent dressing operations. While not illustrated in the embodiment of FIG. 14, additional sealing members may be placed at particular positions between the abrasive article 200 and surfaces of the plate 1401, such as at a location between the substrate 201 and the protrusion 1403 to inhibit debris and fluids form entering the coupling mechanism 1402.

Figure 15:
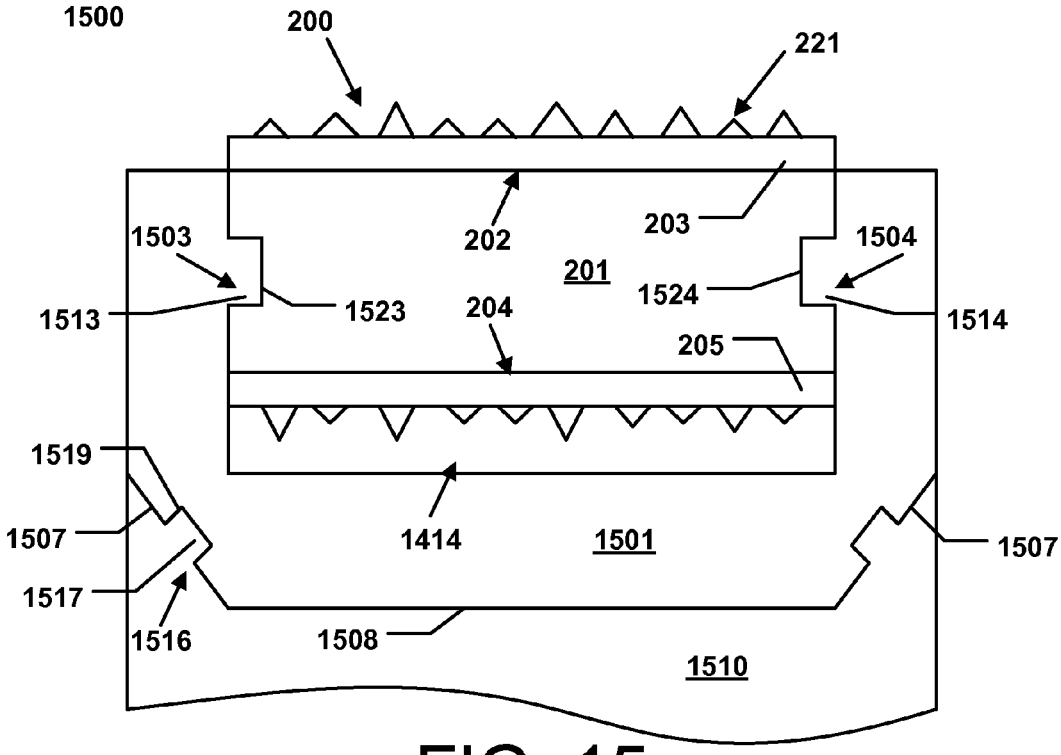
FIG. 15 includes a cross-sectional illustration of a portion of an abrasive tool in accordance with an embodiment.

FIG. 15 includes a cross-sectional illustration of an abrasive tool in accordance with an embodiment. The abrasive tool 1500 can include an abrasive article 200 that is removably coupled to a collet member 1501, and the collet member 1501 can be removable coupled to a plate 1510. In accordance with one embodiment, the abrasive tool 1500 includes engagement structures 1503 and 1504 and is configured to be removably coupled to the abrasive article 200 within a recess 1514 of the collet member 1501. The coupling mechanisms 1503 and 1504 can include protrusions 1513 and 1514 extending from the body of the collet number 1501 and configured to engage recesses 1523 and 1524 within the substrate 201. While the coupling mechanisms 1503 and 1504 are illustrated as including protrusions 1513 and 1514 engaged within the recesses 1523 and 1524, it will be appreciated that any of the other coupling mechanisms described herein can be used to couple the abrasive article 200 to the collet member 1501.

As illustrated, the collet member 1501 can include a surface 1507 that is slanted or angled with respect to the first and second major surfaces 202 and 204 of the substrate 201 and the bottom surface 1508 of the collet member 1501. Additionally, in certain embodiments, the collet member 1501 can include an engagement structure 1516 disposed in the surface 1507 to removably couple the collet member to the plate 1510. In particular, the collet member 1501, and more particularly, the engagement structure 1516 can include a channel 1519 within the surface 1507 configured to engage a protrusion 1517 within the plate 1510 such that the two components can be removably coupled. In certain embodiments, the engagement structure 1516 can include a rotate-and-lock mechanism such that the protrusion 1517 of the plate 1510 can be initially engaged within the channel 1519 of the collet member 1501, and thereafter, either the collet member 1501 or the plate 1510 can be rotated by a certain degree to lock the position of the collet member 1501 relative to the plate 1510. It will be appreciated that the collet member 1501 is an intermediate component between the abrasive article 200 and the plate 1510, and moreover, such a collet member 1501 may be used with any of the embodiments herein.

Moreover, the collet member 1501 can be a composite member including more than one type of material, such that certain portions of the collet member 1501 are capable of expanding and retracting around the plate 1510 at the coupling interface to facilitate a compliant and tight fit between the two components. For example, portions of the collet member 1501 can include a hard material such as a metal or metal alloy that can be coupled to a portion of the collet member 1501 that includes a softer material such as a polymer material, for example a rubber or silicone material. Notably, the portions including the softer material can include those surfaces designed to directly couple the collet member 1501 to the plate 1510.

Figure 16:
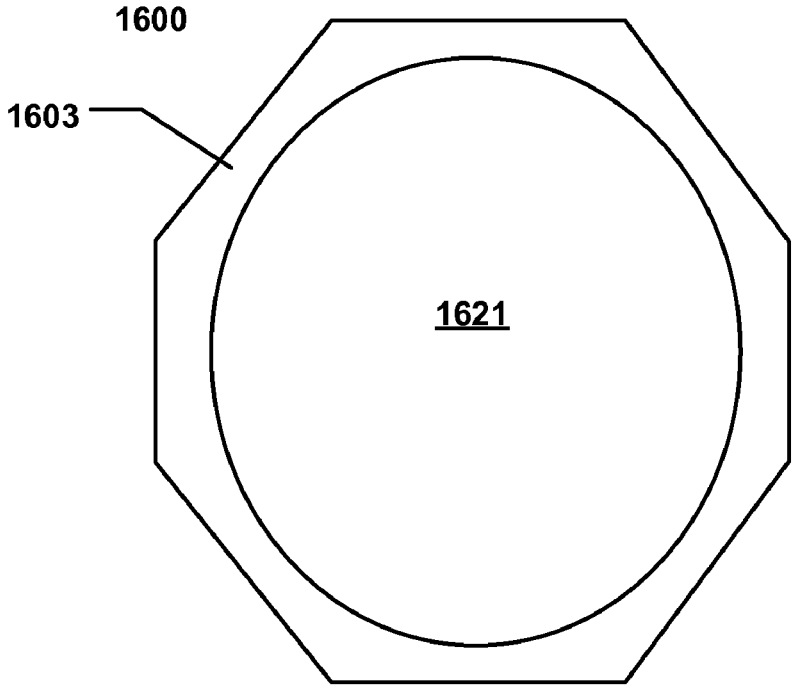
FIG. 16 includes a top view of an abrasive tool in accordance with an embodiment.

FIG. 16 includes a top view illustration of an abrasive tool in accordance with an embodiment. As illustrated, the abrasive tool 1600 includes an abrasive article 1602 which includes a substrate 1603 and layer of abrasive grains 1621 overlying the substrate 1603. In certain designs, the substrate 1603 can have a generally polygonal shape including sides and corners, while the layer of abrasive grain 1621 are oriented on the surface in a shape that is different than the general shape of the substrate 1603. For example, as presented in the embodiment of FIG. 16, the layer of abrasive grains are present on the surface of the substrate 1603 in a generally circular pattern. In particular, the shape of the substrate 1603 such that it incorporates sides and corners facilitates easier coupling of the substrate 1603 with a plate (not illustrated) for removable coupling the abrasive article 1602 with a plate.

Figure 17:
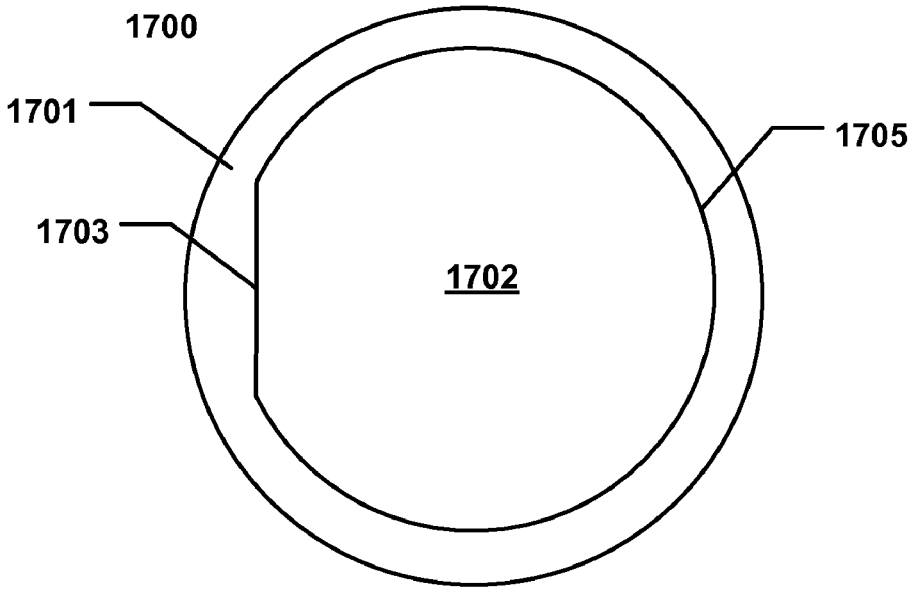
FIG. 17 includes a top view of an abrasive tool in accordance with an embodiment.

FIG. 17 includes a top view illustration of an abrasive tool in accordance with an embodiment. The abrasive tool 1700 includes a plate 1701 that is removably coupled to an abrasive article 1702. In particular, the plate 1701 can have a contour as viewed from the top (as opposed to a cross-sectional contour as viewed through a portion of the plate body) that is significantly different than a contour of the abrasive article 1702. For example, according to the illustrated embodiment of FIG. 17, the plate 1701 can have a generally circular contour as viewed from the top while the abrasive article 1702. However, the abrasive article 1702 has a contour that includes an arcuate portion 1705 defining a portion of the periphery and further includes a flat portion 1703 that defines a portion of the periphery. In particular, the arcuate portion 1705 can have a generally semi-circular shape such that it extends through at least 180° of the periphery. Notably, the flat 1703 provides corners and a side that facilitates securing the position and the orientation of the removable abrasive article 1702 within the plate 1701 such that the abrasive article 1702 does not rotate or shift during a dressing operation.

Figure 18:
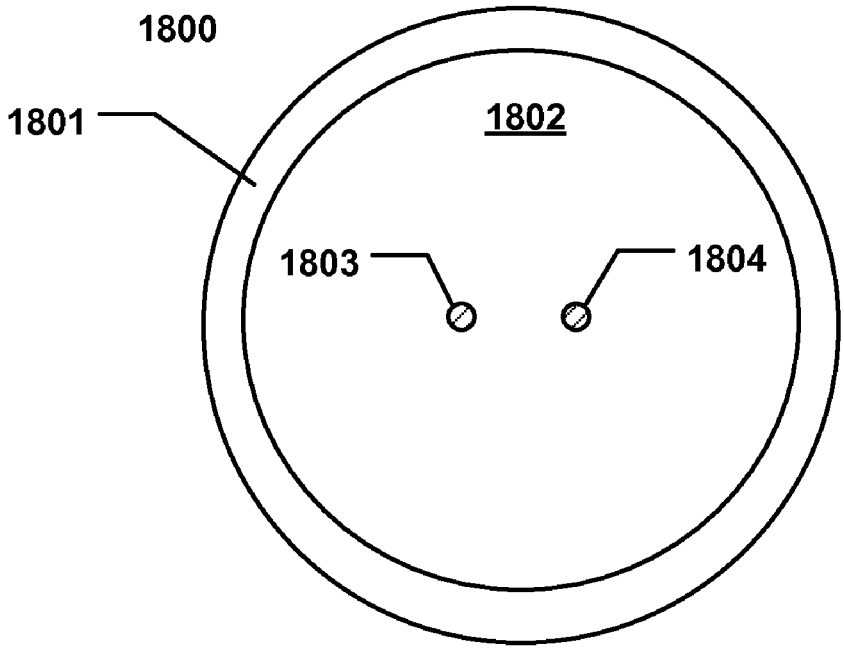
FIG. 18 includes a top view of an abrasive tool in accordance with an embodiment.

FIG. 18 includes a top view illustration of an abrasive tool in accordance with an embodiment. The abrasive tool 1800 includes an abrasive article 1802 removably coupled with the plate 1801. In particular, the abrasive article 1802 includes openings 1803 and 1804 that can extend through the layer of abrasive grains and bonding layer into the interior of the body of the substrate. The openings 1803 and 1804 can be used for removably coupling the abrasive article 1802 with the plate 1801. For example, according to one embodiment, the openings 1803 and 1804 can provide key hole openings for a tool that is designed to engage the abrasive article 1802 within the openings 1803 and 1804 and aid gripping and removal of the abrasive article 1802 from the plate 1801. For example, in one embodiment a keyed tool can include a handle and complementary protrusions configured to engage the abrasive article 1802 within the openings 1803 and 1804. In particular instances, the keyed tool can be used to rotate the abrasive article 1802 relative to the plate 1801 thereby removing the abrasive article 1802 from the plate 1801. In alternative designs, the abrasive article 1802 and plate can be removably coupled via magnetic attraction, and the keyed tool can include a complementary protrusions configured to engage the abrasive article 1802 within the openings 1803 and 1804 and further include a magnet configured to attract the abrasive article 1802 and effectively decouple the abrasive article 1802 from the plate 1801.

Figure 19:
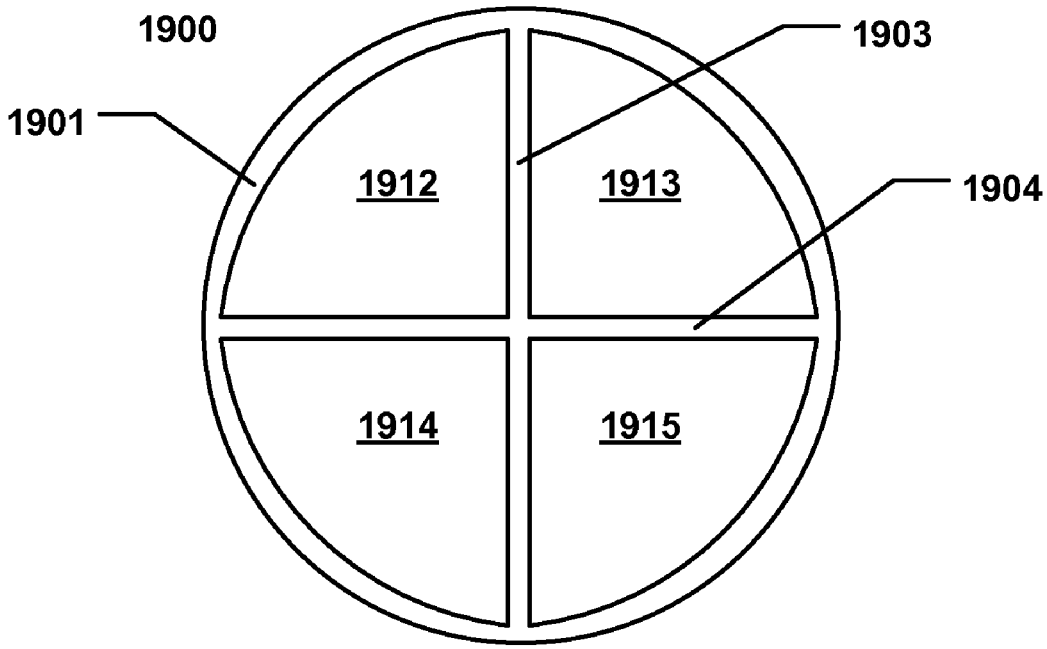
FIG. 19 includes a top view of an abrasive tool in accordance with an embodiment.

FIG. 19 includes a top view illustration of an abrasive tool in accordance with an embodiment. The abrasive tool 1900 includes a plate 1901 that includes a plurality of abrasive articles 1912, 1913, 1914, 1915 (1912-1915) oriented in a particular arrangement on the surface of the plate 1901. As illustrated, the abrasive articles 1912-1915 can each have a unique shape different from each other to form a pattern on the surface of the plate 1901. Additionally, the abrasive tool 1900 includes channels 1903 and 1904 separating the abrasive articles 1912-1915. The channels 1903 and 1904 formed on the surface of the abrasive tool 1900 may facilitate removal of swarf and other debris during a CMP dressing operation. It will be appreciated that each of the abrasive articles 1912-1915 have a unique shape and are configured to be removably coupled with the plate 1901.

Figure 20:
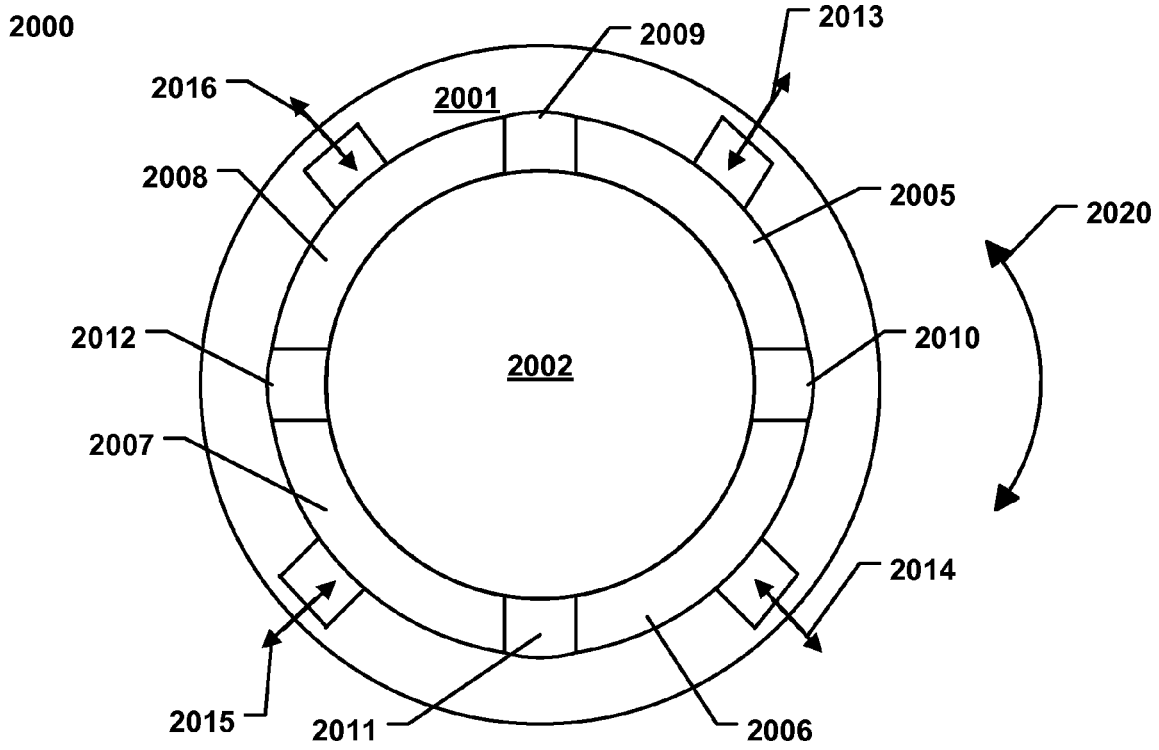
FIG. 20 includes a top view of an abrasive tool in accordance with an embodiment.

FIG. 20 includes a top view illustration of an abrasive tool in accordance with an embodiment. The abrasive tool 2000 includes a plate 2001 and an abrasive article 2002 removably coupled to the plate 2001. Like the other embodiments herein, the abrasive article 2002 is reversible having a substrate including a layer of abrasive grains on a first major surface and second major surface opposite the first. In particular, the coupling mechanism for removably coupling the abrasive article 2002 to the plate 2001 includes a series of maneuverable jaws 2005, 2006, 2007, and 2008 (2005-2008). According to one embodiment, the maneuverable jaws 2005-2008 can be moved to engage and clamp the abrasive article 2002 on the surface of the plate 2001. The maneuverable jaws 2005-2008 can be actuated using different mechanisms, including for example mechanical means, such as a turn, screw, crank, wedge, slide, or the like. The maneuverable jaws 2005-2008 can be operated individually or together for proper positioning of the abrasive article 2002 on the plate 2001.

In one particular embodiment, the maneuverable jaws 2005-2008 can be moved in the directions indicated by the arrows 2013, 2014, 2015, and 2016, that is, in generally inward and outward radial directions with respect to the center of the plate, to engage the abrasive article 2002. In certain designs, the maneuverable jaws 2005-2008 can be moved by rotating the plate 2001 (or the maneuverable jaws 2005-2008 relative to the plate 2001) in the direction as indicated by arrow 2020. Accordingly, the plate 2001 may include ridges or grooves, particularly spiral ridges or grooves, along it upper surface for coupling and moving the maneuverable jaws 2005-2008 relative to the surface of the plate 2001. For example, rotation of the plate 2001 in a clockwise direction may facilitate moving the maneuverable jaws 2005-2008 in a radially inward direction (toward the center of the plate 2001) to engage the abrasive article 2002. While rotation of the plate 2001 in an opposite direction may facilitate moving the maneuverable jaws 2005-2008 in a radially outward direction.

During use of the abrasive tool 2000, a user can place the abrasive article 2002 on the plate 2001 and rotate the plate or a portion of the plate (e.g., an upper portion of the plate) in a clockwise manner until the maneuverable jaws 2005-2008 are moved radially inward and engage the abrasive article 2002. After sufficient use of the abrasive article 2002, a user can remove the abrasive article 2002 by rotating the plate in an opposite direction (i.e., counter-clockwise direction) to move the maneuverable jaws 2005-2008 in a radially outward direction thus disengaging the abrasive article 2002 for removal from the plate 2001.

Additionally, the abrasive tool 2000 can include sealing members 2009, 2010, 2011, and 2012 (2009-2012). In accordance with one embodiment, the position of the sealing members 2009-2012 are fixed on the surface of the plate 2001 thereby facilitating initial placement of the abrasive article 2002 relative to the plate 2001. Moreover, during movement of the maneuverable jaws 2005-2008 in a radially inward direction, the sealing members 2009-2012 can be disposed between each of the arms 2005-2008 facilitating sealing between the maneuverable jaws 2005-2008, the abrasive article 2002, and the plate 2001. In other embodiments, the sealing members 2009-2012 can be fixably attached to the ends of certain the maneuverable jaws 2005-2008 and move radially with the maneuverable jaws 2005-2008.

Figure 21:
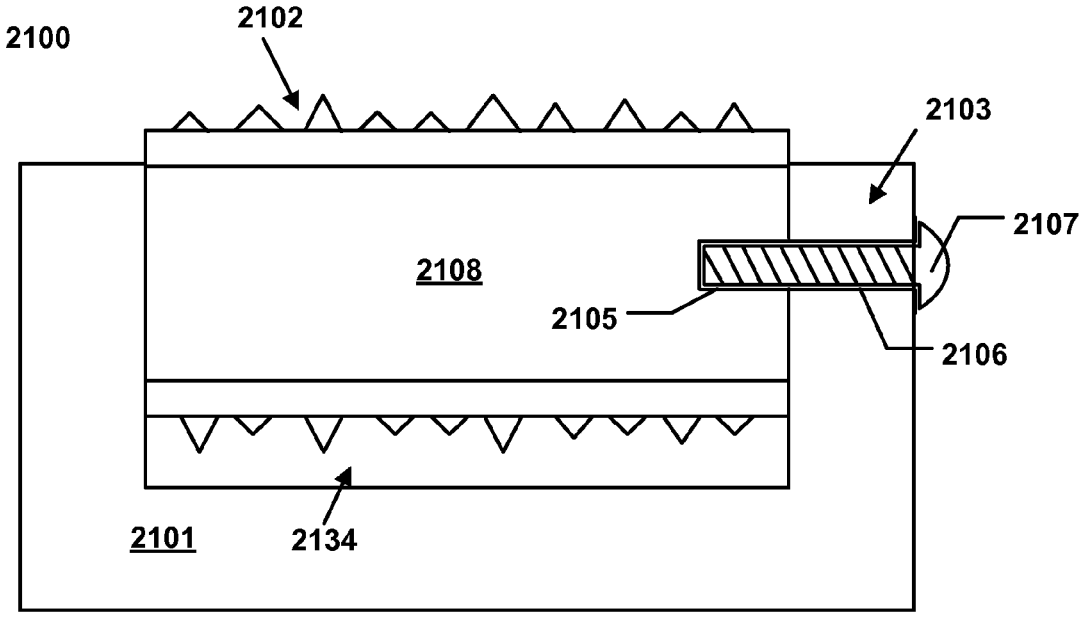
FIG. 21 includes a cross-sectional illustration of a portion of an abrasive tool in accordance with an embodiment.

FIG. 21 includes a cross-sectional illustration of an abrasive tool in accordance with an embodiment. The abrasive tool 2100 includes an abrasive article 2102 that is removably coupled within a recess 2134 of a plate 2101. The abrasive article 2102 can be removable coupled within the recessed 2134 via a coupling mechanism 2103. The coupling mechanism 2103 can include a fastener 2107 that is configured to be engaged within an opening 2106 of the body of the plate 2101 and correspondingly engaged within an opening 2105 extending into a portion of the substrate 2108 of the abrasive article 2102. According to the embodiment of FIG. 21, the fastener 2107 can extend laterally through a portion of the plate 2101 and substrate 2108 to facilitate locking the position of the abrasive article 2102 relative to the plate 2101. It will be appreciated that more than one fastener 2107 can be used to removably couple the abrasive article 2102 and the plate 2101. Moreover, while not illustrated, one or more sealing members can be disposed between the abrasive article 2102 and the plate 2101, such as between the substrate 2108 and an inner surface of the plate 2101 to reduce the likelihood of debris and fluid from entering the recess 2134. In alternative designs, ridges or other placement members (See, for example, ridges 521 and 523 of FIG. 5) may be provided within the recess to aid proper placement of the abrasive article 2102 relative to the plate 2101 to facilitate alignment of the openings 2106 and 2105 and engagement of the fastener 2107 therein. It will further be appreciated that while a fastener 2107 is illustrated, other fastening mechanisms such as Allen bolts, nuts, pins, and the like can be used.

Figure 22:
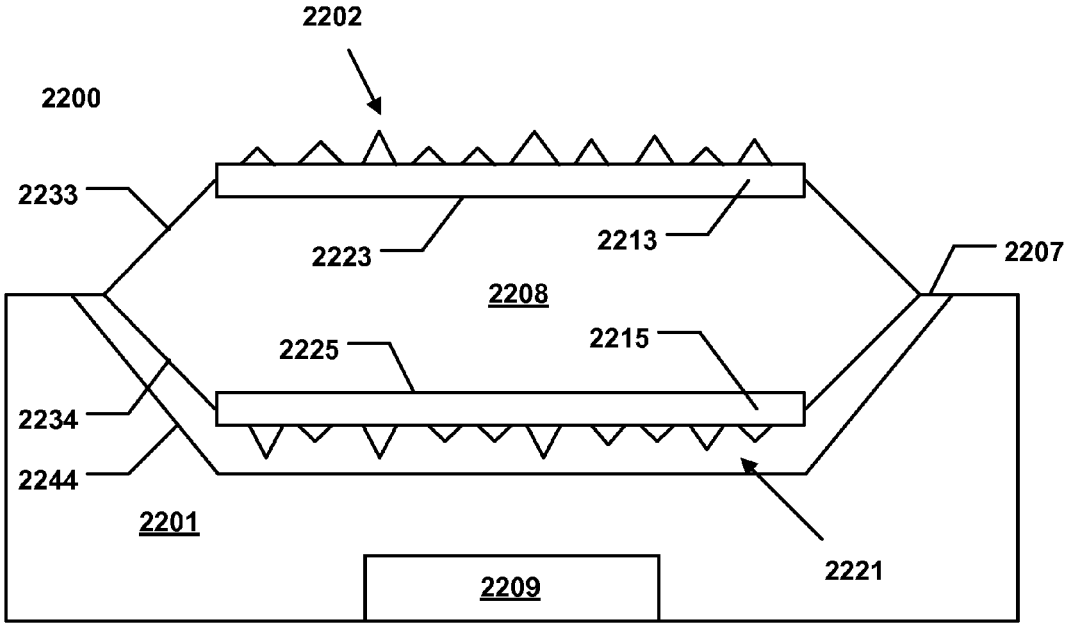
FIG. 22 includes a cross-sectional illustration of a portion of an abrasive tool in accordance with an embodiment.

FIG. 22 includes a cross-sectional illustration of an abrasive tool in accordance with an embodiment. The abrasive tool 2200 includes an abrasive article 2202 removably coupled to a plate 2201. The plate 2201 can include magnet 2209 within the body of the plate 2201, which facilitates coupling between the abrasive article 2202 and the plate 2201. The magnet 2209 can have a polarity and strength sufficient to attract the abrasive article 2202, particularly the substrate 2208 of the abrasive article 2202, wherein the substrate 2202 can include a material capable of being magnetically attracted to the magnet 2209, such as a metal or metal alloy. In particular embodiments, the magnet 2209 is oriented at the bottom surface of the plate 2201, such that it is not surrounded on all sides by the body of the plate 2201 and is accessible from the back surface 2255 of the plate 2201. This may facilitate removal of the magnet 2209 for maintenance or replacement. Additionally, placement of the magnet 2209 at the back surface 2255 of the plate 2201 can provide adequate distance between the magnet 2209 and the substrate 2208 for coupling. Additionally, the position of the magnet 2209 can provide suitable spacing distance for removal of the abrasive article 2202 from the plate 2201 via a removal magnet (not shown) that can more closely engage and more strongly magnetically attract the substrate 2208, for decoupling of the abrasive article 2202 from the plate 2201.

As further illustrated, the substrate 2208 can have a unique shape, including surfaces 2233 and 2234 that are angled with respect to the upper and lower major surfaces 2223 and 2225 of the substrate 2208, respectively. The angled surfaces 2233 and 2234 provide a unique shape for complementary engagement with the angled surface 2244 of the substrate. Moreover, the angled surfaces 2233 and 2234 aid effective engagement between the abrasive article 2202 and a sealing member 2207 disposed between the plate 2201 and the abrasive article 2202. The sealing member 2207 can be a pliable film overlying a surface of the plate 2201 within the recess that is configured to be compressed and deformed upon coupling between the abrasive article 2202 and plate 2201. As will be appreciated, the sealing member 2207 can be a polymer material, or composite material incorporating a polymer material.

In accordance with one particular embodiment, the upper and lower major surfaces 2223 and 2225 of the substrate 2208 can include recesses wherein the bonding layers 2213 and 2215 are disposed, respectively. The recesses in the upper and lower major surfaces 2223 and 2225 provide an abrasive article incorporating bonding layers 2213 and 2215 that are secured with greater mechanical force to the substrate 2208 and also provides an abrasive article comprising a smoother profile, with less corners exposed for suitable coupling within the recess 2221 of the plate 2201 to avoid damage to the bonding layers 2213 and 2215 and abrasive grains contained therein.

Figure 23:
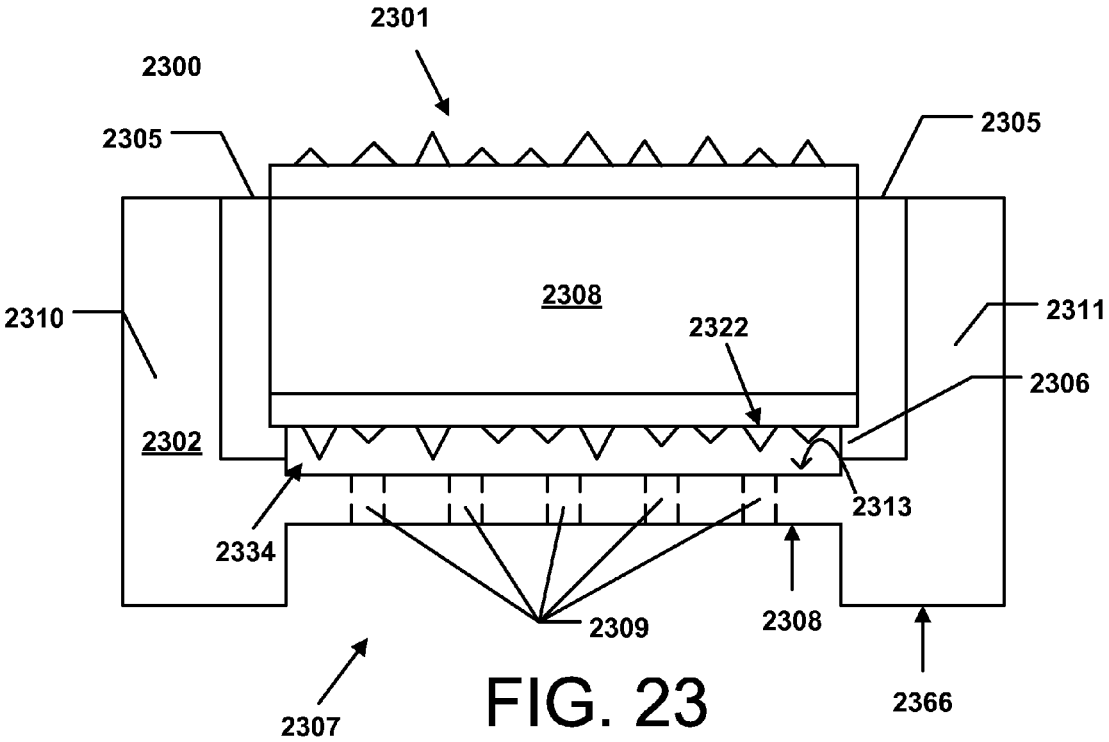
FIG. 23 includes a cross-sectional illustration of a portion of an abrasive tool in accordance with an embodiment.

FIG. 23 includes a cross-sectional illustration of an abrasive tool in accordance with an embodiment. The abrasive tool 2300 includes an abrasive article 2301 that is removably coupled to a plate 2302. Notably, the abrasive article 2302 includes a reversible abrasive article as described in accordance with other embodiments, incorporating first and second layers of abrasive grains on opposing first and second major surfaces of a substrate 2308. The abrasive article 2301 can be coupled within a recess 2334 of the plate 2303. In particular, the plate 2303 has a unique shape including first and second arms 2310 and 2311 on either side of the recess 2334 and a recess 2307 formed in a back surface 2366 of the plate. The recess 2307 includes a back surface 2308 and openings 2309 extending from the back surface of the recess 2307 through the body of the plate 2302 to a bottom surface 2313 of the recess 2334. Such a design can facilitate a pressurized coupling mechanism, wherein a reduced pressure atmosphere is provided within the recess 2307 thereby creating a pressure differential or suction force sufficient to hold the abrasive article 2302 within the recess 2334 of the plate 2302. The reduced pressure atmosphere within the recess 2307 can be provided by use of a vacuum pump that is suitably positioned and sealed with respect to the back surface 2366 of the plate 2302.

As further illustrate, the abrasive tool 2300 can further include a sealing member 2305 disposed along an inner surface of the plate 2302 within the recess 2334 and configured to engage the abrasive article 2301. In particular embodiments, the sealing member 2305 can include a ridge 2306 that protrudes from the body of the sealing member 2305 in a lateral direction into the recess 2334, such that it is configured to engage the bonding layer 2322 of the abrasive article 2301. The sealing member 2305 can reduce the penetration of debris and fluids from entering the recess 2334. The ridge 2306 of the sealing member 2305 can further aid proper placement of the abrasive article 2301 within the recess 2334, such that the bonding layer 2322 is properly spaced from the bottom surface 2313 of the recess 2334 to avoid damaging the layer of abrasive grains and facilitate formation of an adequate pressurized force to hold the abrasive article 2301 within the recess 2334.

FIGS. 24A-24D include illustrations of a method of using an abrasive article for conducting a CMP pad conditioning operation in accordance with an embodiment. In particular, the following figures demonstrate the reversible nature of the abrasive article, and the coupling arrangement between the abrasive article, the plate, and a holder.

Figure 24A:
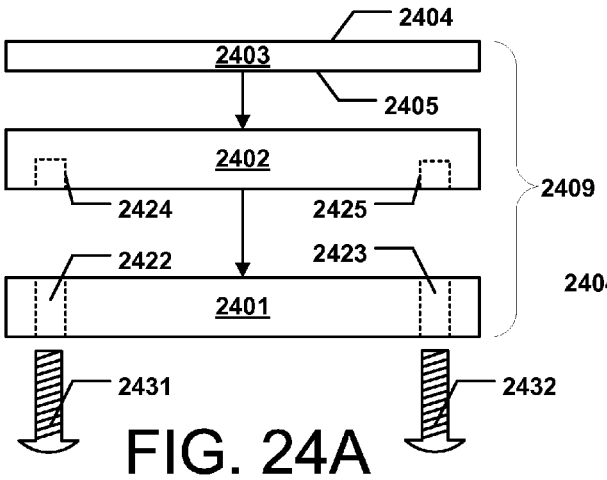
FIGS. 24A-24D include illustrations of a method of using an abrasive article for conducting a CMP pad conditioning operation in accordance with an embodiment.

FIG. 24A includes a cross-sectional illustration of a holder, a plate, and an abrasive article in accordance with an embodiment. In particular, the abrasive article 2403 is formed according to the embodiments herein, including a first abrasive surface 2404 and a second abrasive surface 2405 on the first and second major surfaces of a substrate, respectively. The first and second abrasive surfaces 2404 and 2405 can include abrasive texture or a combination of bonding layer and abrasive grains as described in accordance with the embodiments herein.

The holder 2401 can include a substrate, typically made of a metal or metal alloy material, and having openings 2422 and 2423 extending axially through the thickness of the body for engagement of fasteners 2431 and 2432 therein. The plate 2402 can be disposed between the holder 2401 and the abrasive article 2403 and can include complementary openings 2424 and 2425 extending from a rear surface for engagement of portions of the fasteners 2431 and 2432 therein to directly couple the plate 2402 to the holder 2401. By contrast, in conventional designs, the holder 2401 is based on a manufacturers standard design, typically integrated with a particular dressing machine, and the fasteners 2431 and 2432 are a common industry standard used to directly affix a pad conditioner to the holder 2401. The abrasive article 2403 can be removably coupled to the plate 2402, such that a first abrasive surface 2404 is configured to be exposed and ready to condition a CMP pad. The second abrasive surface 2405 can be located at a surface of the plate 2402 or within the plate 2402, such as contained within a recess of the plate 2402 as described herein.

Figure 24B:
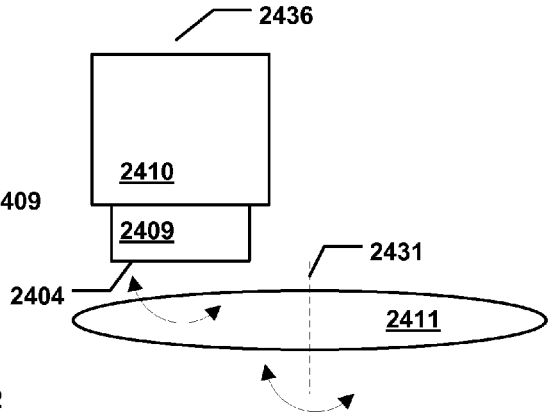

The holder 2401, plate 2402, and abrasive article 2403 can be combined to form an abrasive assembly 2409 that is attached to a CMP tool. FIG. 24B includes a schematic of a CMP tool in accordance with an embodiment. As illustrated, the CMP tool includes a dressing machine 2410 that can include electronic and mechanical systems suitable for conducting the CMP pad dressing processes.

The abrasive assembly 2409 can be coupled to the dressing machine 2410 in a manner such that the first abrasive surface 2404 is exposed and configured to contact and dress the CMP pad 2411. During operation, the first abrasive surface 2404 is contacted to a surface of the CMP pad 2411, which can be moved relative to the first abrasive surface 2404, and oftentimes, both the CMP pad 2411 and abrasive assembly 2409 are moved relative to each other to achieve suitable conditioning of the CMP pad 2411. Movement of the first abrasive surface 2404 and CMP pad 2411 can be a rotational motion, such that the CMP pad is rotated as illustrated about one axis 2431 and the abrasive assembly 2409 is rotated about a different axis 2436, as illustrated. The CMP pad 2411 and abrasive assembly 2409 may be rotated in the same or different directions. Such a process may be conducted regularly and repetitively for one or more CMP pads, until the expected conditioning lifetime of the first abrasive surface 2404 is exhausted. A user may record or track the amount of use or the wear status of the first abrasive surface 2404 using indicia provided on the substrate or by other means described herein.

During conventional conditioning processes, after the dresser has been thoroughly used and exhausted to its expected conditioning lifetime, the dresser is removed and discarded. However, according to embodiments herein, the abrasive article 2403 can be removed from the plate 2402, inverted such that the second abrasive surface is exposed, and a subsequent conditioning process may continue using the same abrasive article 2403.

Figure 24C:
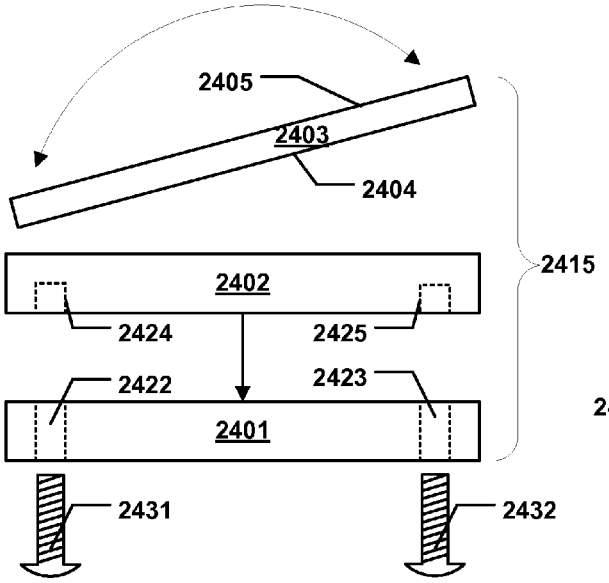

Referring to FIG. 24C, the holder 2401, plate 2402, and abrasive article 2403 are illustrated again. Notably, after thorough use of the first abrasive surface 2404, the abrasive article can be removed from the plate 2402, inverted as illustrated, and coupled again to the plate 2402. In this fashion, the second abrasive surface 2405 is exposed, while the first abrasive surface 2404 is unexposed, and the same abrasive article 2403 forms a different abrasive assembly 2415 that is ready for a second, subsequent conditioning procedure. In particular embodiments, inverting the abrasive article can include the removal of only the abrasive article 2403 from the plate 2402, while the plate 2402 and the holder 2401 remain coupled to the dressing machine 2410, which facilitates rapid and repetitive conditioning without significant interruptions to the CMP process.

Figure 24D:
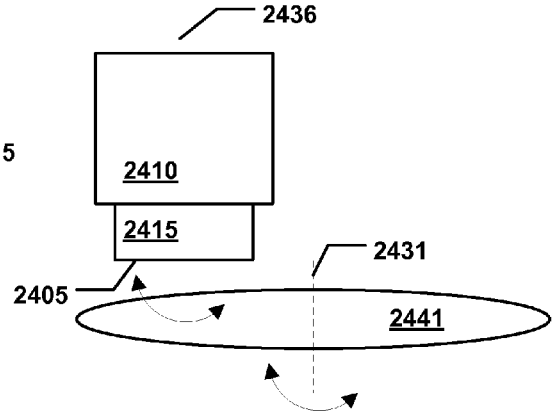

As illustrated in FIG. 24D, the abrasive assembly 2415 can be coupled to the dressing machine 2401 such that the second abrasive surface 2405 is exposed and configured to contact and condition a CMP pad 2441. The CMP pad 2441 can be the same pad as CMP pad 2411, however, because the life of the conditioners typically exceeds that of a single CMP pad, the CMP pads 2411 and 2441 are likely different. Conditioning operations can be completed using the second abrasive surface 2405 in the same manner as used for the first abrasive surface 2404, particularly including the movement of the CMP pad 2441 relative to the second abrasive surface 2405.

The following description provides additional details of particular abrasive articles including CMP pad conditioners, plates, and holders. The embodiments described in the following provide additional features facilitating removable coupling between the plate and the CMP pad conditioner aiding the use of a reversible CMP pad conditioner. It will be appreciated that the embodiments described in the following include features that can be used in combination with any features of the abrasive articles described herein.

Figure 25A:
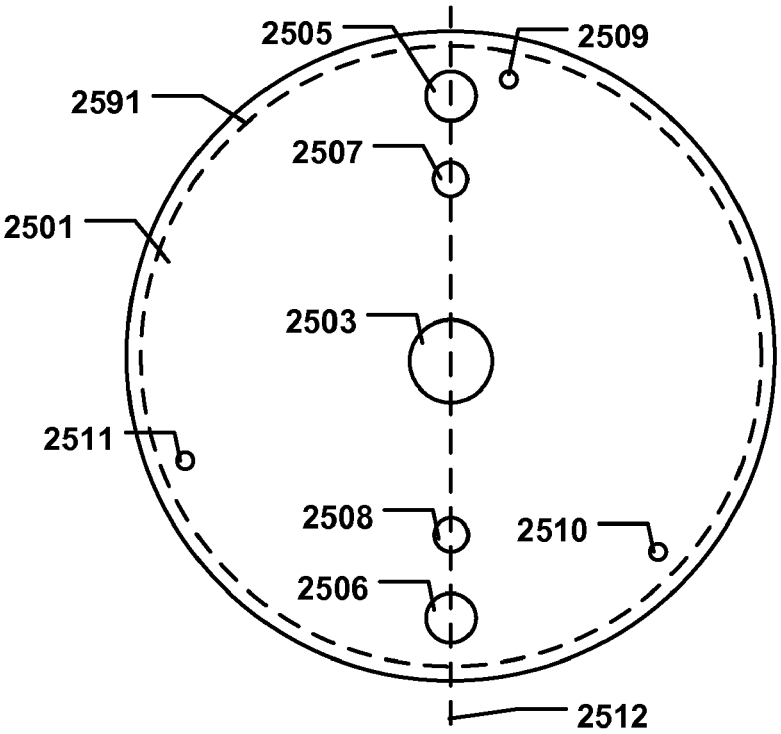
FIG. 25A includes a top view of a backside of a plate in accordance with an embodiment.

FIG. 25A includes a top view of a backside of a plate in accordance with an embodiment. As illustrated, the plate 2501 has a generally circular contour and can have a generally cylindrical three-dimensional shape. The plate 2501 can include a plurality of openings extending axially inward into the body of the plate 2501. The openings may serve to aid coupling of the plate 2501 with other objects that are part of the CMP conditioning process, including for example, a holder. As described herein, a holder may be part of a standard tool used in the industry to affix CMP pad conditioners thereto for operation with a polishing machine.

As illustrated, the plate 2501 can include a central opening 2503 extending into the body of the plate 2501. In particular instances, the opening 2503 can be positioned at the center of the body of the plate 2501 such that it encompasses and is centered about a center point of the plate 2501. Moreover, the opening 2503 can be formed such that it extends completely through the thickness of the body of the plate 2501 such that it may extend completely between an upper surface and lower surface of the body of the plate 2501. The opening 2503 may facilitate removal of a CMP pad conditioner from the plate 2501. In particular, the opening 2503 can provide access for a device or tool to extend through the central opening 2503 from the back surface of the plate 2501 to engage the back surface of the CMP pad conditioner contained within the plate 2501. The tool may be used to engage and urge the CMP pad conditioner from the plate 2501. This will be described in more detail in the following embodiments.

The plate 2501 can further include openings 2507 and 2508 that can be radially spaced apart from a center of the body of the plate 2501 and positioned on opposite sides of the central opening 2503 from each other. Notably, the openings 2507 and 2508 may be circumferentially spaced apart from each other through an angle of approximately 180 degrees. Such openings 2507 and 2508 may be used to removably couple the plate 2501 with a holder. The openings 2507 and 2508 may contain features configured to be used with fasteners, including for example, threaded surfaces configured for use with a threaded fastener.

The plate 2501 can further include openings 2505 and 2506 that can be radially spaced apart from the central opening 2503 and positioned on opposite sides of the central opening 2503 from each other. The openings 2505 and 2506 may be circumferentially spaced apart from each other by a particular angle. According to the illustrated embodiment, the openings 2505 and 2506 can be circumferentially spaced apart from each other by an angle of approximately 180°. The openings 2505 and 2506 may be used for coupling of the plate 2501 to a holder, and in particular designs can be formed to have may features configured to be used with fasteners. That is, the openings 2505 and 2506 may have threaded surfaces configured for engagement with fasteners therein to couple the plate 2501 to a holder.

The plate 2501 can also include openings 2509, 2510 and 2511, each of which are radially spaced apart from the central opening 2503. Additionally, the openings 2509, 2510, and 2511 can be positioned within the plate such that they are circumferentially spaced apart from each other. For example, the openings 2509-2511 can be circumferentially spaced apart from each other such that each are separated by a certain angle, such as approximately 120°. The openings 2509-2511 can be used for coupling of the plate 2501 to a holder, and may contain features suitable for coupling the plate 2501 and holder, such as threaded surfaces for engagement of threaded fasteners therein.

While the plate 2501 can include a plurality of openings, which may be used for coupling of the plate 2501 to a holder, it will be appreciated that not all of the openings may necessarily be used at once for coupling the plate 2501 to other objects, such as a holder. That is, the plate 2501 includes a plurality of openings, each of which are particularly positioned on the plate 2501 such that the plate 2501 can be coupled to various types of holders, wherein different industrial machines may have different styles of holders and thus utilize different configurations of fastening mechanisms. For example, certain holders may utilize three fasteners, in which case, the openings 2509-2511 of the plate 2501 may suffice for coupling of the plate 2501 with the holder. In other instances, certain holders may utilize two fasteners, in which case, the openings 2505 and 2506, or alternatively 2507 and 2508 may be used to couple the plate 2501 with the holder.

Figure 25B:
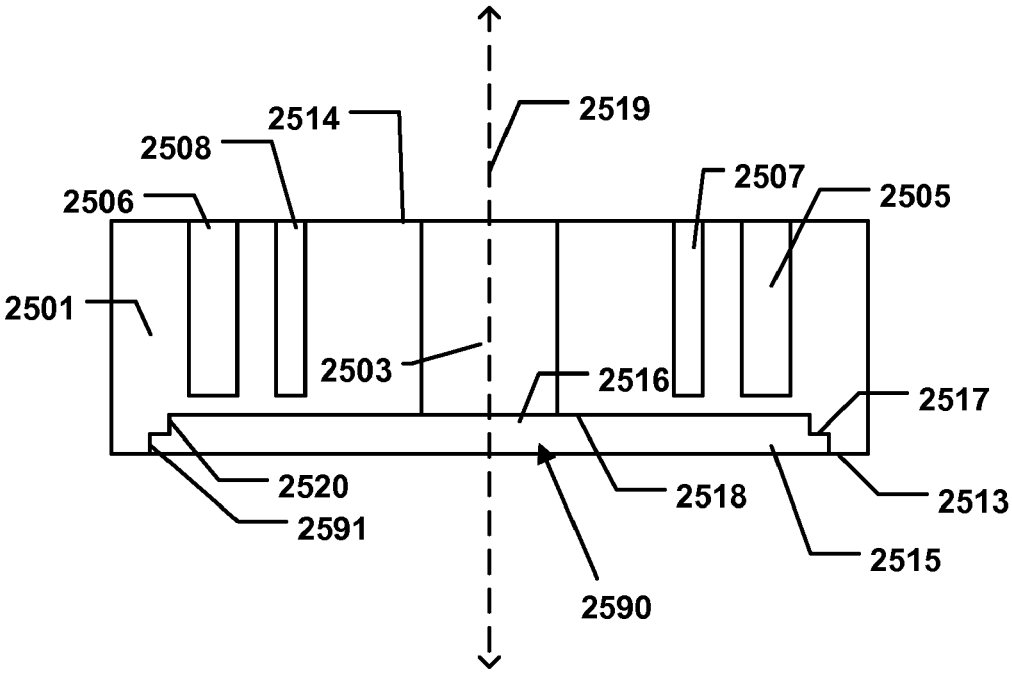
FIG. 25B includes a cross-sectional illustration of a portion of the plate of FIG. 25A in accordance with an embodiment.

FIG. 25B includes a cross-sectional illustration of the plate of FIG. 25A as viewed through along a plane defined by the axis 2512 in accordance with an embodiment. As illustrated, the plate 2501 includes openings 2506, 2508, 2503, 2507, and 2505 as described in FIG. 25A. The openings 2505, 2506, 2507, and 2508 can extend from a rear surface 2514 of the plate 2501 and extend axially along the axial axis 2519 into the body of the plate 2501. Notably, the openings 2505-2508 may not necessarily extend through the full thickness of the body of the plate 2501 from the rear surface 2514 to the upper surface 2513. That is, the openings 2505-2508 may extend for a discrete fraction of the total thickness of the body of the plate 2501. In particular, the openings 2505-2508 can be spaced apart from a bottom surface 2518 of a cavity 2590 formed in the upper surface 2513 of the body of the plate 2501. As such, in particular embodiments the openings 2505-2508 can be axially spaced apart from, and disconnected from the cavity 2590 formed in the upper surface 2513 of the body of the plate 2501. This design can assure that fasteners engaged within the openings 2505-2508 may not extend through the body of the plate 2501 to engage objects contained within the cavity 2590.

The central opening 2503 can extend through the entire thickness of the body of the plate 2501. That is, the central opening 2503 can extend from a rear surface 2514 and intersect the bottom surface 2518 of the cavity 2590 formed in the upper surface 2513 of the body of the plate 2501. As such, the central opening 2503 can extend through the entire thickness of the body of the plate 2501 such that the central opening 2503 and cavity 2508 are connected and the central opening 2503 can provide access to the cavity 2508 from the rear surface 2514 of the plate 2501.

The plate 2501 can be formed such that it includes the cavity 2590 formed in the upper surface 2513 of the body of the plate 2501 configured to contain the CMP pad conditioner therein for coupling the CMP pad conditioner and plate during conditioning operations. The cavity 2590 can extend axially inward into the body of the plate 2501. Moreover, it will be appreciated that the cavity 2590 can define a generally circular opening within the upper surface 2513 of the plate 2501 as viewed in a top down view.

The cavity 2590 of FIG. 25B is particularly shaped according to one embodiment. In particular, the cavity 2590 can include cavity portions. Each of the cavity portions can be defined by different surfaces within the cavity 2590 and may be shaped to contain different components of the abrasive tool. For example, the cavity 2590 can include a first cavity portion 2515 that can be a region defined by the surface 2591 extending along the axial axis 2519 generally perpendicular to the upper surface 2513 of the plate 2501, and a surface 2517 extending generally perpendicular to the axial axis 2519 and the surface 2591. Notably, the combination of surfaces 2591 and 2517 can form a step or shelf within the body of the plate 2501 and therein defining the first cavity portion 2515 extending axially into the body of the plate 2501.

Additionally, the cavity 2590 can include a second cavity portion 2516, which can be connected to and contiguous with the first cavity portion 2515. The second cavity portion 2516 can be defined by a surface 2520 extending generally parallel to the axial axis 2519 and connected to the surface 2517. Moreover, the second cavity portion 2516 can be defined by a bottom surface 2518 extending generally perpendicular to the axial axis 2519, which may intersect the surfaces of the central opening 2503. As illustrated, the second cavity portion 2516 can have a smaller width (e.g. diameter) as compared to the first cavity portion 2515. Such a design may facilitate placement of certain objects within the second cavity portion 2516 separate from objects to be contained within the first cavity portion 2515. For example, the abrasive tool can be formed such that an abrasive article (e.g., a CMP pad conditioner) can be contained within the first cavity portion 2515 while another object can be contained with the second cavity portion 2516, such as a pad.

While the embodiment of FIG. 25B has illustrated a cavity 2590 including cavity portions defined by different surfaces within the cavity 2590, in other designs, the cavity may be a simple recess defined by a bottom surface connected to side surfaces. That is, certain embodiments, may not necessarily employ a cavity having distinct cavity portions.

Figure 25C:
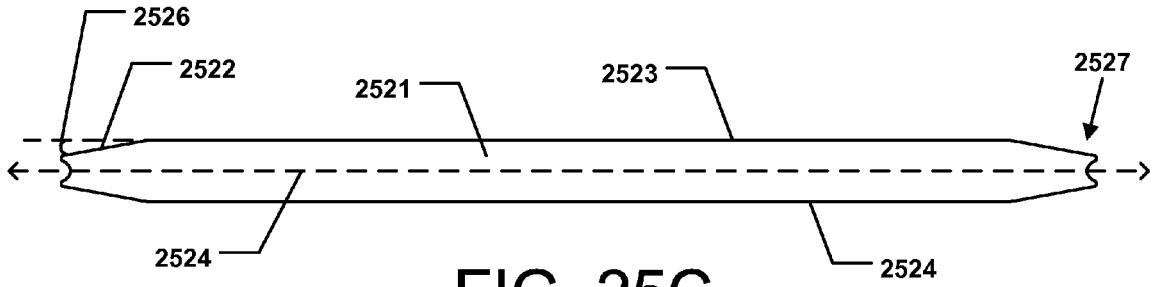
FIG. 25C includes a cross-sectional illustration of a CMP pad conditioner in accordance with an embodiment.

FIG. 25C includes a cross-sectional illustration of a CMP pad conditioner in accordance with an embodiment. The CMP pad conditioner 2521 can include those features as described in previous embodiments. Moreover, the CMP pad conditioner 2521 can have a first major surface 2523 extending parallel to the lateral or radial axis 2524. The first major surface 2523 can have an abrasive texture as described in accordance with embodiments herein. Additionally, the CMP pad conditioner 2521 can include a second major surface 2524 parallel to the lateral axis 2524 and the first major surface 2523. The second major surface 2524 can include abrasive texture as described in accordance with embodiments herein. As such, the abrasive article can be a CMP pad conditioner 2521 having abrasive texture on the first major surface 2523 and the second major surface 2524 such that the CMP pad conditioner 2521 can be reversed during operation and both first major surface 2523 and second major surface 2524 may be used for conditioning operations.

As further illustrated, the CMP pad conditioner 2521 can include a side region 2527 extending between the first major surface 2523 and second major surface 2524. Notably, the side region 2527 can include a plurality of surfaces which can define an engagement structure aiding coupling between the CMP pad conditioner 2521 to a plate. In particular, the CMP pad conditioner 2521 can include a side region 2527 having a tapered surface 2522. The tapered surface 2522 can be connected to the first major surface and extend at an angle to the first major surface 2523 and at an angle to the lateral axis 2524 of the CMP pad conditioner 2521. In particular, the tapered surface 2522 can extend at a taper angle 2526 which can be at least about 1°. In other instances, the taper angle 2526 can be greater, such as at least about 5°, such as at least about 8°, or even at least about 10°. In certain instances, the CMP pad conditioner 2521 is formed such that the taper angle 2526 defined between the tapered surface 2522 and the first major surface 2523 can be within a range between about 1° and about 25°, such as between about 5° and about 20°, such as between about 8° and about 15°.

As further illustrated and according to embodiments herein, the CMP pad conditioner 2521 can include a plurality of tapered surfaces, each of which can extend between one of the major surfaces and a side surface at the side region 2527. The tapered surfaces of the CMP pad conditioner aid proper placement and clearance of the CMP pad conditioner 2521 within the plate 2501 and reduce sharp angles, which may damage a pad during a conditioning operation.

FIGS. 25D-25G include illustrations of side regions of different CMP pad conditioners in accordance with embodiments herein. The following embodiments provide illustrations of different side region designs employing different types, number, and orientations of side surfaces making up the side regions. In particular, the side regions can include a plurality of surfaces configured to engage a sealing member for use with the abrasive tool. It will be appreciated that the features of the following embodiments can extend around an entire periphery (e.g., a circumference) of a CMP pad conditioner between and connecting the major surfaces of the CMP pad conditioner.

Figure 25D:
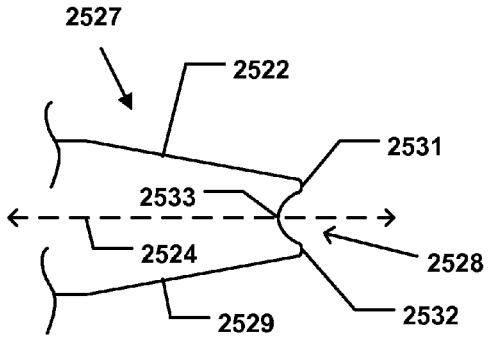
FIGS. 25D-25G include cross-sectional illustrations of portions of side regions of a CMP pad conditioner in accordance with embodiments.

FIG. 25D includes an illustration of a side region of a CMP pad conditioner in accordance with an embodiment. The side region 2527 includes tapered surfaces 2522 and 2529 that extend at angles relative to the lateral axis 2524. As further illustrated, the side region 2527 can include a groove 2528 formed by a plurality of distinct side surfaces, and particularly surfaces 2531, 2532, and 2533. The surfaces 2531 and 2532 can be curvilinear surfaces extending from the tapered surfaces 2522 and 2529, respectively. The surface 2533 extends between and connects the surfaces 2531 and 2532, and can have a particularly curved surface for complimentary engagement of a sealing member therein. According to certain designs, the surface 2533 can have a concave shape that extends axially inward into the body of the CMP pad conditioner 2521. Notably, the surfaces 2531, 2532, and 2533 form a groove absent sharp corners, which may be particularly suitable for containing pliable members, such as a sealing member, without damaging the sealing member.

Figure 25E:
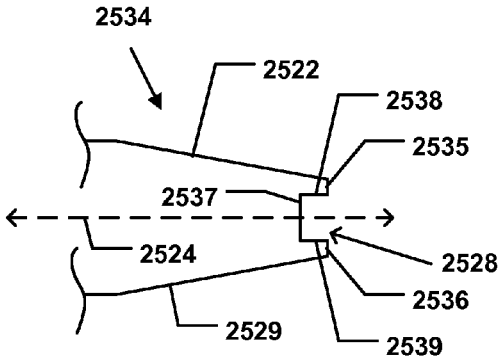

FIG. 25E includes a cross-sectional illustration of a portion of a side region of a CMP pad conditioner in accordance with an embodiment. In particular, the side region 2534 includes tapered surfaces 2522 and 2529 as described in accordance with embodiments herein. Additionally, the side region 2534 includes a groove 2528 connected to and extending between the tapered surfaces 2522 and 2529 at the side region 2534 of the CMP pad conditioner. The groove 2528 can be a generally concave shape extending radially inward into the body of the CMP pad conditioner. In certain instances, the groove 2528 can be defined by surfaces 2535, 2536, 2537, 2538, and 2539. In particular, the surfaces 2535-2539 are generally linear surfaces extending parallel or perpendicular to each other and forming right angles with each other. As a result, in the particular illustrated embodiment of FIG. 25E, the groove 2528 can have a generally rectilinear shape. That is, the surfaces 2535 and 2536 extend generally perpendicular to the lateral axis 2524 and are connected to surfaces 2538 and 2539, which can extend at a perpendicular angle to the surfaces 2535 and 2536, parallel to the lateral axis 2524. Moreover, the surface 2537 can extend between the surfaces 2538 and 2539 in a direction perpendicular to the lateral axis 2524 to form the inner most surface of the groove 2528.

Figure 25F:
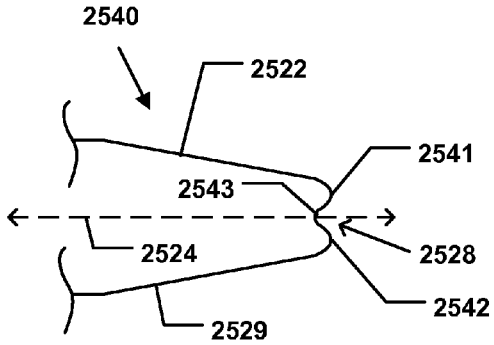

FIG. 25F includes a cross-sectional illustration of a side region of a CMP pad conditioner in accordance with an embodiment. As illustrated, the side region 2540 can include tapered surfaces 2522 and 2529 as described in accordance with embodiments herein. Additionally, the side region 2540 can includes a groove 2528 formed by a combination of surfaces including surface 2541, surface 2542, and surface 2543. The groove 2528 can have a concave portion that extends radially inward into the body fo the CMP pad conditioner. The surface 2541 can be connected to the tapered surface 2522 and have a curvilinear shape, particularly a convex shape that extends radially outward from the body of the CMP pad conditioner. The surface 2541 can be connected to the surface 2543. The surface 2543 can be connected to the surface 2542, which like the surface 2541 can have a curvilinear surface that extends radially outward from the body of the CMP pad conditioner. Surface 2542 can be connected to the tapered surface 2529. As illustrated, in accordance with the embodiment of FIG. 25F, the groove 2528 has a curvilinear contour defined by surfaces 2541, 2542, and 2543, but the volume of the groove 2528 is less than the grooves illustrated in the embodiments of FIGS. 25D and 25E.

Figure 25G:
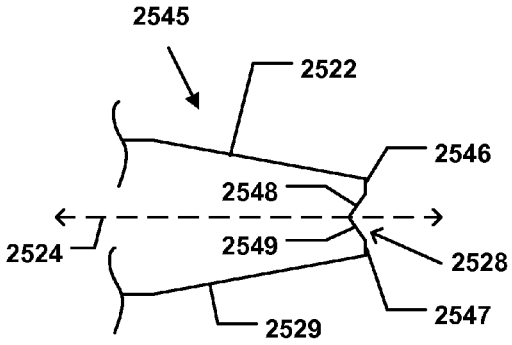

FIG. 25G includes a cross-sectional illustration of a side region of a CMP pad conditioner in accordance with an embodiment. The side region 2545 includes tapered surfaces 2522 and 2529 as described in accordance with embodiments herein. Additionally, the side region 2545 can include a groove 2528 having a generally linear contour defined by linear surfaces 2546, 2546, 2548, and 2549. As illustrated, the surfaces 2546 and 2547 can extend at a generally perpendicular angle to the lateral axis 2524 from respective tapered surfaces 2522 and 2529. The surfaces 2548 and 2549 can be connected to surfaces 2546 and 2547, respectively. The surfaces 2548 and 2549 can define a groove 2528 extending radially inward into the body of the CMP pad conditioner. The surfaces 2548 and 2549 can be connected to the surfaces 2546 and 2547 at a generally perpendicular angle and can also be angled relative to the lateral axis 2524. Additionally, the surfaces 2548 and 2549 are generally linear surfaces extending at an angle to the surfaces 2546 and 2547 respectively. In certain embodiments, the angle formed between the surfaces 2548 and 2549 can be an obtuse angle, that is, an angle greater than about 90 degrees.

Figure 26A:
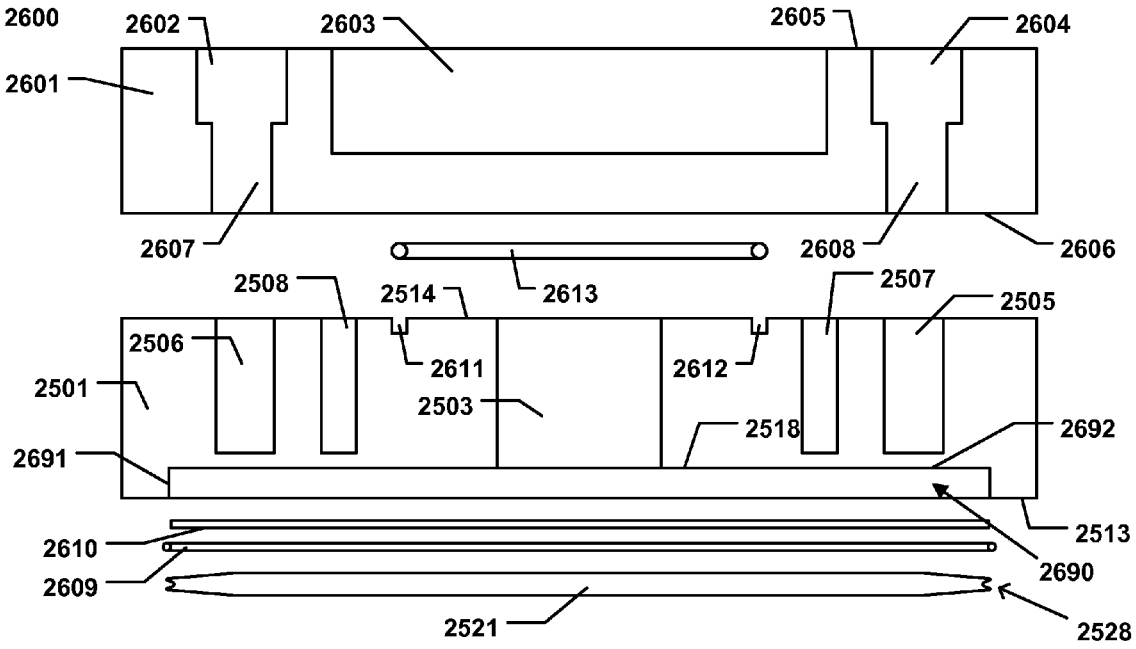
FIG. 26A includes a cross-sectional illustration of a conditioning system including a plate and CMP pad conditioner in accordance with an embodiment.

FIG. 26A includes a conditioning system including a plate and an abrasive article, otherwise referred to as a CMP pad conditioner, in accordance with an embodiment. The conditioning system 2600 can include a holder 2601 which can be configured to be removably coupled to a plate 2501, which in turn can be removably coupled to a CMP pad conditioner 2521. The conditioning system of FIG. 26A is illustrated as including particular components that can be separated from each other prior to assembly of the conditioning system. The assembled version of the conditioning system 2600 is further illustrated in FIG. 26B.

The holder 2601 can include a central opening 2603 extending axially into the body of the holder 2601. The opening 2603 may facilitate coupling of the holder with other objects used during the CMP process which are not illustrated.

The holder 2601 further can include openings 2602 and 2604 extending into the body from the upper surface 2605 of the holder 2601. The openings 2607 and 2608 can be radially spaced apart from each other on opposite sides of the central opening 2603 and circumferentially spaced apart from each other. The openings 2607 and 2608 can extend into the body of the holder 2601 from the rear surface 2606 of the holder 2601. Notably, the opening 2602 can be connected to the opening 2607 such that the combination of openings 2602 and 2607 extend through the entire thickness of the body of the holder 2601 and thus connected to the upper surface 2605 and rear surface 2606. Likewise, the opening 2604 can be connected to the opening 2608 such that the combination of openings 2604 and 2608 form an opening extending through the entire thickness of the body of the holder 2601 and connecting the upper surface 2605 and rear surface 2606. It will be appreciated that the openings 2602 and 2604 can have a greater width (e.g. diameter) as compared to their respective connected openings 2607 and 2608. This design can facilitates engagement of fasteners therein such that the head of a fastener can be contained within and properly positioned within the openings 2602 and 2604, without necessarily extending into the openings 2607 and 2608.

The conditioning system 2600 further includes a plate 2501 having those features as described in FIG. 25B. As further illustrated in FIG. 26A, the plate 2501 can include a recess 2611 extending axially into the body of the plate 2501 from the upper surface 2514 of the plate 2501. The recess 2611 can be formed between the central opening 2503 and opening 2508 within the body of the plate 2501. Additionally, the plate 2501 can include a recess 2612 extending axially into the body of the plate 2501 from the upper surface 2514 of the plate 2501. The recess 2612 can be positioned between the central opening 2503 and opening 2507. It will be appreciated that the recess 2611 and recess 2612 can be connected and define a single recess extending circumferentially around the central opening 2503. According to certain embodiments, the recesses 2611 and 2612 can be a single, annular-shaped recess extending around the central opening 2503.

Figure 26B:
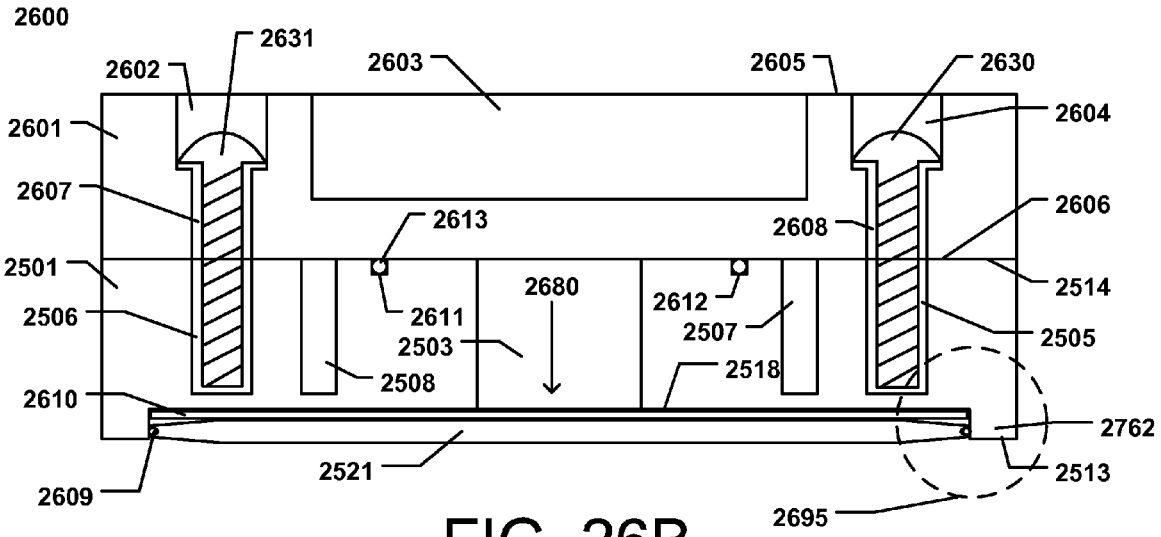
FIG. 26B includes a cross-sectional illustration of a conditioning system including a plate and CMP pad conditioner in accordance with an embodiment.

In particular, the conditioning system 2600 can be formed such that a sealing member 1613 can be disposed within the recess 2611 and 2612 during assembly (See, FIG. 26B). Notably the sealing member 1613 can be a single, monolithic piece, such as an O-ring. As such, the sealing member 2613 can be seated within the recesses 2611 and 2612, which as described herein can describe an annular-shaped recess. The sealing member 2613 can be provided within the recesses 2611 and 2612 for sealing the central opening 2503 from fluids and/or swarf generated during conditioning operations.

The conditioning system 2600 can further include a member 2610 configured to be positioned within the cavity 2690 formed within the upper surface 2513 of the plate 2501. Notably, unlike the embodiment of FIG. 25B, the cavity 2690 may not necessarily include discrete cavity portions. Rather, the cavity 2690 can be an opening extending axially inward into the body of the plate 2501. The cavity 2690 can be defined by a surface 2691 extending radially inward perpendicular to the upper surface 2513 of the plate 2501. Additionally, the cavity 2690 can be defined by a bottom surface 2692 connected to the surface 2691 and extending at a generally perpendicular angle to the surface 2691 and in a generally parallel direction to the upper surface 2514 of the plate 2501.

The member 2610 can be sized and shaped such that it is configured to be positioned within the cavity 2690 during assembly of the conditioning system 2600. In accordance with embodiments herein, the member 2610 can be a protective layer or pad of material similar to the protective layer 261 described herein. That is, for example, the member 2610 can be made of a polymer material, such as a thermoset, thermoplastic, resin, elastomer, and a combination thereof. The member 2610 can protect the abrasive texture of the CMP pad conditioner 2521 when it is assembled within the conditioning system, particularly within the cavity 2690 of the plate 2501.

The conditioning system further includes a CMP pad conditioner 2521 that may be combined with a sealing member 2609 in accordance with an embodiment. Notably, the sealing member 2609 may be positioned within the groove 2528 of the CMP pad conditioner 2521 to facilitate sealing between the plate 2501 and CMP pad conditioner 2521. The sealing member can be a pliable material, such as a polymer material, and particularly a thermoset, thermoplastic, elastomer, resin, or a combination thereof.

FIG. 26B includes a cross-sectional illustration of the conditioning system of FIG. 26A after assembly in accordance with an embodiment. As illustrated, the holder 2601 can overly and can be directly connected to the plate 2501. The CMP pad conditioner 2521 can be removably coupled to the plate 2501 such that it is contained within the cavity 2690. Notably, in the assembled form, the rear surface 2606 of the holder 2601 can be directly connected to the upper surface 2514 of the plate 2501. Moreover, the opening 2607 of the holder 2601 can be axially aligned with the opening 2506 of the plate 2501 such that a fastener 2631 can be placed within the opening 2602 and extend through opening 2607 of the holder 2601 into the opening 2506 of the plate 2501 to couple the holder 2601 and plate 2501 to each other. Additionally, the opening 2608 can be axially aligned with the opening 2505 such that a fastener 2630 can be placed within the opening 2604 and extend through the openings 2608 and 2505 to couple the holder 2601 and plate 2501 to each other.

As further illustrated, the sealing member 2613 can be contained within the recesses 2611 and 2612 between the rear surface 2606 of the holder 2601 and upper surface 2514 of the plate 2501. The sealing member 2613 can engage the surfaces of the recesses 2611 and 2612 and the rear surface 2606 of the holder 2601 to form a seal and reduce the likelihood of fluids and/or swarf from entering the center opening 2503.

As further illustrated in FIG. 26B, the member 2610 can be contained within the cavity 2690 such that a major surface of the member 2610 can be abutting the bottom surface 2692 of the cavity 2690. Additionally, the opposite major surface of the member 2610 can be abutting a major surface of the CMP pad conditioner 2521 to protect the abrasive texture from damage while contained within the cavity 2590. As further illustrated, in the assembled form, the CMP pad conditioner 2521 can be contained within cavity 2690, such that a major surface of the CMP pad conditioner 2521 is abutting the member 2610, and the opposite major surface of the CMP pad conditioner 2521 is protruding from the plate 2501. The major surface of the CMP pad conditioner 2521 protruding from the plate 2501 can extend in an axial direction beyond the plane defined by the upper surface 2513 of the plate 2501. As such, the major surface of the CMP pad conditioner 2521 is placed in a position to accomplish conditioning and the upper surface 2513 of the plate 2501 can be spaced apart from the pad during a conditioning operation.

After sufficient use of the abrasive article, disassembly of the conditioning system 2600 can be initiated by a user removing fasteners 2631 and 2630 from respective openings to decouple the holder 2601 and plate 2501. After removing the fasteners 2631 and 2630, the plate 2501 and CMP pad conditioner 2521 may still be coupled to each other. To remove the CMP pad conditioner 2521 from the plate 2501, the user may use an object or tool (e.g., a fastener) to extend through the central opening 2503 from the rear surface 2514 of the plate 2501 in the direction 2680. The object can be extended in the direction 2680 through the central opening 2503 until the object abuts the rear surface of the member 2610 or CMP pad conditioner 2521. Applying sufficient force in the direction 2680 can facilitate removal of the CMP pad conditioner 2521 from the cavity 2590 of the plate 2501.

Depending upon the wear status of the CMP pad conditioner 2521, the CMP pad conditioner 2521 may be reversed, such that the opposite major surface and the corresponding abrasive texture on the opposite major surface is positioned to protrude from the plate 2501. Upon reorienting the CMP pad conditioner 2521, the conditioner can be coupled with the plate 2501 in the cavity 2590 and used to continue the dressing operation. After flipping the CMP pad conditioner 2521, fasteners 2630 and 2631 may be positioned within respective openings to couple the holder 2601 and plate 2501 and complete reassembly of the conditioning system 2600.

Figure 27A:
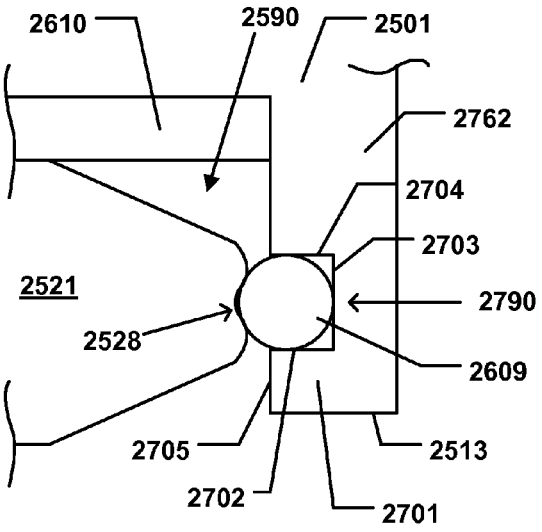
FIGS. 27A-27C include cross-sectional illustrations of a portion of a CMP pad conditioner and plate in accordance with an embodiment.
Figure 27B:
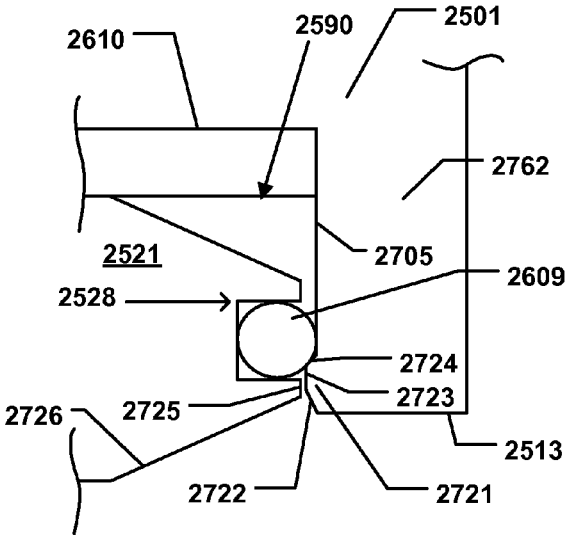
Figure 27C:
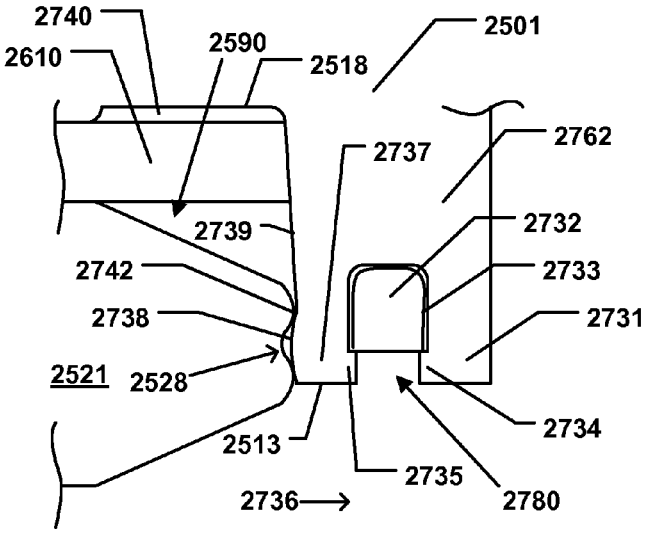

FIGS. 27A-27C include cross-sectional illustrations of portions of a CMP pad conditioner and plate in accordance with an embodiment. Notably, the following embodiments of FIGS. 27A-27C demonstrate various engagement structures and coupling mechanisms that can be employed with any of the embodiments herein to achieve removable coupling between a CMP pad conditioner and a plate. In such embodiments, the CMP pad conditioner and the plate can utilize various engagement structures have certain surface contours, sealing members, biasing members, and a combination thereof to facilitate removable coupling between the CMP pad conditioner and plate. In particular, the following embodiments of FIGS. 27A-27C can include various coupling mechanisms for use between the CMP pad conditioner and plate, generally at the region 2695 illustrated in FIG. 26B.

FIG. 27A includes a cross-sectional illustration of a portion of a CMP pad conditioner and plate in accordance with an embodiment. In particular, the embodiment of FIG. 27A includes an illustration of a particular engagement structure utilizing particular coupling surfaces and a sealing member to facilitate removable coupling between the CMP pad conditioner 2521 and the plate 2501. In particular, the plate 2501 includes an arm 2762 extending axially from the body of the plate 2501 and defining a cavity 2590 for engagement of the CMP pad conditioner 2521 as described in embodiments herein. In particular, the arm 2762 can include a flange 2701 extending radially inward at a generally perpendicular angle to the arm 2762.

The arm 2762 can have a groove 2790 (i.e., a plate groove) defined within an interior surface 2705. In particular, the groove 2790 can be formed by a surface 2702, which is connected to and extending at a generally perpendicular angle to the interior surface 2705. The groove 2790 can further be defined by a surface 2703 connected to the and extending at a generally perpendicular angle to the surface 2702. Moreover, the groove 2790 can further be defined by a surface 2704 connected to and extending at a generally perpendicular angle to the surface 2703. The surfaces 2704 and 2702 can be generally parallel to each other. As such, the surfaces 2702, 2703, and 2704 can define a groove 2790 within the inner surface 2705 of the arm 2762 having a generally rectilinear contour.

As further illustrated, a sealing member 2609 can be contained within the groove 2790 when the CMP pad conditioner and plate 2501 are assembled. As further illustrated, in the assembled position, the CMP pad conditioner 2521 is configured to abut and contact the sealing member 2609 contained within the groove 2790 of the plate 2501. Notably, the sealing member 2609 is positioned such that a majority of the volume of the sealing member 2609 is contained within the groove 2790 and only a fraction of the surface of the sealing member 2609 is contacted by the groove 2528 of the CMP pad conditioner 2521. Accordingly, in the assembled state, the CMP pad conditioner 2521 can be contained within the cavity 2590 and the groove 2528 of the CMP pad conditioner 2521 can be abutting the sealing member 2609 contained within the groove 2790. It will be appreciated, that in the assembled state, the sealing member may be deformed in a manner to allow some contact between the CMP pad conditioner 2521 and arm 2762 of the plate 2501, however, this may not necessarily always be the case. Such a configuration facilitates removable coupling of the CMP pad conditioner 2521 with the plate 2501 and further facilitates sealing of the connection between the CMP pad conditioner 2521 and plate 2501.

FIG. 27B includes a cross-sectional illustration of a portion of the CMP pad conditioner 2521 and a plate 2501 and particularly the engagement structure used for removable coupling between the CMP pad conditioner 2521 and plate 2501. As illustrated, the CMP pad conditioner 2521 can have a groove 2528 extending radially into the body of the CMP pad conditioner 2521 for engagement of a sealing member 2609 therein. Unlike the embodiment of FIG. 27A, the embodiment of FIG. 27B is formed such that a majority of the volume of the sealing member 2609 is contained within a groove 2528 formed within the CMP pad conditioner 2521.

As further illustrated, the plate 2501 can include an arm 2762 extending axially outward from the body of the plate 2501 aiding the formation of the cavity 2590 within the plate 2501. The arm 2762 can include a flange portion 2721 proximate to the upper surface 2513 and extending radially inward. The flange portion 2721 is configured to engage a portion of the sealing member 2609 in the assembled state. The flange 2721 can include a first surface 2722 extending at an angle from the upper surface 2513, a surface 2723 connected to and extending at an angle to the surface 2722 and generally perpendicular to the upper surface 2513, and a surface 2724 connected to and extending at an angle to the surface 2723 to form the radially inward protruding flange portion 2721.

During assembly the CMP pad conditioner 2521 having the sealing member 2609 contained within the groove 2528 can be fitted into the plate 2501 such that the sealing member 2609 extends beyond and axially inward and radially outward of the flange portion 2721. In the assembled state as illustrated, the sealing member 2609 can be abutting the surface 2724 of the flange portion and the inner surface 2705 of the arm 2762.

As illustrated, the surfaces of the CMP pad conditioner 2521 can be spaced apart from the surfaces of the plate 2501, such that the sealing member 2609 maintains the connection between the plate 2501 and the CMP pad conditioner 2521. However, in certain instances, the surface 2725 of the CMP pad conditioner 2521 may engage and abut a surface of the plate 2501, particularly the surface 2723 of the flange portion 2721. It will be appreciated, that during assembly and disassembly, the sealing member 2609 can be deformed, such that the it can axially translate by the flange portion 2721 and particularly by the surface 2723 of the flange portion. The sealing member 2609 may further be formed and positioned such that it is deformed while the CMP pad conditioner 2521 is engaged within the cavity 2590 of the plate 2501.

FIG. 27C includes a cross-sectional illustration of a portion of a CMP pad conditioner 2521 and plate 2501 in particularly engagement structures utilized for removable coupling of the CMP pad conditioner 2521 and plate 2501. As illustrated, the plate 2501 can be formed such that it has a recess 2780 extending axially inward into the arm 2762 of the plate 2501 from the upper surface 2513 of the plate 2501. The recess 2780 can be defined as a space between arm portions 2737 and 2731 that can extend axially outward as protrusions or tines on either side of the recess 2780.

In accordance with one embodiment, the recess 2780 can be formed to contain a resilient member 2733. The resilient member 2733 can be a generally U-shaped member configured to fit the contours of the recess 2780 and bias the arms 2737 and 2731 into biased positions away from each other. As illustrated, the resilient member 2733 can be configured to extend along and have generally the same contour as the inner surface of the recess 2780, that is, a U-shaped contour. Moreover, in certain embodiments, the recess 2780 may be filled with a pliable material 2732. Suitable pliable materials can include organic or inorganic materials or a combination thereof. In certain instances, the pliable material 2732 can be a polymer, such as an elastomer. Use of the pliable material 2732 within the recess 2780 can provide additional resiliency against the movement of the arm 2737 in the direction 2736 toward the arm 2731.

As further illustrated, the recess 2780 can be formed with flanges 2735 and 2734 extending toward each other. The flanges 2734 and 2735 can be formed to facilitate containing the resilient member 2733 and pliable material 2732 within the recess 2780.

As further illustrated, the arm 2737 can be formed such that is has a surface 2738 extending between an inner surface 2739 and upper surface 2513 of the plate 2501. The surface 2738 can have a curved contour and be formed to engage a portion of the CMP pad conditioner 2521 during assembly between the pad conditioner 2521 and plate 2501. In particular instances, the CMP pad conditioner 2521 can be formed such that it has a groove 2528 that is configured to engage and abut the surface 2738 of the arm 2737 during assembly. For example, in the assembled form as illustrated, the groove 2528 can be formed to include a surface 2742 configured to engage an edge between the surface 2738 and surface 2739 of the plate 2501. That is, during assembly, the CMP pad conditioner 2521 can be placed within the cavity 2590 until the arm 2737 is sufficiently moved in the direction 2736 such that the surface 2742 of the CMP pad conditioner 2521 is engaged with and abuts the joint between the surface 2738 and inner surface 2739 of the arm portion 2737.

Removal of the CMP pad conditioner 2521 from the plate 2501 can include application of force to the back side of the CMP pad conditioner 2521 sufficient to urge the arm 2737 in a direction 2736 for sufficient clearance of the surface 2742 past the surface 2738 of the arm portion 2737 thus releasing the CMP pad conditioner 2521 from the cavity 2590.

As further illustrated, the inner surface 2739 of the plate 2501 can be formed to have a gap 2740 formed between a bottom surface 2518 of the cavity 2590 within the plate 2501 and a surface of the member 2610. Such a gap 2740 may provide additional flexure of the arm 2737 for suitable removable coupling between the CMP pad conditioner 2521 and plate 2501. Moreover, use of a polymer material for making the plate 2501 may further aid the flexural nature of the arm portion 2737.

Figure 28A:
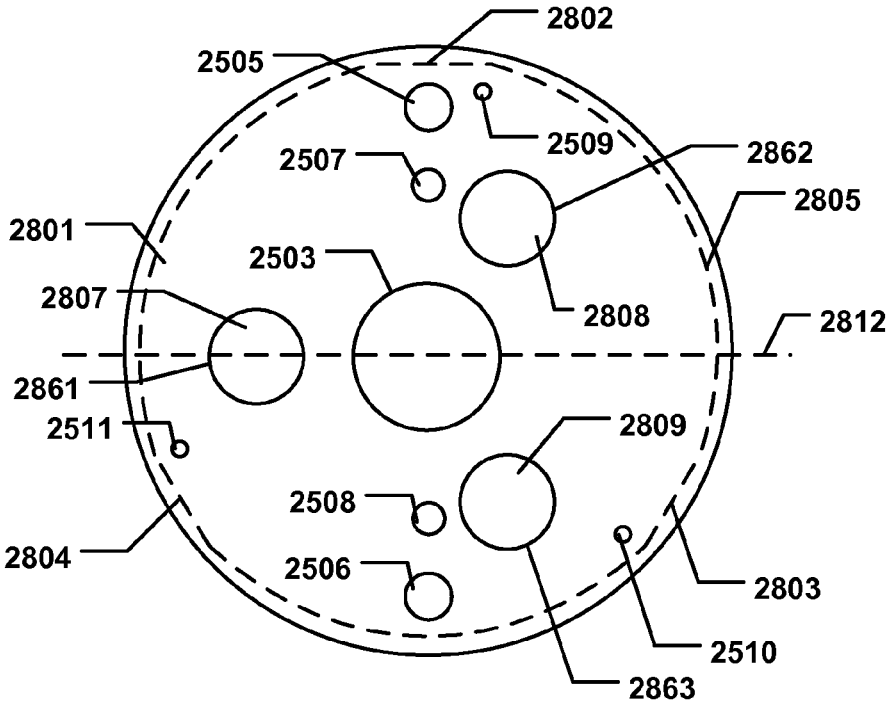
FIG. 28A includes a top view of a plate in accordance with an embodiment.

FIG. 28A includes a top view illustration of a backside of a plate in accordance with an embodiment. The plate 2801 can have a generally circular contour, and a cylindrical three-dimensional shape. As illustrated, the plate 2801 can include a central opening 2503, and openings 2505, 2506, 2507, and 2508 as described in embodiments herein. Moreover, the plate 2801 can include openings 2509, 2510, and 2511 as described in accordance with embodiments herein.

As further illustrated, the plate 2801 can include recesses 2861, 2862, and 2863 radially spaced apart from a center of the body and circumferentially spaced apart from each other around a center of the body of the plate 2801. The recesses 2861-2863 can extend axially into the body of the plate 2801 for a sufficient depth to contain certain objects therein. Notably, the recesses 2861-2863 can be equilaterally spaced apart such that approximately 120° separate the centers of the recesses 2861-2863.

In accordance with an embodiment, the recesses 2861-2863 can include magnets 2807, 2808, and 2809 contained within the recesses 2861-2863. It will be appreciated that use of magnets 2807-2809 within the body of the plate 2801 can be used to facilitate magnetic coupling between the plate 2801 and a CMP pad conditioner for removable coupling between the plate 2801 and CMP pad conditioner. As described herein, for such designs, the CMP pad conditioner may utilize a metal portion to aid magnetic coupling with the magnets 2807-2809.

As further illustrated, the plate 2801 can include a cavity as defined by dotted line 2805 having a generally circular contour. However, the cavity 2805 is formed to include a flat portion 2802, a flat portion 2803 and a flat portion 2804 within and extending along portions of the circumference of the cavity 2805. That is, the arcuate and generally circular surface of the cavity 2805 is interrupted at specific locations along the circumference by flat portions 2802-2804. The flat portions 2802-2804 are linear surface portions interrupting the generally curved surface of the cavity 2805. The flat portions 2802-2804 can facilitate proper coupling between the plate 2801 and a CMP pad conditioner, lessening the likelihood of rotation of the CMP pad conditioner within the plate 2801 during operation.

Figure 28B:
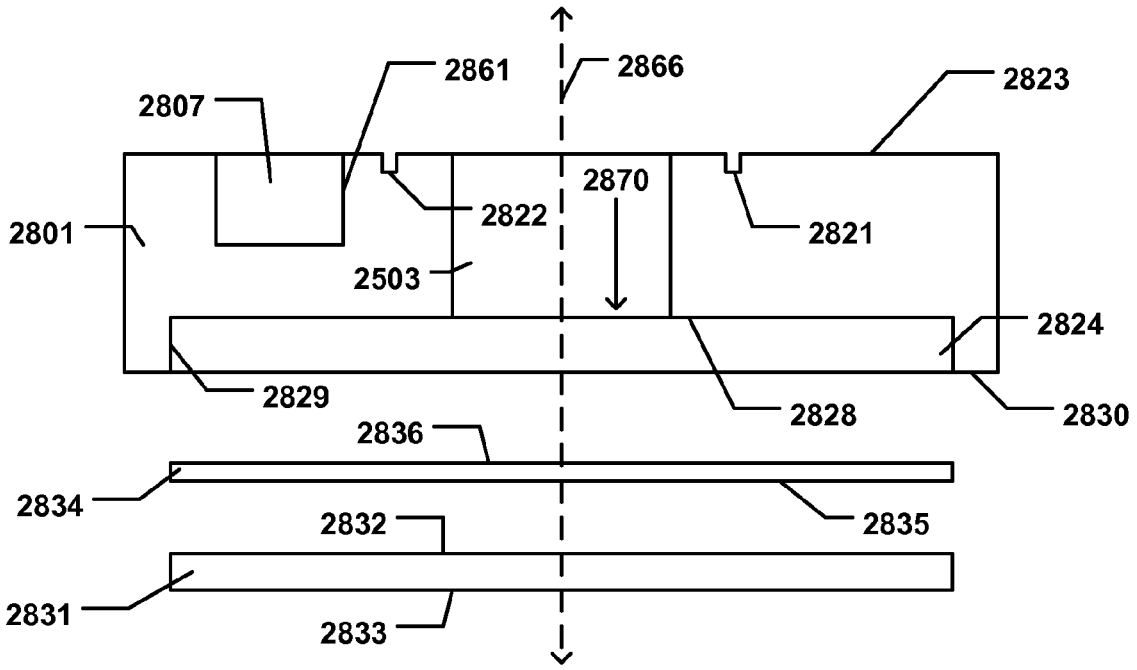
FIG. 28B includes a cross-sectional illustration of the plate of FIG. 28A in accordance with an embodiment.

FIG. 28B includes a cross-sectional illustration of a portion of the plate 2801 of FIG. 28A as viewed along a plane defined by the axis 2812. The plate 2801 can include a recess 2861 extending axially into the body of the plate 2801 and configured to contain a magnet 2807 therein. As further illustrated, the plate 2801 can be formed to include recesses 2822 and 2821 similar to those recesses described in accordance with FIG. 26A and FIG. 26B for containing a sealing member therein and sealing the plate 2801 against a holder.

As further illustrated, the plate 2801 can be formed to include a cavity 2824 extending axially inward into the body of the plate 2801. The cavity can be defined by a surface 2829 extending perpendicular to the upper surface 2830 of the plate 2801 and a bottom surface 2828 extending generally perpendicular to the axially axis 2866 and substantially parallel to the upper surface 2830 of the plate 2801. Moreover, the cavity 2824 can be contiguous with and connected to the central opening 2503 of the plate 2801 such that the central opening 2503 extends through the entire thickness of the plate 2801 along the axially axis 2866.

During assembly, a member 2834, which can be a protective layer or pad, can be inserted within the cavity 2824 such that a rear surface 2836 of the member 2834 abuts and is connected to the bottom surface 2828 of the cavity 2824. Additionally, during assembly a CMP pad conditioner 2831 having a first major surface 2832 and second major surface 2833, each of which can have abrasive texture, can be placed with the cavity 2824 of the plate 2801. Notably, the surface 2832 of the CMP pad conditioner 2831 can abut and be directly connected to an upper surface 2835 of the member 2834 when the CMP pad conditioner 2831 is contained within the cavity 2824 of the plate 2801. It will be appreciated, that while the CMP pad conditioner 2831 is illustrated as having a generally rectangular shape, it can include any features as described in accordance with CMP pad conditioners of the embodiments herein.

During disassembly of the CMP pad conditioner 2831 from the plate 2801, a user may insert an object (e.g., a fastener, an elongated tool, or hand) within the central opening 2503 of the plate 2801 to engage the member 2834, or alternatively the rear surface 2832 of the CMP pad conditioner 2831. Force may be applied to the member 2834 or CMP pad conditioner 2831 to urge the CMP pad conditioner in a direction 2870 and thus magnetically decouple the CMP pad conditioner 2831 from the magnets 2807-2809, and removably couple the CMP pad conditioner 2831 from the plate 2801.

Figure 28C:
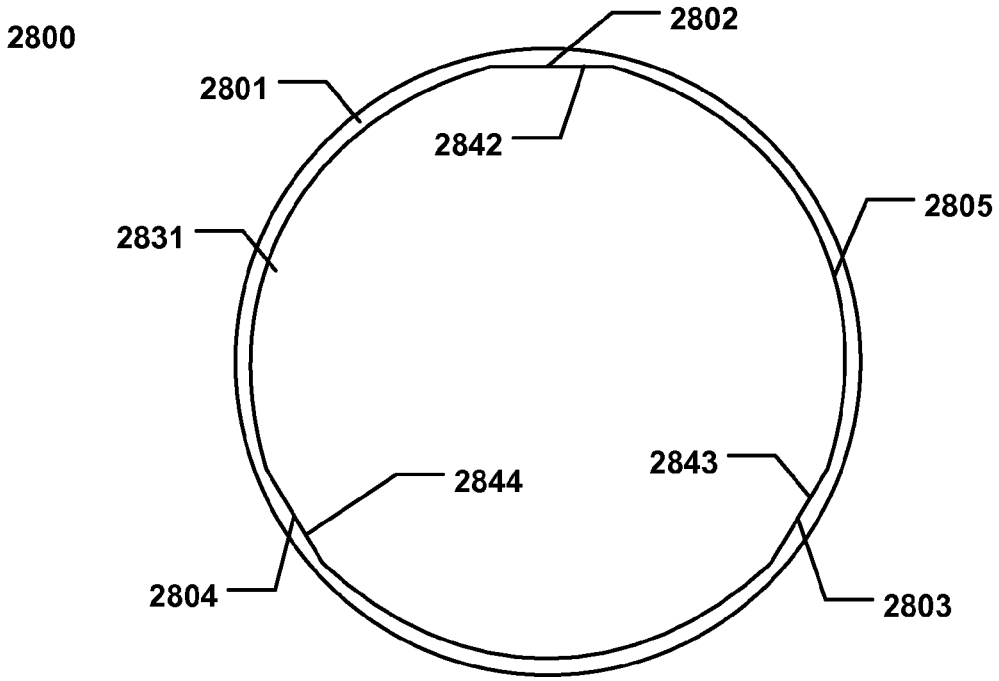
FIG. 28C includes a top view of a plate and CMP pad conditioner in accordance with an embodiment.

FIG. 28C includes a top view illustration of a plate and CMP pad conditioner coupled to each other in accordance with an embodiment. Notably, the illustration of FIG. 28C includes a CMP pad conditioner coupled to the plate of FIG. 28A. As illustrated, the plate 2801 includes flat portions 2802, 2803, and 2804, defined by linear surface regions at the circumference of the cavity configured to contain the CMP pad conditioner 2831. Moreover, the CMP pad conditioner 2831 can include complimentary flat potions 2842, 2843, and 2844 defined by linear surface regions at the circumference of the CMP pad conditioner 2831 configured to directly contact and abut the flat portions 2802, 2803, and 2804 of the plate 2801. Such an arrangement reduces the likelihood of rotation of the CMP pad conditioner 2831 within the plate 2801 during operation.

Figure 29:
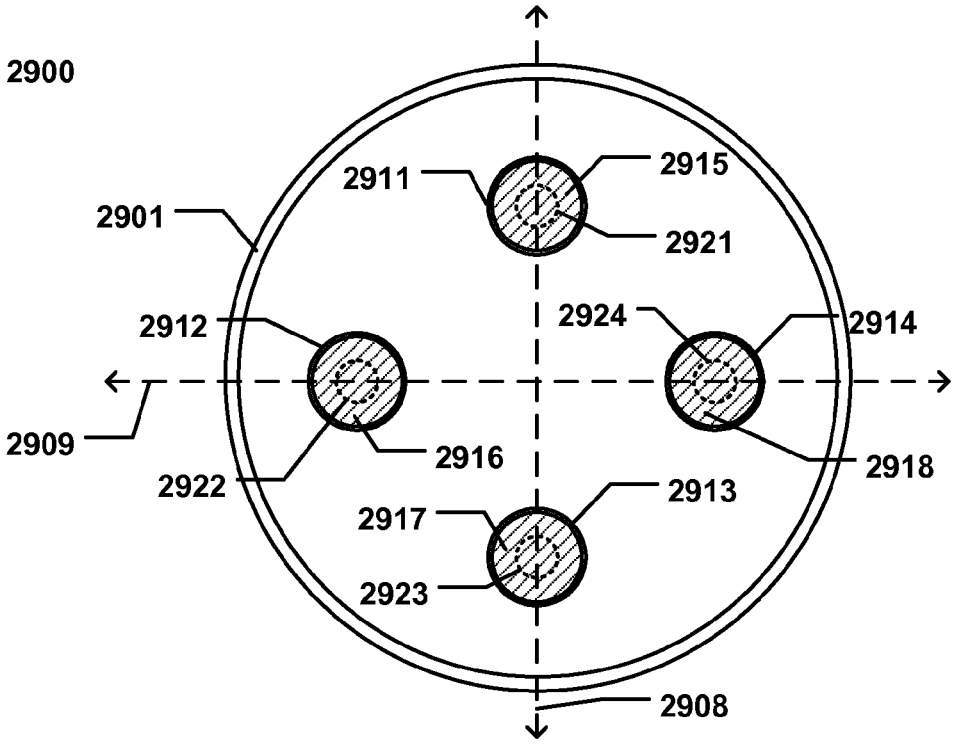
FIG. 29 includes a top view illustration of an abrasive tool in accordance with an embodiment.

FIG. 29 includes a top view illustration of an abrasive tool in accordance with an embodiment. The foregoing embodiments have been directed to abrasive articles utilizing a CMP pad conditioner that is removably coupled to a plate. However, it is also contemplated that a single plate may be used with a plurality of CMP pad conditioners. In particular, an abrasive tool may employ a plurality of CMP pad conditioners removably coupled to a single plate, wherein the plate has a plurality of recesses or cavities to accommodate and removably couple each of the CMP pad conditioners therein.

The abrasive tool 2900 can include a plate 2901 including those features described in accordance with plates of the embodiments herein. For example, the plate 2901 can have a circular contour as viewed in a top view, and a generally cylindrical three-dimensional shape. The plate 2901 can include a plurality of other openings (not illustrated) extending into the body and configured to aid coupling of the plate 2901 with another object, such as a holder.

The plate 2901 can include cavities 2911, 2912, 2913, and 2914 (2911-2914) within the upper surface of the plate 2901 that extend axially inward into the body of the plate 2901. The cavities 2911-2914 can be positioned at particular locations within the upper surface of the plate 2901, and in particular, may be arranged in a pattern around a center of the plate 2901 for proper balance during conditioning operations. The cavities 2911 and 2913 can be radially spaced apart from the center of the plate 2901, but can be positioned along an axis 2908 and circumferentially spaced apart from each other by an angle of approximately 180 degrees. Likewise, the cavities 2912 and 2914 can be radially spaced apart from a center of the plate, but can be positioned along an axis 2909 such that the cavities 2912 and 2914 can be circumferentially spaced apart from each other by an angle of approximately 180 degrees.

Each of the cavities 2911-2914 can be formed to contain a respective CMP pad conditioner 2915, 2916, 2917, and 2918. As such, the cavities 2911-2914 can include features of the embodiments herein to facilitate removable coupling between the plate 2901 and the CMP pad conditioners 2915-2918. Additionally, the CMP pad conditioners 2915-2918 can include features of the embodiments herein to facilitate removable coupling between the plate 2901 and the respective CMP pad conditioner. Notably, the CMP pad conditioners 2915-2918 are reversible, such that each of the CMP pad conditioners 2915-2918 has abrasive texture on first and second major surfaces of the substrate.

While the embodiment of FIG. 29 has illustrated a plate 2901 having four cavities 2911-2914, which are configured to contain four distinct and separate CMP pad conditioners 2915-2918, such an embodiment is not intended to be limiting on the number of cavities and CMP pad conditioners that may be included on a single plate. Other embodiments may employ a plate having only 2 cavities. While other embodiments may utilize a plate having a different number of cavities (and a corresponding number of CMP pad conditioners) such as at least about 3 cavities, at least about 4 cavities, at least about 6 cavities, at least about 10 cavities, at least about 16 cavities, at least about 24 cavities, or even at least about 30 cavities. In particular, any number of cavities may be utilized, typically such that the number of cavities is a multiple or two.

As further illustrated, the plate 2901 can be formed to have an opening 2921 within the cavity 2911, an opening 2922 within the cavity 2912, an opening 2923 within the cavity 2913, and an opening 2924 within the cavity 2914. The openings 2921-2924 can be formed in the rear surface of the plate 2901 and extend axially into the body of the plate 2901. As illustrated, the openings 2921-2924 can be formed to extend from the back surface to a bottom surface of the respective cavities, such that the openings allow a user to access a CMP pad conditioner contained within a cavity from the back surface of the plate 2901. Such a design facilitates removable coupling between the CMP pad conditioners 2915-2918 and the plate 2901. An operator can use a tool extended through one of the openings 2921-2924 from the rear surface of the plate 2901 to access and force a CMP pad conditioner from a corresponding cavity and aid removal of the CMP pad conditioner from the cavity. The design relationships between the openings 2921-2924 and the cavities 2911-2914 is substantially the same as the design between the central opening 2503 and cavity 2590 illustrated in FIG. 25B.

The embodiments herein are directed to a method of forming an abrasive tool including reversible abrasive articles having first and second layers of abrasive grains on first and second major surfaces of the substrate. The abrasive tools can include a combination of features including coupling mechanisms including engagement structures on the abrasive article and engagement structures or coupling surfaces on the plate for removably coupling the two components. Other features according to the embodiments include superior flatness, dual abrasive surfaces having different polishing capabilities, particular shapes of components, sealing members, biasing members, particular materials, collet members, magnets, indicia indicating the wear status of the different layers of abrasive grains, and protective layers. Notably, the abrasive tools herein include a combination of elements that make use of reversible CMP pad conditioners having improved lifetime and a variety of capabilities to improve the conditioning process.

In the foregoing, reference to specific embodiments and the connections of certain components is illustrative. It will be appreciated that reference to components as being coupled or connected is intended to disclose either direct connection between said components or indirect connection through one or more intervening components as will be appreciated to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description of the Drawings, with each claim standing on its own as defining separately claimed subject matter.

What is claimed is:

1. An abrasive tool for use as a CMP pad conditioner comprising:

a plate; and an abrasive article comprising:

a solid substrate having a first major surface and a second major surface opposite the first major surface and a coupling surface having a depression configured for complementary engagement with the plate;

a first single layer of abrasive grains attached to the first major surface;

a second single layer of abrasive grains attached to the second major surface; and wherein the plate and abrasive article are removably coupled via a coupling mechanism configured for reversible operation of the abrasive article, wherein the first single layer of abrasive grains and second single layer of abrasive grains are spaced apart from the plate.

2. The abrasive tool of claim 1, wherein the coupling mechanism includes an engagement structure attached to the abrasive article.

3. The abrasive tool of claim 1, wherein the coupling mechanism includes a coupling surface on the plate.

4. The abrasive tool of claim 1, wherein the engagement structure includes a structure selected from the group of structures consisting of latches, fasteners, clamps, interference fit connections, and a combination thereof.

5. A method of dressing a CMP pad comprising:

coupling an abrasive article to a dressing machine, the abrasive article comprising:

a plate; and a CMP pad conditioner removably coupled to the plate, the CMP pad conditioner comprising a solid substrate having a first major surface and a second major surface opposite the first major surface, wherein the abrasive article comprises a first single layer of abrasive grains at the first major surface of the substrate spaced apart from the plate, and a second single layer of abrasive grains at the second major surface of the substrate spaced apart from the plate, and wherein the abrasive article is mounted on the dressing machine to expose the first abrasive surface;

contacting the first abrasive surface to a surface of a first CMP pad and moving the first CMP pad relative to the first abrasive surface to condition the first CMP pad;

inverting the abrasive article to expose the second abrasive surface; and contacting the second abrasive surface to a surface of a second CMP pad and moving the second CMP pad relative to the second abrasive surface to condition the second CMP pad.

6. The method of claim 5, wherein the plate is directly coupled to the dressing machine.

7. The method of claim 6, wherein inverting the abrasive article comprises:

removing the abrasive article from the plate;

inverting the abrasive article; and coupling the abrasive article to the plate, wherein the second single layer of abrasive grains is exposed to conduct a conditioning operation.

8. The method of claim 7, wherein during removing the abrasive article from the plate, the plate remains coupled to the dressing machine.

9. The method of claim 5, wherein the first single layer of abrasive grains is used for an expected conditioning lifetime before the abrasive article is inverted.

10. The abrasive tool of claim 1, further comprising a first bonding layer overlying the first surface of the substrate and having the first single layer of abrasive grains contained therein.

11. The abrasive tool of claim 1, wherein the wherein the first single layer of abrasive grains comprises a flatness of not greater than about 0.02 cm as measured by optical, auto-focusing technology.

12. The abrasive tool of claim 10, wherein the first bonding layer comprises a transition metal.

13. The abrasive tool of claim 1, further comprising a second bonding layer overlying the second surface of the substrate and having the second single layer of abrasive grains contained therein.

14. The abrasive tool of claim 1, wherein the substrate comprises a material selected from the group consisting of metals, metal alloys, ceramics, and a combination thereof.

15. The abrasive tool of claim 1, wherein the substrate comprises a material having an elastic modulus of at least 2E3 MPa.

* * * * *

UNITED STATES PATENT AND TRADEMARK OFFICE

CERTIFICATE OF CORRECTION

PATENT NO. : 8,342,910 B2
APPLICATION NO. : 12/651326
DATED : January 1, 2013
INVENTOR(S) : Dinh-Ngoc et al.

It is certified that error appears in the above-identified patent and that said Letters Patent is hereby corrected as shown below:

In the Claim

Column 44, line 9, claim 15, delete "2E3" and insert therefor -- 2E3 --

Signed and Sealed this
Twenty-first Day of October, 2014

Michelle K. Lee

Michelle K. Lee
*Deputy Director of the United States Patent and Trademark Office*